US009579670B2

(12) United States Patent
Sasaki et al.

(10) Patent No.: US 9,579,670 B2
(45) Date of Patent: Feb. 28, 2017

(54) DISPENSING CONTAINER

(75) Inventors: Tsuyoshi Sasaki, Tokyo (JP); Takefumi Kuriyama, Tokyo (JP); Shigeo Iizuka, Tokyo (JP); Hiroshi Mizushima, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 228 days.

(21) Appl. No.: 14/239,287

(22) PCT Filed: Aug. 21, 2012

(86) PCT No.: PCT/JP2012/005240

§ 371 (c)(1),
(2), (4) Date: Feb. 18, 2014

(87) PCT Pub. No.: WO2013/031136

PCT Pub. Date: Mar. 7, 2013

(65) Prior Publication Data

US 2014/0209639 A1 Jul. 31, 2014

(30) Foreign Application Priority Data

Aug. 31, 2011 (JP) ..... 2011-190070
Aug. 31, 2011 (JP) ..... 2011-190081
Nov. 30, 2011 (JP) ..... 2011-262941

(51) Int. Cl.
*B67D 7/76* (2010.01)
*B05B 11/00* (2006.01)
(Continued)

(52) U.S. Cl.
CPC ..... *B05B 11/0005* (2013.01); *B05B 7/0037* (2013.01); *B05B 11/0029* (2013.01);
(Continued)

(58) Field of Classification Search
CPC ..... B05B 11/0005; B05B 7/0037; B05B 11/0029; B05B 11/0032; B05B 11/047; B65D 1/323; B65D 51/1644
(Continued)

(56) References Cited

U.S. PATENT DOCUMENTS 3,474,936 A * 10/1969 McDonnell ..... B05B 11/0032 222/211
4,340,157 A * 7/1982 Darner ..... B05B 11/043 222/148
(Continued)

FOREIGN PATENT DOCUMENTS

CA 2683128 A1 11/2008
EP 0 624 401 A1 11/1994
(Continued)

OTHER PUBLICATIONS

JPH0811961A—English Translation, Feb. 2016.*
(Continued)

*Primary Examiner* — J. Casimer Jacyna
*Assistant Examiner* — Benjamin R Shaw
(74) *Attorney, Agent, or Firm* — Oliff PLC

(57) ABSTRACT

A dispensing container that dispenses a liquid contained therein in foam includes: a container body storing therein a liquid; and a base cap mounted to a mouth of the container body. The container body is flexible so that a squeeze operation may be performed on the container body. The base cap is provided, on a top wall, with a nozzle forming a tubular passage communicating with a front end orifice. The nozzle is provided with a foaming mechanism for the liquid at an upstream end portion and with a through-hole in a predetermined position on a circumferential wall of the nozzle that is downstream of the foaming mechanism. The through-hole is provided with a check valve, and the front
(Continued)

end orifice communicates with an inside of the container body through the through-hole.

9 Claims, 37 Drawing Sheets

(51) Int. Cl.

| | |
|---|---|
| ***B65D 1/32*** | (2006.01) |
| ***B65D 51/16*** | (2006.01) |
| ***B05B 7/00*** | (2006.01) |
| ***B05B 11/04*** | (2006.01) |

(52) U.S. Cl.
CPC ..... *B05B 11/0032* (2013.01); *B05B 11/047* (2013.01); *B65D 1/323* (2013.01); *B65D 51/1644* (2013.01)

(58) Field of Classification Search
USPC ..... 222/190, 109, 110, 571, 211
See application file for complete search history.

(56) References Cited

U.S. PATENT DOCUMENTS

| | | | | |
|---|---|---|---|---|
| 5,156,307 | A * | 10/1992 | Callahan | B05B 7/0037 222/190 |
| 5,823,400 | A * | 10/1998 | Omori | B05B 11/0018 222/318 |
| 2002/0130198 | A1* | 9/2002 | Bennett | B05B 7/0037 239/343 |
| 2004/0060945 | A1* | 4/2004 | Cater | B05B 7/0031 222/1 |
| 2010/0126522 | A1 | 5/2010 | Fujinuma et al. | |
| 2010/0126523 | A1* | 5/2010 | Fujinuma | B05B 11/048 132/221 |
| 2011/0284421 | A1* | 11/2011 | Lane | A61Q 5/10 206/581 |
| 2013/0068794 | A1* | 3/2013 | Kodama | B05B 7/0037 222/190 |

FOREIGN PATENT DOCUMENTS

| | | | | |
|---|---|---|---|---|
| JP | U-58-174272 | | | 11/1983 |
| JP | U-63-21250 | | | 2/1988 |
| JP | U-2-102366 | | | 8/1990 |
| JP | H0568852 | U | | 9/1993 |
| JP | H07-25326 | Y2 | | 6/1995 |
| JP | H0725326 | Y | * | 6/1995 |
| JP | U-7-39948 | | | 7/1995 |
| JP | A-8-11961 | | | 1/1996 |
| JP | H0811961 | A | * | 1/1996 |
| KR | 10-2010-0015917 | A | | 2/2010 |
| WO | WO 2008/136433 | A1 | | 11/2008 |
| WO | WO 2008/136441 | A1 | | 11/2008 |

OTHER PUBLICATIONS

JPH0725326Y—English Translation, Feb. 2016.*
Aug. 19, 2015 Extended Search Report issued in European Patent Application No. 12828097.1.
Feb. 18, 2015 Office Action issued in Canadian Patent Application No. 2,842,140.
International Search Report issued in International Patent Application No. PCT/JP2012/005240 dated Nov. 6, 2012.
Nov. 27, 2014 Office Action issued in Chinese Application No. 2012800421283.
Oct. 30, 2015 Office Action issued in Australian Patent Application No. 2012303454.
Extended European Search Report issued in Application No. 14174753.5 dated Sep. 23, 2014.
Apr. 2, 2015 Search Report issued in Australian Patent Application No. 2012303454.
Feb. 25, 2015 Office Action issued in Korean Patent Application No. 10-2014-7008285.
Apr. 14, 2015 Office Action issued in Japanese Application No. 2011-190070.
Apr. 21, 2015 Office Action issued in Japanese Application No. 2011-190081.
Sep. 23, 2015 Office Action issued in Canadian Application No. 2,842,140.

* cited by examiner

B-B Sectional View

C Arrow View

D-D Sectional View

A-A Sectional View

B-B Sectional View

Perspective View

C-C Sectional View

D-D Sectional View

DISPENSING CONTAINER

TECHNICAL FIELD

The present invention relates to a dispensing container configured to dispense a contained liquid in foam with use of squeeze property of a container body.

BACKGROUND ART

Patent Literature 1 discloses a utility model directed to a dispensing container so-called squeeze foamer container configured to cause a liquid in a container body to join with air in an air-liquid mixing chamber provided inside with use of squeeze property of the container body, to form an evenly foamed liquid by letting the mixture of liquid and air pass through a foam-uniformizing tubular body having a tubular-shaped net holder provided with a net at upper and lower ends thereof, and to dispense the foamed liquid from a nozzle. Squeeze foamer containers of the kind are used in a wide variety of applications, such as for hair cosmetic and for cleansing agents used in a bath, a kitchen, and a toilet room.

In such a dispensing container, when pressure applied to the container body is released, a circumferential wall of a trunk is elastically restored from a squeezed state under the pressure, which is what is called squeeze-back. Due to the squeeze-back, pressure inside the container body is lowered, and outer air is introduced into the container body through an outer-air inlet passage provided on an outer circumferential surface of the foam-uniformizing tubular body.

Patent Literature 2 also proposes a dispensing container including a foaming member made of a mesh and the like incorporated in a passage of content, wherein, in response to squeezing of a flexible trunk, the content is caused to be mixed with air, and the mixture of the content and air is also caused to pass through the foaming member to be foamed. The foamed content is expelled from an ejection orifice of a nozzle.

CITATION LIST

Patent Literature

Patent Literature 1: Japanese Utility Application Publication No. H0739948

Patent Literature 2: Japanese Utility Application Publication No. S58174272

SUMMARY OF THE INVENTION

Technical Problems

In the aforementioned dispensing containers, when the pressure applied to the container body is released and outer air is introduced into the container body through the outer-air inlet passage, foam gathering in an upper portion of the foam-uniformizing tubular body is drawn to the outer-air inlet passage, and the foam drawn to the inlet passage creates resistance. As a result, it takes time for the shape of the trunk to be restored, and the problem of poor dispensing operability arises, e.g., where the next dispensing operation may not be carried out immediately.

Furthermore, although the dispensing containers of the kind is expected to advantageously prevent problems, such as liquid draining after an dispensing operation, the subsequent liquid dripping from an outlet, and solidification inside the nozzle, by causing the foamed liquid remaining in the outlet and the nozzle after the dispensing operation to flow backward toward a direction of the container body with use of a suction back function (which is also called back suction function) caused by the aforementioned squeeze back, when the foamed liquid is drawn to the inlet passage as described above, the problem of degradation of the suction back function also arises.

In view of the above problems found in the conventional technologies, the present invention aims to create a structure in the dispensing container of a squeeze foamer type that is capable of causing the container body to be smoothly restored by the squeeze back after a dispensing operation and is also capable of sufficiently exerting the suction back function within the nozzle. The present invention is to provide a dispensing container for a foamed liquid that has excellent dispensing operability, that does not suffer from the liquid dripping or the like and has excellent hygiene, and that is capable of reducing costs of components.

Solution to Problems

A first aspect of the present invention resides in a dispensing container that dispenses a liquid contained therein in foam, including:

a container body including a flexible trunk storing therein the contained liquid; and a base cap mounted to a mouth of the container body, wherein the base cap is provided at a top wall thereof with a nozzle that forms a tubular passage communicating with a front end orifice, the nozzle is provided in an upstream end portion thereof with a foaming mechanism for the liquid, a through-hole is provided in a predetermined position on a circumferential wall of the nozzle that is downstream of the foaming mechanism, the through-hole is provided with a check valve, and the front end orifice communicates with an inside of the container body through the through-hole With the above structure, the through-hole provides a separate route from the foaming mechanism provided in the upstream end portion of the nozzle for letting the front end orifice communicated with the inside of the container body. Accordingly, during squeeze back, even when the foamed liquid has high flow resistance near the foaming mechanism employing a foaming member or the like, outer air may directly enter the container body through the through-hole via the front end orifice and the nozzle. As a result, a shape of the container body is restored to the original shape quickly, and a dispensing operation by squeezing is smoothly performed.

Furthermore, by providing the through-hole in the predetermined position in the nozzle that is downstream of the foaming mechanism, the foamed liquid remaining at least in a region in the nozzle that extends from the front end orifice to the through-hole is returned into the container body through the through-hole in accordance with flow of outer air from the front end orifice. As a result, the problem of liquid dripping from the front end orifice or the like after use is sufficiently addressed.

A second aspect of the present invention resides in the foaming mechanism wherein a junction space and a foaming member are provided in the upstream end portion of the nozzle toward a downward in the stated order, the junction space and the foaming member constituting the foaming mechanism.

A third aspect of the present invention resides in a shape of the nozzle, wherein the nozzle bends from an axis direction to a lateral direction of the container body toward the front end orifice. The nozzle corresponds to a so-called L-shaped nozzle and may be referred to below as an L-shaped nozzle.

A fourth aspect of the present invention resides in a structure of the foaming mechanism, wherein a tubular cylinder is engagedly assembled and fixed to the upstream end portion of the nozzle, and the foaming member is assembled and fixed in the cylinder, and the junction space is provided on an upstream of the foaming member.

A fifth aspect of the present invention resides in a mode of supplying the liquid and air to the foaming mechanism provided in the aforementioned cylinder, wherein, in a lower end portion of the cylinder, a suction tube for supplying the liquid to the junction space is suspendedly provided, and an inlet hole for supplying air to the junction space is provided.

A sixth aspect of the present invention resides in a mode of providing the check valve with respect to the through-hole, wherein a ring-shaped valve body is contiguously provided around a circumferential wall of the cylinder as an outer flange, the valve body serving as a check valve for the through-hole.

With the above structure, by using the tubular cylinder that is assembled and fixed to the upstream end portion of the nozzle in an externally fitting manner, the check valve is reliably and easily arranged.

A seventh aspect of the present invention resides in a position in which the through-hole is provided, wherein the through-hole is provided in a lower end portion of a circumferential wall in a horizontal portion of the nozzle that extends in the lateral direction.

With the above through-hole, due to the suction back function, the shape of the container body is restored even more quickly, and the foamed liquid remaining near the front end orifice is reliably returned to the inside of the container body.

A eighth aspect of the present invention also resides in the position in which the through-hole is provided, wherein the through-hole is provided on a rear end wall of the nozzle.

With the above through-hole, due to the suction back function, the foamed liquid remaining at least in the horizontal portion of the nozzle is returned into the container body.

Furthermore, according to a ninth aspect of the present invention, by providing the through-hole in the flat surface area on the outer surface of the rear end wall of the nozzle, the check valve is allowed to utilize the flat surface area as a valve seat and to reliably exert a sealing function with respect to the through-hole.

A tenth aspect of the present invention resides in a mode of providing the check valve, wherein a cylindrical base tubular piece as a base portion of the check valve is assembled and fixed to a vertical portion from underneath in the externally fitting manner, the vertical portion having a tubular body shape and extending in the axis direction of the container body, and the check valve is provided to be capable of swinging rearward by using a rear end wall of the base tubular piece.

With the above structure, by, with use of a member including the base tubular piece that is assembled and fixed to the vertical portion of the nozzle in the externally fitting manner, providing the check valve using the rear end wall of the base tubular piece, the check valve, which is a small member, is easily and precisely positioned with respect to the through-hole. As a result, productivity associated with assembly process is improved, and the function of the check valve is rightly exerted.

An eleventh aspect of the present invention resides in a more detailed mode of providing the check valve, wherein the check valve has a disk shape, and the disk-shaped check valve stands via a swing plate piece extending upward from an upper end edge of the rear end wall in a circumferential wall of the base tubular piece.

By swinging displacement of the check valve about a base end portion of the swing plate piece as a pivot due to the suction back function, sealing by the check valve is smoothly released.

A twelfth aspect of the present invention also resides in a more detailed mode of providing the check valve, wherein a pair of left and right support plate pieces is provided to stand upward from an upper end edge of the rear end wall in a circumferential wall of the base tubular piece, a pair of left and right swing connection pieces is interposed between the pair of support plate pieces, and the check valve is provided to be capable of swinging rearward by elastic deformation of the pair of swing connection pieces.

A thirteenth aspect of the present invention also resides in a more detailed mode of providing the check valve, wherein a cutout portion is formed by cutting out a rectangular shape from an upper end edge of the rear end wall in a circumferential wall of the base tubular piece, and the check valve is provided in the cutout portion to be capable of swinging via a pair of left and right swing connection pieces by elastic deformation of the swing connection pieces.

A fourteenth aspect of the present invention resides in a mode of providing the foaming mechanism, wherein the foaming member is assembled and fixed to a lower portion of an inside of the base tubular piece, and the junction space is provided on an upstream of the foaming member to constitute the foaming mechanism.

Thus, the foaming mechanism, which includes the junction space and the foaming member, is provided by utilizing the base tubular piece serving as the base portion of the check valve.

A fifteenth aspect of the present invention resides in a mode of supplying the liquid and air to the foaming mechanism provided in the aforementioned check valve member, wherein, in a lower end portion of the base tubular piece, a suction tube for supplying the liquid to the junction space is suspendedly provided, and an inlet hole for supplying air to the junction space is provided.

A sixteenth aspect of the present invention resides in a position in which the through-hole is provided, wherein the through-hole is provided on the rear end wall in a horizontal portion of the nozzle that extends in the lateral direction of the nozzle.

Due to the suction back function, outer air flows linearly from the front end orifice toward the through-hole and enters the inside of the container through the through-hole.

As a result, in accordance with the flow of outer air, the foamed liquid remaining in the horizontal portion is returned into the container at early timing, and subsequently, the shape of the trunk of the container body may be restored even more quickly.

A seventeenth aspect of the present invention resides in a position in which the through-hole is provided, wherein the through-hole is provided near an upper end (a downstream end portion) of the foaming mechanism.

With the above structure, due to the suction back function, substantially all the foamed liquid remaining on a downstream side of the foaming mechanism in the nozzle is returned into the container body.

A eighteenth aspect of the present invention resides in a dispensing container, including:

a container body that includes a trunk that stands from a bottom portion and includes inside thereof a filling space for content; a cylinder that holds a suction tube for the content, that includes an air inlet hole, and that defines inside thereof a junction space of the content and air; a base cap that is fixed and held in a mouth of the container body and that is configured to suspendedly hold the cylinder in the mouth; and a nozzle that is integrally connected to the base cap and that forms inside thereof an expulsion passage communicating with the junction space, wherein when the trunk is squeezed, the content and air are mixed in the junction space to be foamed, and the foamed content is dispensed to an outside from a front end of the nozzle, and wherein the nozzle is provided with a through-hole that lets the expulsion passage communicate with the filling space so as to introduce outer air and the content remaining in the expulsion passage into the filling space, and the cylinder further includes a shielding wall that covers the inlet hole, with a bottom side thereof being left open.

According to a nineteenth aspect of the present invention, it is preferable that the shielding wall includes a tongue piece provided at least on one side provided with the through-hole.

According to a twentieth aspect of the present invention, it is preferable that the tongue piece is provided with a pair of barrier walls that prevents inflow of the content flowing around to back of side edges of the tongue piece and flowing toward the inlet hole.

A twenty-first aspect of the present invention resides in a dispensing container, including:

a container body that includes a flexible trunk including inside thereof a filling space for content; a cylinder that holds a suction tube for the content, that includes an air inlet hole, and that defines inside thereof a junction space of the content and air; a base cap that is fixed and held in a mouth of the container body and that is configured to suspendedly hold the cylinder in the mouth; and a nozzle that is integrally connected to the base cap and that forms inside thereof an expulsion passage communicating with the junction space, wherein when the trunk is squeezed, the content and air are mixed in the junction space to be foamed, and the foamed content is dispensed to an outside from a front end of the nozzle, and wherein the base cap includes: an annular passage that is provided between the base cap and an outer surface wall of the cylinder and that communicates with the filling space; and a through-hole that lets the expulsion passage communicate with the annual passage so as to introduce outer air and the content remaining in the expulsion passage into the annular passage, and the cylinder includes a flange that is provided with an outlet hole for the remaining content, that is provided to define the annular passage, and that forms a storage space of the remaining content near the through-hole.

According to a twenty-second aspect of the present invention, it is preferable that the outlet hole is smaller in opening area than the through-hole having a smallest possible opening area.

According to a twenty-third aspect of the present invention, it is preferable that an annular wall is provided around an edge of the flange along an inner surface wall of the base cap, the annular wall being in elastic contact with the inner surface wall.

A twenty-fourth aspect of the present invention resides in a dispensing container, including:

a container body that includes a flexible trunk including inside thereof a filling space for content; a base cap that includes a tubular body configured to be fixed and held to a mouth of the container body and to stand in the mouth; and a cylinder that holds a suction tube for the content, that includes an air inlet hole, and that is connected to a lower end portion of the tubular body so as to define inside thereof a junction space of the content and air; and a nozzle that communicates with an upper end portion of the tubular body and that lets an expulsion passage communicated with the junction space, the expulsion passage being formed inside the nozzle, wherein when the trunk is squeezed, the content and air in the junction space are mixed to be foamed, and the foamed content is dispensed to an outside from an outlet of the expulsion passage, and wherein the base cap further includes an outer tube surrounding the tubular body with space therebetween, and an annular passage communicating with the filling space is formed between the tubular body and the outer tube, the nozzle is provided with a through-hole that lets the expulsion passage communicate with the annular passage so as to introduce outer air and the content remaining in the expulsion passage into the annular passage, a partition wall is provided in a lower end portion of the outer tube, the partition wall defining the annular passage and forming a storage space of the introduced content, and the partition wall is provided with an opening communicating with the filling space.

According to a twenty-fifth aspect of the present invention, it is preferable that the opening is smaller in opening area than the through-hole having a smallest possible opening area.

A twenty-sixth aspect of the present invention resides in a dispensing container, including:

a container body that includes a flexible trunk including inside thereof a filling space for content; a cylinder that holds a suction tube for the content, that includes an air inlet hole, and that defines inside thereof a junction space of the content and air; a base cap that includes an inner tube and an outer tube and that is fixed and held in a mouth of the container body, the inner tube holding the cylinder and including an upper orifice communicating with the junction space, and the outer tube surrounding the inner tube and forming an annular space between the outer tube and the inner tube, the annular space communicating with the filling space; and a head that is integrally connected with a nozzle and that is slidably provided along an axis line of the outer tube, the nozzle including an expulsion passage that introduces foamed content from a rear end orifice thereof and that dispenses the introduced foamed content to an outside from a front end orifice thereof, wherein the head includes a relay space serving as a feeding passage and as a return passage, the feeding passage communicating with the upper orifice and feeding to the expulsion passage the content foamed in response to squeezing of the trunk, and the return passage drawing back the content remaining in the expulsion passage together with outer air into the annular space in response to restoration of the trunk, and the relay space is provided with a plug body that closes the upper orifice in a descending position of the head and that opens the upper orifice in an ascending position of the head.

According to a twenty-seventh aspect of the present invention, it is preferable that the head includes an annular wall extending to the annular space, and that the inner tube includes an elastic wall that closes the annular space by coming into sealing contact with the annular wall in the descending position of the head and that opens the annular space in the ascending position of the head.

Advantageous Effects of Invention

In a dispensing container according to the present invention, wherein the base cap is provided at a top wall thereof with a nozzle that forms a tubular passage communicating with a front end orifice, the nozzle is provided in an upstream end portion thereof with a foaming mechanism for the liquid, a through-hole is provided in a predetermined position on a circumferential wall of the nozzle that is downstream of the foaming mechanism, the through-hole is provided with a check valve, and the front end orifice communicates with an inside of the container body through the through-hole, the following advantageous effects are achieved.

That is to say, in the dispensing container with the features according to the present invention, the through-hole provides a separate route from the foaming mechanism provided in the upstream end portion of the nozzle for letting the front end orifice communicated with the inside of the container body. Accordingly, during squeeze back, even when the foamed liquid has high flow resistance near the foaming mechanism employing a foaming member or the like, outer air may directly enter the container body through the through-hole via the front end orifice and the nozzle. As a result, the shape of the container body is restored to the original shape quickly, and a dispensing operation by squeezing is smoothly performed.

Furthermore, by providing the through-hole in the predetermined position in the nozzle that is downstream of the foaming mechanism, the foamed liquid remaining in the region in the nozzle that extends from the front end orifice to the through-hole is returned into the container body through the through-hole in accordance with the flow of outer air from the front end orifice. As a result, the problem of liquid dripping from the front end orifice or the like after use is sufficiently addressed.

Moreover, in a dispensing container according to the present invention, wherein the nozzle includes a flat surface area in a predetermined portion on an outer surface of a rear end wall of the nozzle, the through-hole is provided in a predetermined position in the flat surface area that is downstream of the foaming mechanism, the check valve for the through-hole is provided in the flat surface area, and the front end orifice communicates with the inside of the container body through the through-hole, the following advantageous effects are also achieved.

That is to say, during squeeze back, the shape of the container is also restored to the original shape quickly by letting outer air directly enter the container body through the through-hole via the nozzle, and a dispensing operation by squeezing is smoothly performed.

Moreover, by providing the through-hole on the rear end wall of the nozzle, the foamed liquid remaining in the region in the L-shaped nozzle that extends laterally toward the front end orifice is returned into the container body through the through-hole provided on the rear end wall in accordance with the flow of outer air from the front end orifice. As a result, the problem of liquid dripping from the front end orifice or the like after use is sufficiently addressed.

Moreover, the through-hole is provided in the flat surface area on an outer circumferential surface of the rear end wall, and the check valve is allowed to utilize the flat surface area as the valve seat and to reliably exert the sealing function with respect to the through-hole.

Moreover, in a dispensing container according to the present invention, wherein the nozzle including an expulsion passage for a content is provided with a through-hole that lets the expulsion passage communicate with the filling space so as to introduce outer air and the content remaining in the expulsion passage into the filling space, the suction back function is effectively exerted, and it is ensured that liquid dripping from the front end orifice of the nozzle is prevented.

The cylinder including the inlet hole for air to be mixed with the content and foamed further includes a shielding wall that covers the inlet hole, with a bottom side thereof being left open, and accordingly, the remaining content including bubbles returned to the filling space through the through-hole is prevented from flowing directly into the inlet hole. Consequently, probability that the bubbles of the content clog up the inlet hole is sufficiently reduced. As a result, a mixture ratio of the content and air is maintained to be a desired ratio, and fine-textured foam is stably expelled.

When the shielding wall includes a tongue piece provided at least on one side provided with the through-hole, the inlet hole positioned on the side provided with the through-hole, into which the remaining content might directly flow, is effectively covered by the shielding wall having a smallest possible size. As a result, increase in costs of components is minimized while the advantageous effect of stably expelling the fine-textured foam is sufficiently provided.

When the tongue piece is provided with a pair of barrier walls that prevents inflow of the content flowing around to back of side edges of the tongue piece and flowing toward the inlet hole, the inlet hole is less likely to be clogged up by the bubbles of the content, and therefore, a desired foam is stably and continuously expelled.

Moreover, in a dispensing container according to the present invention, wherein the base cap includes: an annular passage provided between the base cap and an outer surface wall of the cylinder; and a through-hole configured to let the expulsion passage for the content communicate with the annular passage and to introduce outer air and the content remaining in the expulsion passage into the annular passage, the suction back function is effectively exerted, and liquid dripping from the front end orifice of the nozzle is reliably prevented.

The cylinder also includes a flange that defines the annular passage with an outlet hole for the remaining content being left and that forms a storage space of the remaining content in a portion of the defined annular passage near the through-hole. As a result, the remaining content is temporarily retained in the storage space, and the bubbles of the content are likely to disappear. Consequently, the container body is prevented from being immediately filled with the bubbles of the remaining content, and the problem of the bubbles of the remaining content clogging up the air inlet hole is less likely to occur. Accordingly, the mixture ratio of the content and air is maintained to be the desired ratio, and the fine-textured foam is stably expelled. Moreover, since the number of components remains the same despite the above function, costs of the components are minimized.

When the outlet hole is smaller in opening area than the through-hole having a smallest possible opening area, through which the expulsion passage and the annular passage communicate, size of the bubbles of the remaining content passing through the outlet hole is reliably reduced. As a result, the fine-textured foam is even more stably expelled.

When an annular wall is provided around an edge of the flange along an inner surface wall of the base cap, the annular wall being in elastic contact with the inner surface wall, it is ensured that the remaining content is prevented from leaking from space between the flange and the inner surface wall of the base cap. As a result, the remaining content is stably introduced into the filling space through the outlet hole alone, and the desired foam is continuously expelled.

In a dispensing container according to the present invention, including: a base cap that includes a tubular body configured to be fixed and held to a mouth of a container body and an outer tube surrounding the tubular body, an annular passage being formed between the tubular body and the outer tube; a cylinder that is connected to a lower end portion of the tubular body so as to define inside thereof a junction space in which the content and air are mixed to be foamed; and a nozzle that is provided with a through-hole that lets the expulsion passage communicate with the annular passage so as to introduce outer air and the content remaining in the expulsion passage into the annular passage, the suction back function is effectively exerted, and liquid dripping from the ejection orifice is reliably prevented.

Furthermore, a partition wall is provided in a lower end portion of the outer tube, the partition wall defining the annular passage and forming a storage space of the introduced content, and the partition wall is provided with an opening communicating with the filling space provided in the container body. Accordingly, by temporarily retaining the remaining content in the storage space, the bubbles tend to disappear, and when the bubbles pass through the opening, the size of the bubbles become smaller in opening area than the opening. As a result, the container body is prevented from being immediately filled with the bubbles of the remaining content, and the air inlet hole is less likely to be clogged up by the bubbles of the remaining content. Accordingly, the mixture ratio of the content and air is maintained to be the desired ratio, and the fine-textured foam is stably expelled.

When the opening provided in the partition wall is smaller in opening area than the through-hole having a smallest possible opening area, the through hole letting the expulsion passage communicated with the annular passage, the size of the bubbles of the remaining content stored in the annular passage is reliably reduced, and accordingly, the fine-textured foam is even more stably expelled.

In a dispensing container according to the present invention, including: a base cap that is fixed and held in a mouth of a container body and that includes an inner tube and an outer tube, the inner tube holding a cylinder in which the content is foamed and including an upper orifice communicating with the cylinder, and the outer tube forming an annular space between the outer tube and the inner tube, the annular space communicating with a filling space; and a head that is integrally connected with a nozzle and that is slidably provided along an axis line of the outer tube, wherein the head includes a relay space serving as a feeding passage and as a return passage, the feeding passage communicating with the upper orifice and feeding, to the expulsion passage of the nozzle, the content foamed in response to squeezing of the trunk, and the return passage drawing back the content remaining in the expulsion passage into the annular space in response to restoration of the trunk, and the relay space is provided with a plug body that closes the upper orifice in a descending position of the head and that opens the upper orifice in an ascending position of the head, by maintaining the head in the descending position, unrequired leakage of the content is reliably prevented. On the other hand, during use, the foamed content is dispensed simply by displacing the head downward, and liquid dripping after a dispensing operation is also prevented.

When the head includes an annular wall extending to the annular space, and the inner tube includes an elastic wall that closes the annular space by coming into sealing contact with the annular wall in the descending position of the head and that opens the annular space in the ascending position of the head, by maintaining the head in the descending position, the annular space is closed, and the filling space is sealed. As a result, even when unintentional pressure is applied to the container body, the trunk is not easily deformed (since outer air may not come in and out of the filling space, the shape of the trunk is maintained), and unrequired dispensing of the content is more effectively prevented.

BRIEF DESCRIPTION OF DRAWINGS

The present invention will be further described below with reference to the accompanying drawings, wherein:

FIG. 6 illustrates a dispensing container according to Embodiment 2 of the present invention.

FIG. 7 illustrates a dispensing container according to Embodiment 3 of the present invention.

FIG. 22 illustrates a dispensing container according to Embodiment 7 of the present invention.

FIG. 25 illustrates a dispensing container according to Embodiment 8 of the present invention.

DESCRIPTION OF EMBODIMENTS

Embodiments of the present invention will be described with reference to examples and the drawings.

Figure 1:
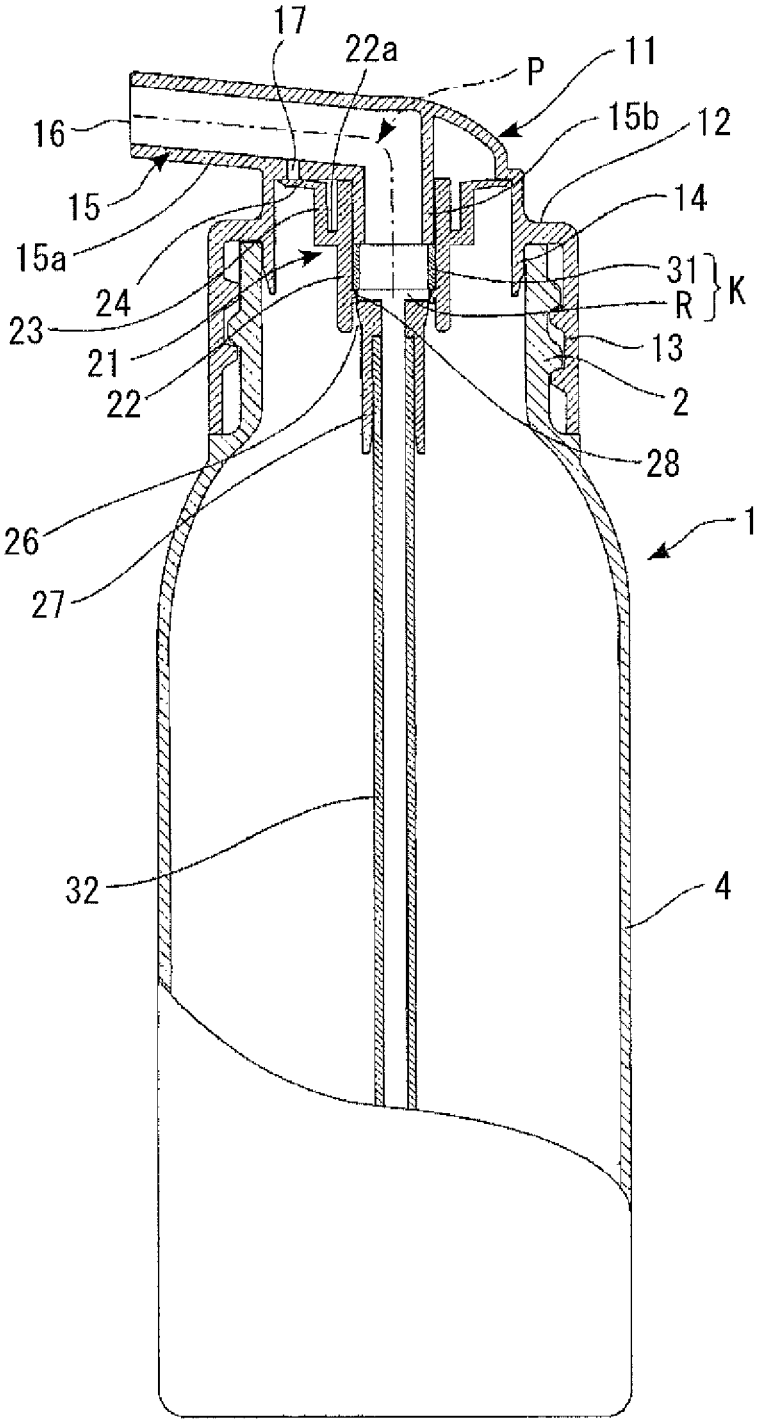
FIG. 1 is a longitudinally-sectioned partial side view of a dispensing container according to Embodiment 1 of the present invention.
Figure 2:
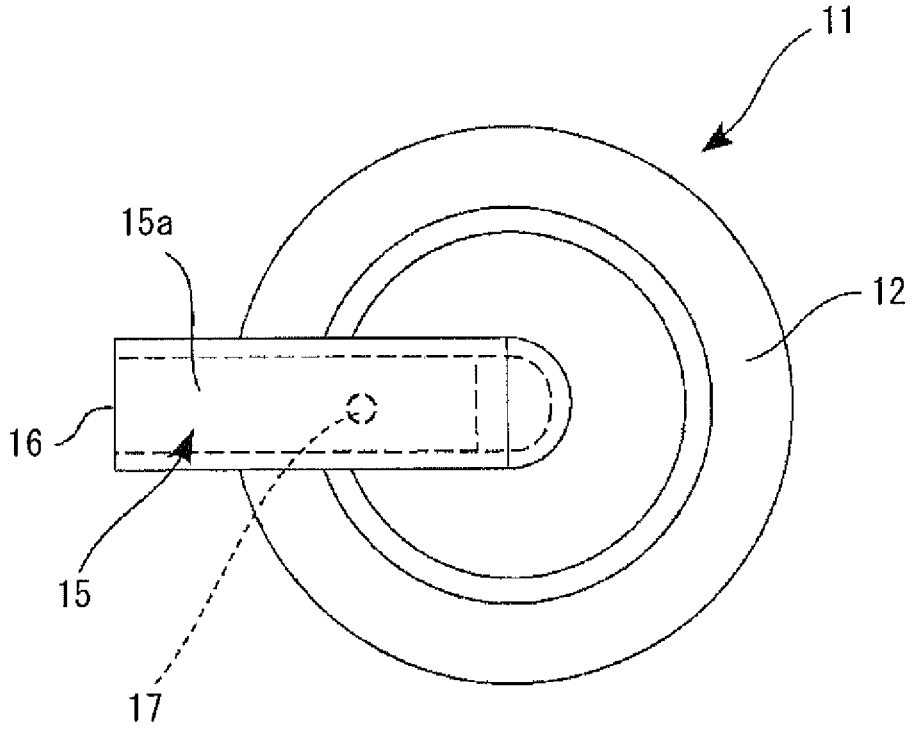
FIG. 2 is a plan view of a base cap of the container illustrated in FIG. 1.

FIGS. 1-3 illustrate a dispensing container according to Embodiment 1 of the present invention. FIG. 1 is a longitudinally-sectioned partial side view, FIG. 2 is a plan view of a base cap 11 that is a member of the container, and FIG. 3 is a perspective view of a cylinder 21 that is a member of the container.

The dispensing container includes five members in total, i.e., a container body 1 configured by blow molding, a base cap 11 assembled and fixed to a mouth 2 of the container body 1, a cylinder 21 assembled and fixed to a lower end portion of the base cap 11, a foaming member 31 including a cylindrical body provided at un upper end thereof with a mesh, and a suction tube 32 called dip tube.

In the present embodiment, the container body 1 is a bottle body made of a High Density Polyethylene (HDPE) resin and configured by blow molding. The container body 1 includes a cylindrical trunk 4 and the mouth 2 provided to stand from an upper end of the trunk via a shoulder. The trunk 4 is flexible in order to allow a squeeze operation thereon by hand and is capable of being elastically restored when pressure is released.

The base cap 11 is an injection-molded member made of a Low Density Polyethylene (LDPE) resin, and the entire base cap 11 has a cylindrical shape with a top surface. The base cap 11 includes an outer wall 13 that is configured to be screw fastened onto the mouth 2 of the container body 1, and a sealing wall 14 that is provided inside the outer wall 13 to be engaged in the mouth 2.

The base cap 11 also includes a top wall 12 in which an L-shaped nozzle 15 is provided. By the nozzle 15, a tubular passage P is formed. The tubular passage P extends to reach a front end orifice 16 for a foamed liquid FL that is later described.

The L-shaped nozzle 15 herein includes a horizontal portion 15*a* extending horizontally and a vertical portion 15*b* extending vertically, i.e. in an axis direction of the container body 1.

In the present embodiment, a through-hole 17 is formed in a position in a lower end portion of a circumferential wall in the horizontal portion 15*a* of the nozzle 15 that communicates with an inside of the container body 1.

The cylinder 21 is an injection-molded member made of the LDPE resin and the entire cylinder 21 has a tubular shape. The cylinder 21 includes a fitting tubular piece 22 configured to be externally fitted to the vertical portion 15*b* that corresponds to an upstream end portion of the nozzle 15. An outer tubular piece 23 is further provided on an outer side of the fitting tubular piece 22 via a bottom wall 22*a* in an outer flange shape, and a ring-shaped thin valve body 24 is contiguously provided around an upper end of the outer tubular piece 23 as an outer flange. Around an inner circumferential wall of the fitting tubular piece 22, a locking ridge 28 is also provided for positioning of the foaming member 31 with respect to a vertical direction.

Figure 3A:
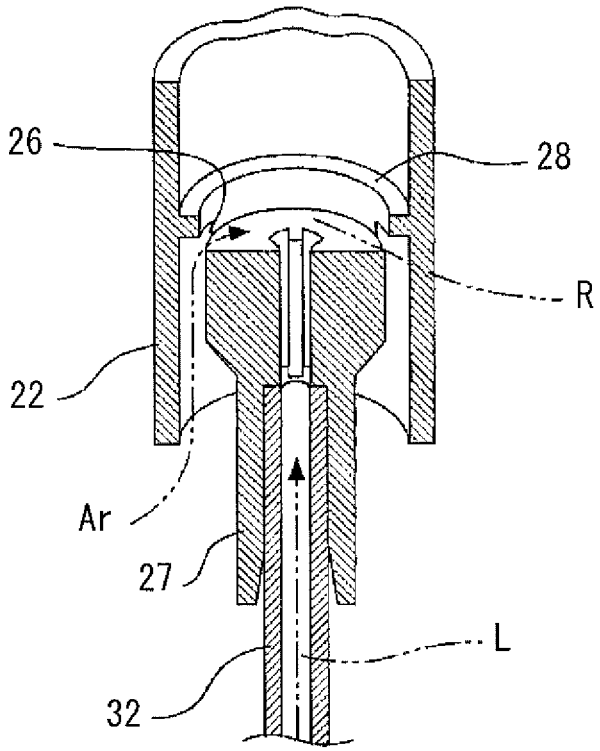
FIG. 3A is a longitudinally-sectioned perspective view of a part of the container illustrated in FIG. 1 in a state where a suction tube is engaged in a cylinder of the container.
Figure 3B:
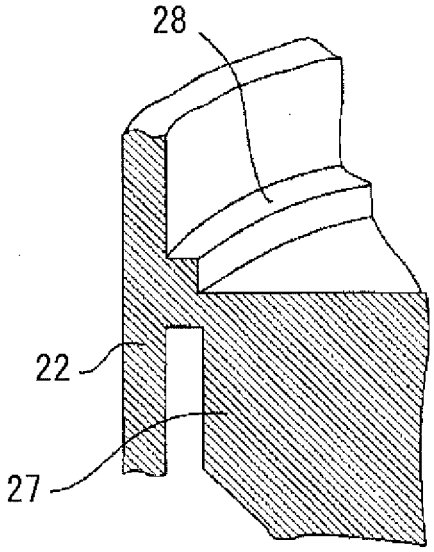
FIG. 3B is a longitudinally-sectioned perspective view of a part of FIG. 3A in which an inlet hole is not provided.

FIG. 3A is a longitudinally-sectioned perspective view of a portion of the container illustrated in FIG. 1, with the suction tube 32 being engaged into the cylinder 21. FIG. 3B is a longitudinally-sectioned perspective view of a part of FIG. 3A in which the inlet hole 26 is not provided. As illustrated in FIGS. 3A and 3B, a suspended tubular piece 27 is suspendedly provided inside the locking ridge 28, and a pair of front and rear inlet holes 26 is formed by cutting off a circumferential wall of the locking ridge 28 at two points in a front and rear direction.

The five members described above are assembled and fixed in the following procedure, and an assembled state illustrated in FIG. 1 is achieved.

1) The foaming member 31 is engaged in the fitting tubular piece 22 of the cylinder 21 and mounted on the locking ridge 28.
2) An upper end of the suction tube 32 is engaged into the suspended tubular piece 27 of the cylinder 21.
3) The vertical portion 15*b* of the nozzle 15 of the base cap 11 is engaged in an upper end portion of the fitting tubular piece 22 of the cylinder 21 to thereby assemble the base cap 11 to the cylinder 21.
4) The outer wall 13 of the base cap 11 is screwed to the mouth 2 of the container body 1, to thereby assemble and fix the base cap 11 to the container body 1.

In the assembled state as illustrated in FIG. 1, the valve body 24 of the cylinder 21 closes the through-hole 17 of the base cap 11 so that the valve body 24 functions as a check valve. The foaming member 31 is sandwiched between the lower end of the vertical portion 15*b* of the nozzle 15 and the locking ridge 28 to be firmly fixed, and between a lower end of the foaming member 31 and an upper end of the suspended tubular piece 27 there is provided a junction space R in which the liquid and air are joined and mixed as described later. The junction space R and the foaming member 31 constitute a foaming mechanism K for turning a normal liquid into a foamed liquid.

Figure 4:
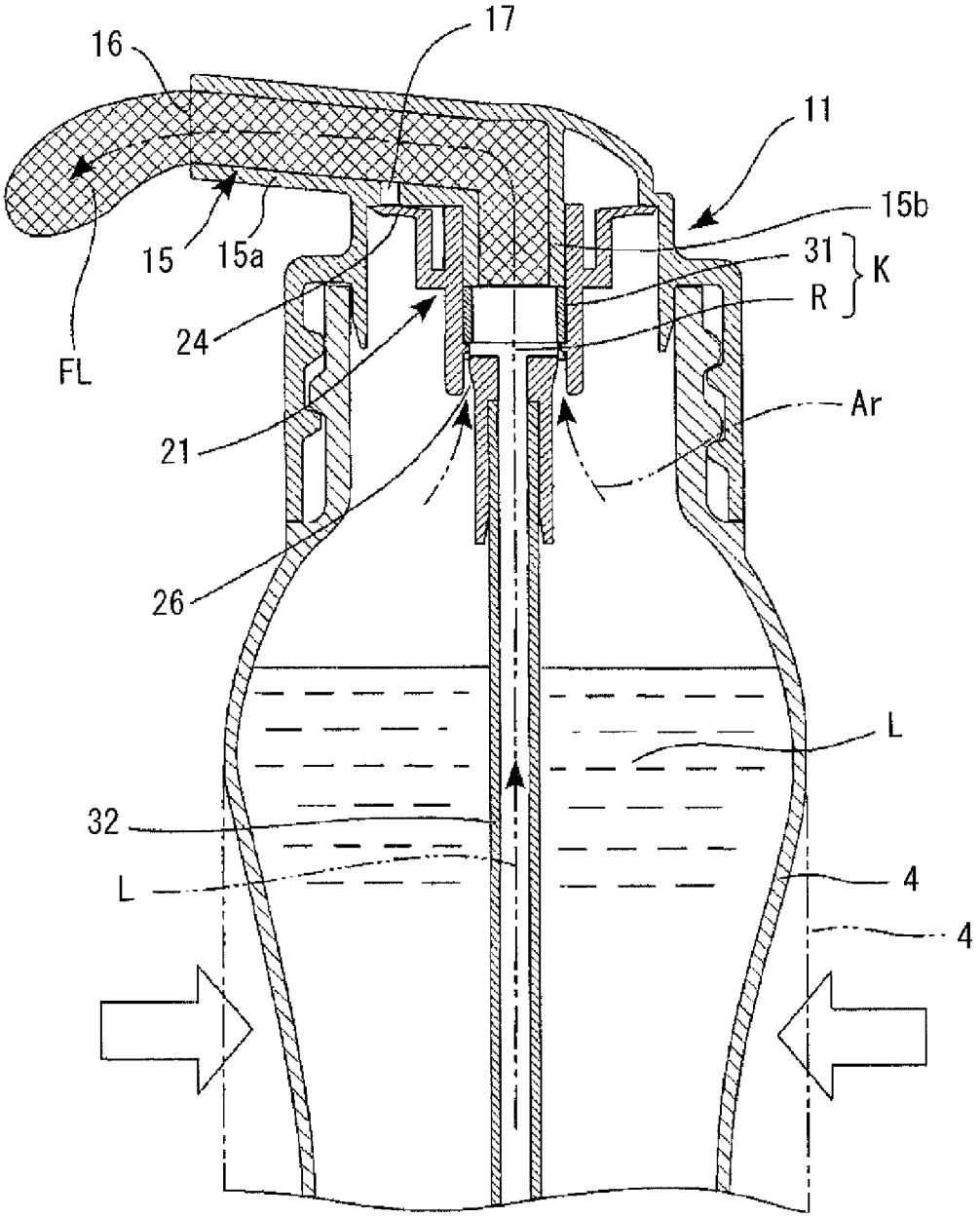
FIG. 4 is a longitudinally-sectioned side view illustrating a state where a trunk of the container illustrated in FIG. 1 is applied with pressure.
Figure 5:
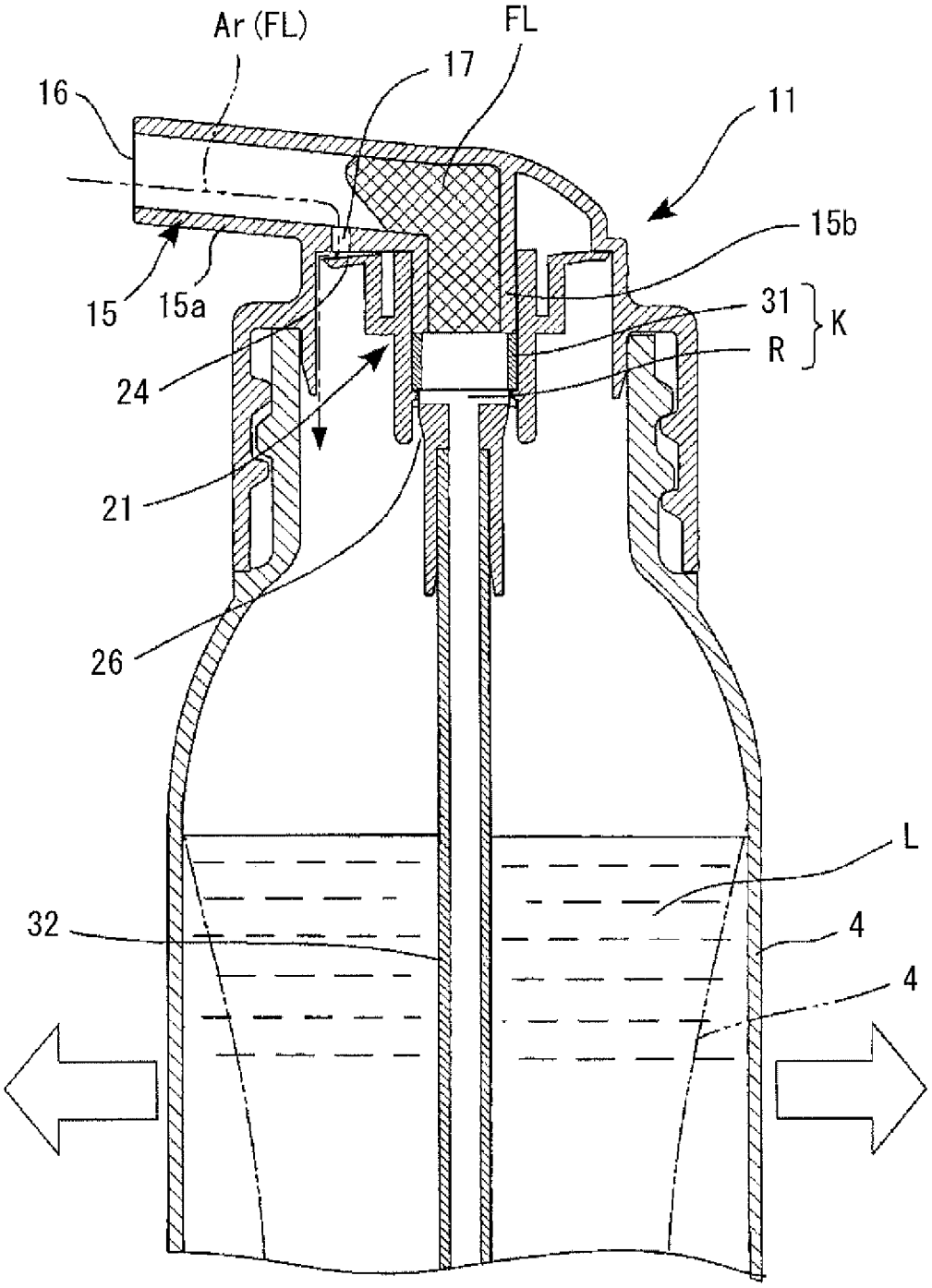
FIG. 5 is a longitudinally-sectioned side view illustrating a state where the pressure applied in the state illustrated in FIG. 4 is released.

Next, with reference to FIGS. 4 and 5 illustrating a mode of use of the dispensing container illustrated in FIG. 1, FIG. 4 is a longitudinally-sectioned side view illustrating a state where a trunk 4 of the container illustrated in FIG. 1 is applied with pressure, and FIG. 5 is a longitudinally-sectioned side view illustrating a state where the pressure applied in the state illustrated in FIG. 4 is released.

In FIG. 4, upon a squeeze operation by hand applying pressure to the trunk 4 in a direction indicated by arrow outlines with blanks inside, the pressure inside the container is raised, and a liquid L stored in the container body 1 moves upward through the suction tube 32 and flows into the junction space R. At the same time, gas (air) Ar present in an upper portion of the container flows into the junction space R from a peripheral upper end portion of the suspended tubular piece 27 through the inlet hole 26 formed in an inner flange circumferential piece 25 of the cylinder 21, and the liquid L and gas Ar are mixed in the junction space R.

The mixture of the liquid L and gas Ar passes through the foaming member 31, and accordingly, by the effect of the mesh disposed at the upper end of the foaming member 31, fine air bubbles are evenly generated in the liquid L, and a foamed liquid FL is formed. The foamed liquid FL flows along the tubular passage P (of FIG. 1) formed by the nozzle 15 as indicated by cross-hatching (in FIG. 4) and is dispensed from the front end orifice 16.

The dispensing operation may be terminated by releasing the pressure applied by hand. By doing so, the circumferential wall of the trunk 4 is restored to the original shape by elastic restorative force in a direction indicated by arrow outlines with blanks inside in FIG. 5.

As a result of the restoration, the inside of the container is placed under reduced pressure, and due to the resulting suction back function, the sealing function of the valve body 24 with respect to the through-hole 17 is released, and outer air starts to flow into the inside of the container from the front end orifice 16 through the through-hole 17. At the same time, in accordance with the flow of outer air, the foamed liquid FL remaining in a region in the nozzle 15 that extends from the front end orifice 16 to the through-hole 17 is returned to the inside of the container through the through-hole 17.

The aforementioned suction back function due to the through-hole 17 causes the remaining foamed liquid FL to flow backward to an area indicated by cross-hatching in FIG. 5 at early timing. Accordingly, subsequent inflow of outer air into the inside of the container through the through-hole 17 is considerably smoothened, and the circumferential wall of the trunk 4 is restored at an early stage. Consequently, the subsequent squeeze operation may be performed immediately, and favorable dispensing operability is achieved.

Furthermore, since the foamed liquid FL flows backward at least from the through-hole 17 toward the upstream side as described above, the problem of liquid dripping or the like after use is sufficiently addressed.

Note that a dimension and a position of the through-hole 17 may be appropriately determined in view of liquid property (e.g. viscosity of the liquid L, viscosity of the foamed liquid FL to be formed, and size of air bubbles), the problem such as solidification of the liquid L in the nozzle 15 after use, ease of providing the check valve, and the like.

Figure 6A:
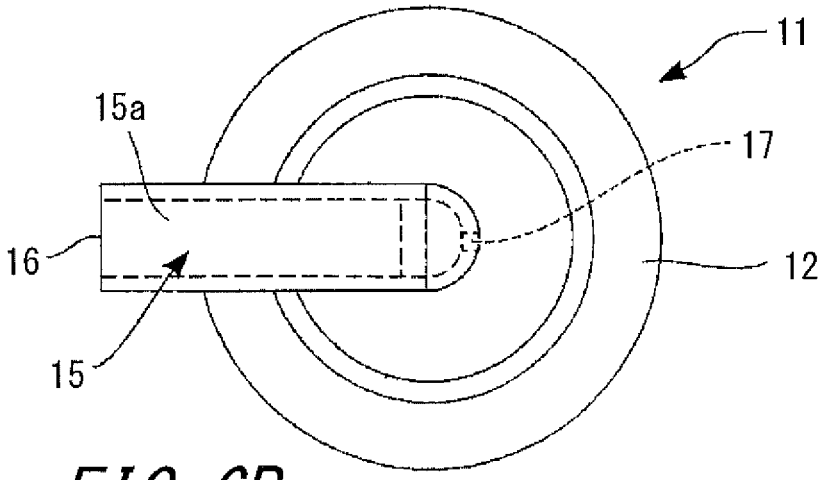
FIG. 6A is a plan view of a base cap.
Figure 6B:
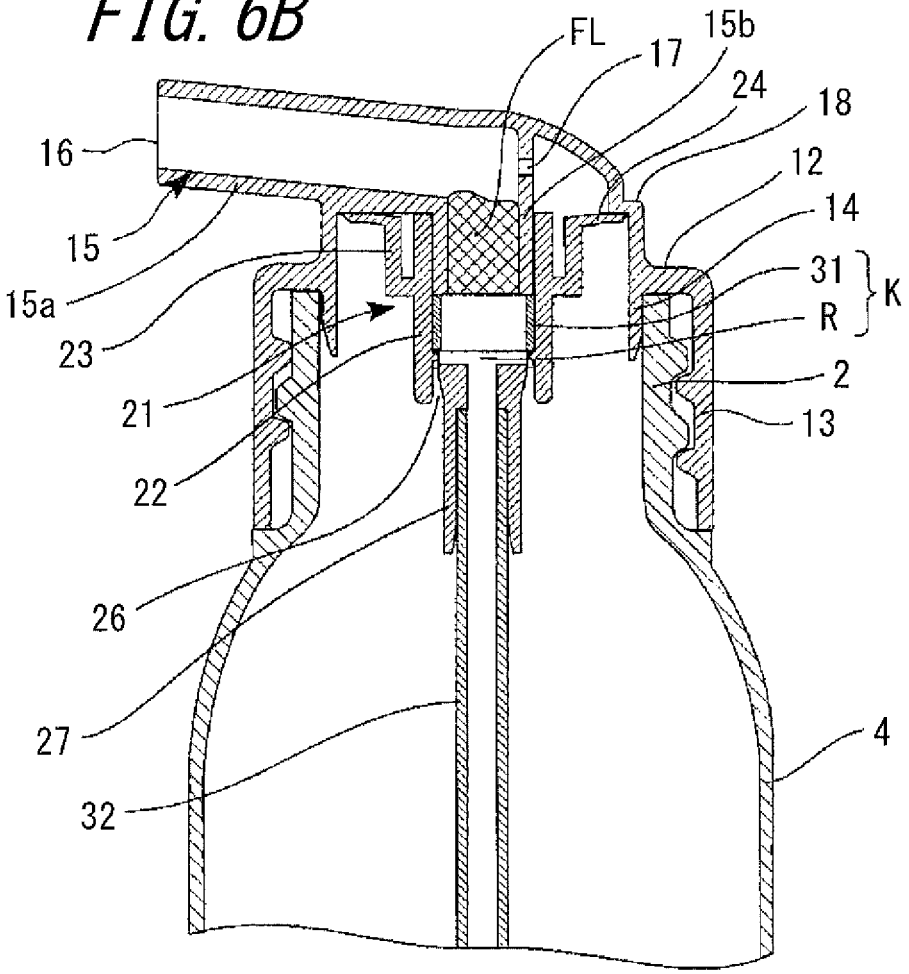
FIG. 6B is a longitudinally-sectioned side view of a container.
Figure 7A:
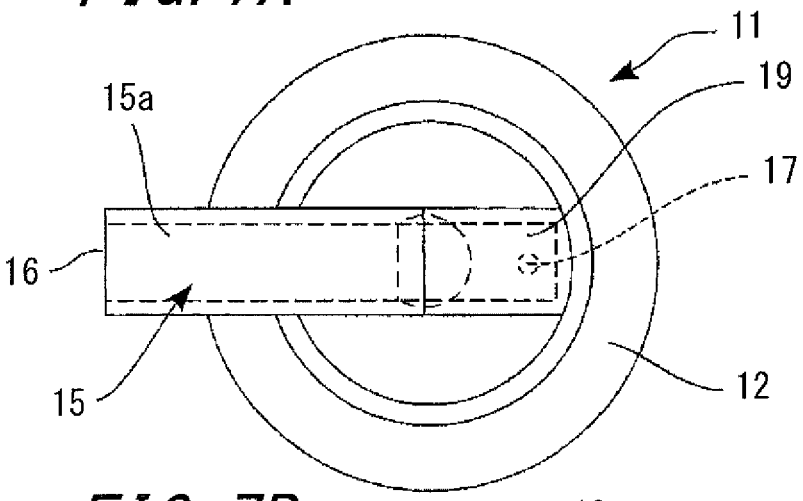
FIG. 7A is a plan view of a base cap.
Figure 7B:
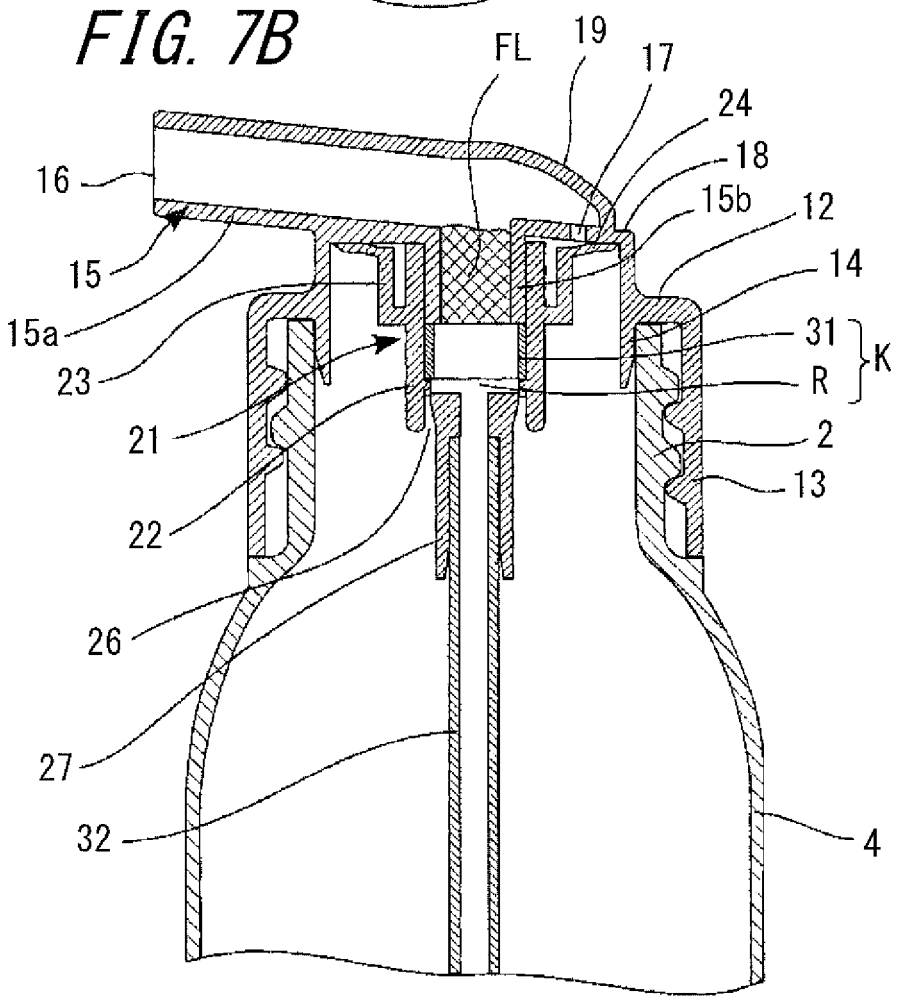
FIG. 7B is a longitudinally-sectioned side view of a container.

FIGS. 6A and 6B illustrate a dispensing container according to Embodiment 2 of the present invention, and FIGS. 7A and 7B illustrate a dispensing container according to Embodiment 3 of the present invention, thus illustrating, in particular, other variations of positions in which the through-hole 17 is provided compared with the container illustrated in FIG. 1.

Although similar to the container illustrated in FIG. 1 in the other respects in structure, the container illustrated in FIG. 6 differs from the container illustrated in FIG. 1 in that the through-hole 17 is formed in an upper end portion of the rear end wall of the L-shaped nozzle 15, and in that the ring-shaped valve body 24 of the cylinder 21 serves as the check valve by taking advantage of a stepped portion 18 circumferentially formed on the top wall 12 of the base cap 11.

By providing the through-hole 17 in the rear end wall of the L-shaped nozzle 15, a larger portion of the foamed liquid FL remaining in the nozzle 15 is returned to the inside of the container. Eventually, as indicated by cross-hatching in FIG. 6B, the foamed liquid FL remains above the foaming member 31 to only some degree.

The container illustrated in FIG. 7 is another variation of the container illustrated in FIG. 6 in which the through-hole 17 is formed in the rear end wall of the L-shaped nozzle 15. The container illustrated in FIG. 7 differs from the container illustrated in FIG. 6 in that an upper end portion of the rear end wall of the L-shaped nozzle 15 is extended to protrude rearward, and the through-hole 17 is formed in a lower end portion of a circumferential wall of the extended portion 19, and in that the ring-shaped valve body 24 of the cylinder 21 functions as the check valve by taking advantage of the stepped portion 18 circumferentially formed on the top wall 12 of the base cap 11.

By providing the through-hole 17 as described above, similarly to the case of the container illustrated in FIG. 6, a larger portion of the foamed liquid FL remaining in the nozzle 15 is returned to the inside of the container. Eventually, as indicated by cross-hatching in FIG. 7B, the foamed liquid FL remains above the foaming member 31 to only some degree.

Furthermore, compared to the container illustrated in FIG. 6, the valve body 24 is provided in proximity to the through-hole 17 in the container illustrated in FIG. 7, and the suction back function is exerted more effectively, depending on the property (e.g. viscosity) of the foamed liquid FL.

Although the structures and advantageous effects of the present invention have been described in accordance with the embodiments, the present invention is not limited to the above embodiments.

For example, although in the embodiments the container body is the blow-molded member made of a HDPE resin, a tube container may also be used, and other synthetic resins may be appropriately chosen in consideration of squeeze property, gas barrier property, chemical resistance, moldability, or the like. Furthermore, in order to have the container body exhibit excellent gas barrier property, it is possible to adopt a laminated structure including a resin layer made of, for example, an ethylene-vinyl alcohol resin as an inner layer, or to use an aluminum laminated tube body.

Moreover, as for the other members, namely, the base cap and the foaming body, synthetic resins used may be appropriately chosen in consideration of moldability, sealing property, chemical resistance, or the like.

Moreover, the positions of the check valve are not limited to those described in the above embodiments, and the positions may be appropriately determined in consideration of liquid property (e.g. the viscosity of the foamed liquid FL and the size of air bubbles), the problem such as solidification of the liquid L in the nozzle 15 after use, ease of providing the check valve, productivity associated with moldability and assembly, or the like.

The foaming mechanism may also be configured in various manners.

Next, Embodiments 4-6 of the present invention will be described in detail with reference to the drawings.

Figure 8:
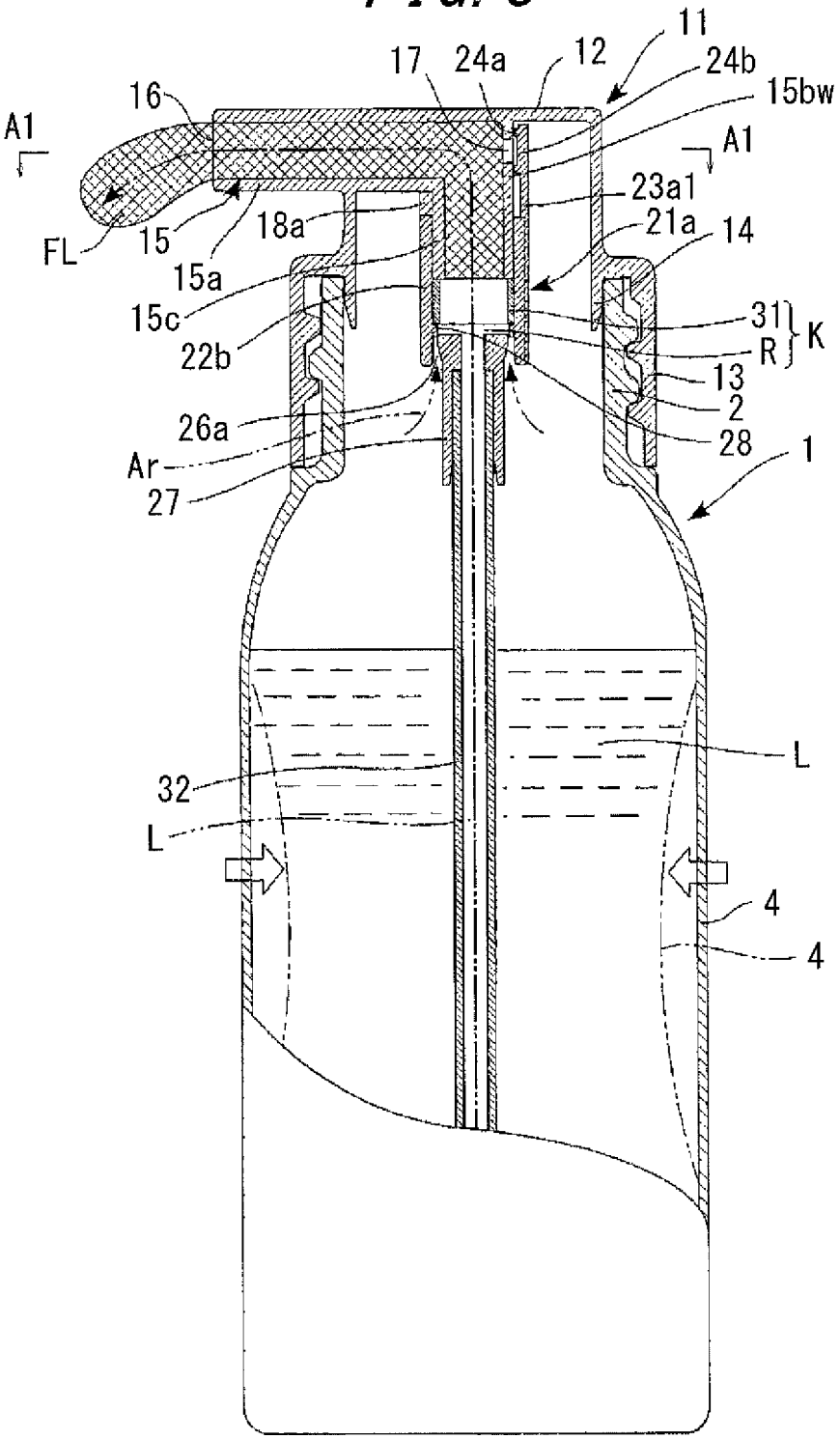
FIG. 8 is a longitudinally-sectioned partial side view of a dispensing container according to Embodiment 4 of the present invention.
Figure 9:
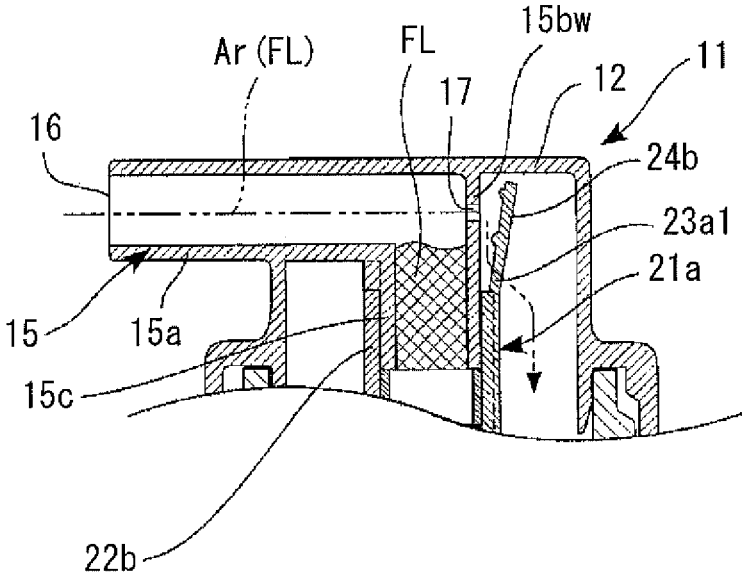
FIG. 9 is a longitudinally-sectioned side view illustrating a swing position of a check valve when pressure applied to a trunk of a container illustrated in FIG. 8 is released.
Figure 10:
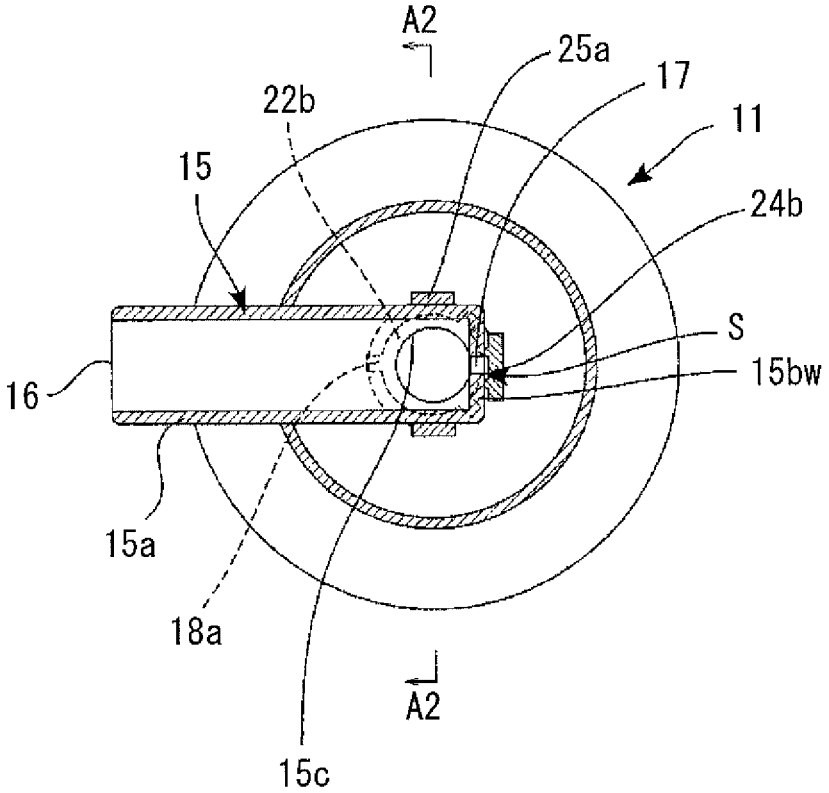
FIG. 10 is a sectional plan view taken along a line A1-A1 of FIG. 8, illustrating a state where a base cap of the container illustrated in FIG. 8 is engaged with a check valve member.
Figure 11:
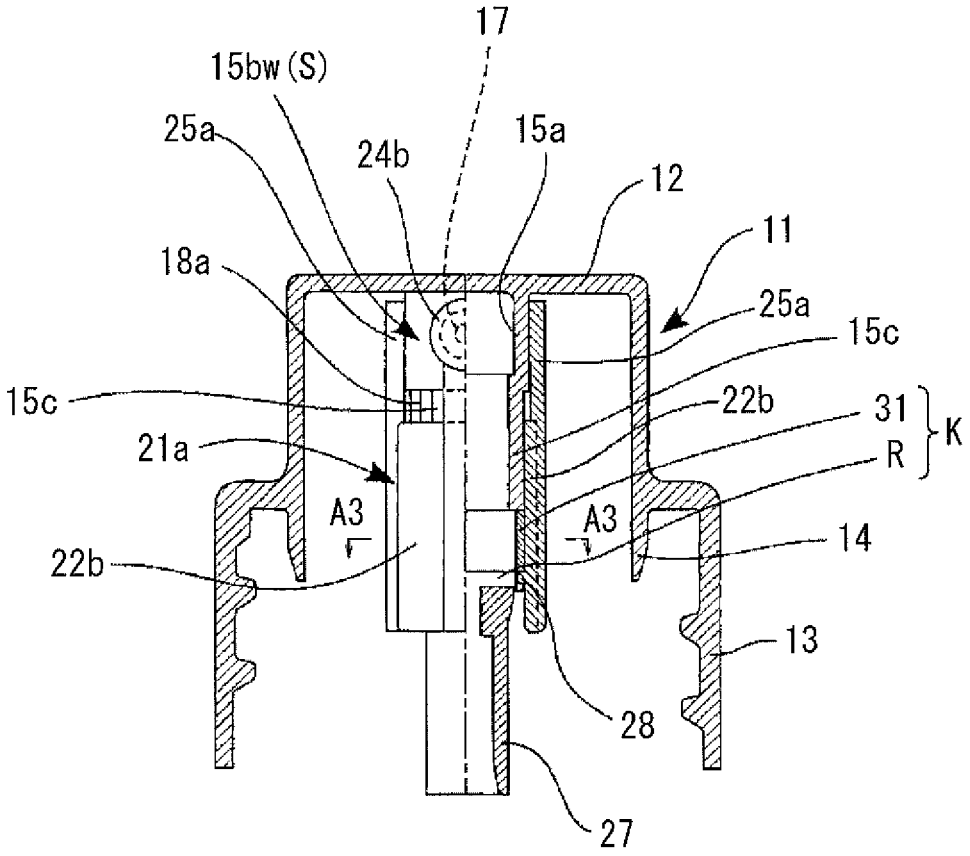
FIG. 11 is a longitudinal-sectioned partial rear view taken along a line A2-A2 of FIG. 10, illustrating a state where the base cap of the container illustrated in FIG. 8 is engaged with the check valve member.
Figure 12:
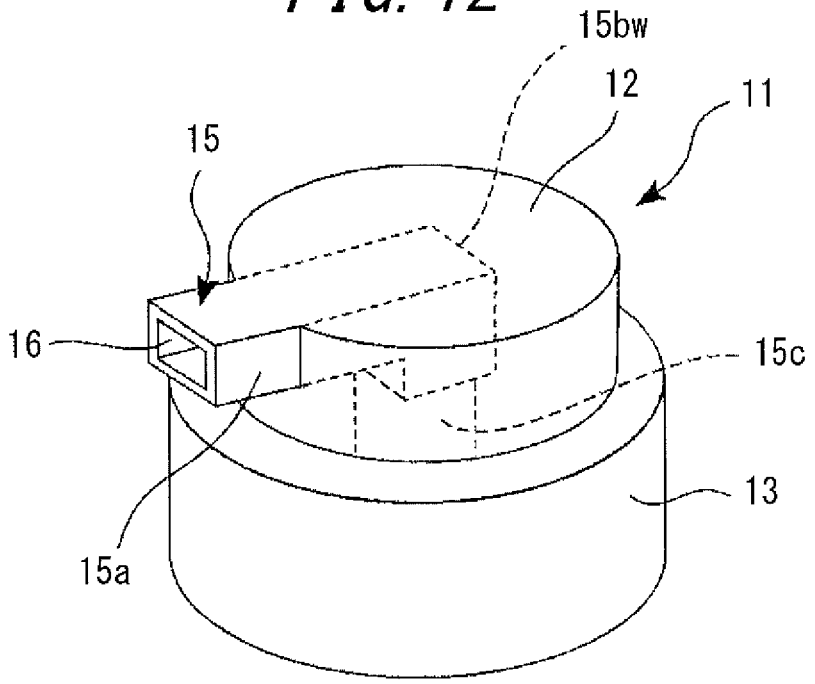
FIG. 12 is a perspective view of the base cap of the container illustrated in FIG. 8 as seen from obliquely thereabove.
Figure 13:
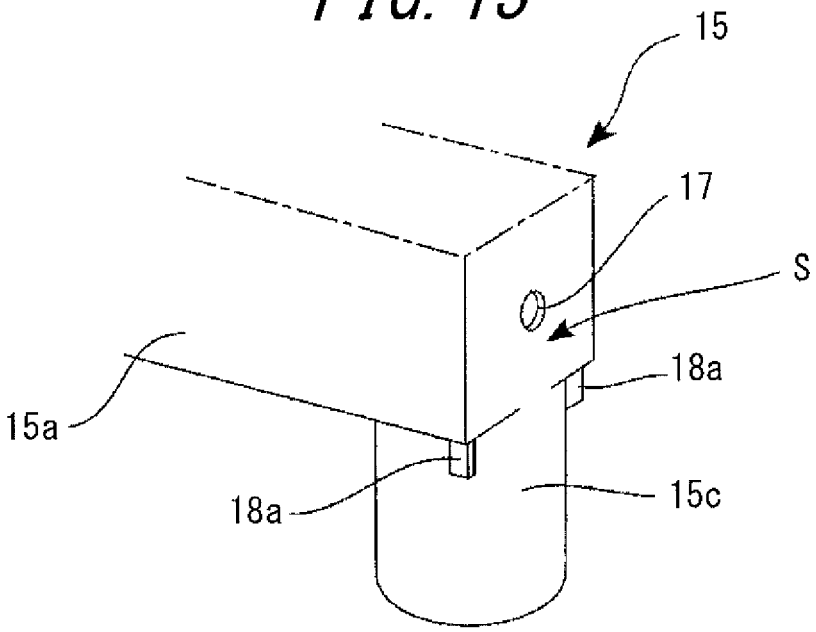
FIG. 13 is a partial perspective view of a tubular body of the base cap of the container illustrated in FIG. 8 as seen from obliquely rearward thereof.
Figure 14:
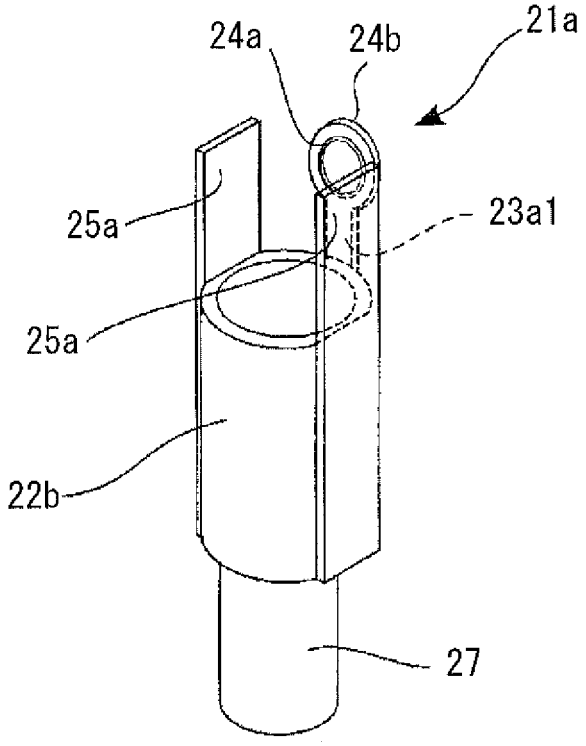
FIG. 14 is a perspective view of the check valve member illustrated in FIG. 8 as seen from obliquely forward thereof.

FIGS. 8-14 illustrate a dispensing container according to Embodiment 4 of the present invention. FIG. 8 is a longitudinally-sectioned partial side view, FIG. 9 is a longitudinally-sectioned side view illustrating a swing position of a check valve 24*b* when pressure applied to the trunk 4 is released, FIG. 10 is a sectional plan view illustrating a state where the base cap 11 and a check valve member 21*a*, which are members of the container, are assembled together, FIG. 11 is a longitudinal-sectioned partial rear view illustrating a state where the base cap 11 and the check valve member 21*a*, which are the members of the containers, are assembled together, FIG. 12 is a perspective view of the base cap 11, FIG. 13 is a partial perspective view of the nozzle 15 of the base cap 11, and FIG. 14 is a perspective view of the check valve member 21*a*. The same or similar structures as or to those in Embodiments 1-3 are denoted by the same reference numerals, and a description thereof is omitted.

The dispensing container includes five members in total, i.e., the container body 1 configured by blow molding, the base cap 11 assembled and fixed to the mouth 2 of the container body 1, the check valve member 21*a* assembled and fixed to the lower end portion of the base cap 11, the foaming member 31 including a cylindrical body provided at the upper end thereof with the mesh, and the suction tube 32 called dip tube.

In the present embodiments, the L-shaped nozzle 15 includes the horizontal portion 15*a* extending horizontally and a vertical portion 15*c* extending vertically, i.e. in the axis direction of the container body 1.

In the present embodiment, the horizontal portion 15*a* of the nozzle 15 has a rectangular tubular shape, and the vertical portion 15*c* has a cylindrical shape. (Refer to FIGS. 12 and 13.)

As illustrated in FIGS. 10 and 13, for example, the horizontal portion 15*a* has a rear end wall 15*bw* whose outer surface forms a flat area S. The through-hole 17 is also provided in middle of the rear end wall 15*bw*.

The vertical portion 15*c* has a circumferential wall, and abutment pieces 18*a* are provided at three positions at equal central angles in an upper end portion of the circumferential wall. The abutment pieces 18*a* are provided for positioning of the check valve member 21*a* with respect to the vertical direction and are later described.

The check valve member 21*a* is an injection-molded member made of the LDPE resin and has a shape illustrated in the perspective view in FIG. 14. The check valve member 21*a* includes a cylindrical base tubular piece 22*b* that is engaged onto the vertical portion 15*c* of the nozzle 15 in the externally fitting manner. A disk-shaped check valve 24*b* is also provided to stand via a swing plate piece 23*a*1 extending upward from an upper end edge of a rear end wall in a circumferential wall of the base tubular piece 22*b*.

The disk-shaped check valve 24*b* includes a circular projection 24*a* (as illustrated in FIGS. 8 and 14, for example), and the swing plate piece 23*a*1 is formed in a smaller thickness than the circumferential wall of the base tubular piece 22*b* and extends upward, in manner such that the check valve 24*b* is capable of swinging rearward without difficulty as described later.

From the upper end edge of side portions in the circumferential wall of the base tubular piece 22*b*, a pair of left and right rectangular side-plate pieces 25*a* is provided to stand. By sandwiching side walls of the horizontal portion 15*a* of the nozzle 15 of the base cap 11 between upper end portions of the side-plate pieces 25*a* (as illustrated in FIG. 11), orientation of the check valve member 21*a* when assembled to the base cap 11 is correctly determined, and the position of the check valve 24*b* when disposed over the through-hole 17 is easily and precisely set.

Around an inner circumferential wall of the base tubular piece 22*b*, the locking ridge 28 is circumferentially provided for positioning of the foaming member 31 with respect to the vertical direction.

Additionally, an inlet hole 26*a*, the suspended tubular piece 27, and the locking ridge 28 of the check valve member 21*a* have substantially the same structures as those of the inlet hole 26, the suspended tubular piece 27, and the locking ridge 28 of the cylinder 21 illustrated in FIG. 3.

Then, the five members described above are assembled and fixed in the following procedure, and the assembled state illustrated in FIG. 8 is achieved.

1) The foaming member 31 is engaged in the base tubular piece 22*b* of the check valve member 21*a* and mounted on the locking ridge 28.
2) The upper end of the suction tube 32 is engaged into the suspended tubular piece 27 of the check valve member 21*a*.
3) The vertical portion 15*c* of the nozzle 15 of the base cap 11 is engaged into an upper end portion of the base tubular piece 22*b* of the check valve member 21*a* to thereby assemble the base cap 11 to the check valve member 21*a*. At this time, the abutment pieces 18*a* serve to determine a limit to which the vertical portion 15*c* may be fitted.
4) The outer wall 13 of the base cap 11 is screwed to the mouth 2 of the container body 1, to thereby assemble and fix the base cap 11 to the container body 1.

In the assembled state as illustrated in FIG. 8, the check valve 24*b*, which is provided to extend above the upper end edge of the rear end wall in the base tubular piece 22*b* of the check valve member 21*a* via the swing plate piece 23*a*1, closes the through-hole 17 provided in the base cap 11. In this regard, since the through-hole 17 is formed in the flat area S formed by the outer surface of the rear end wall 15*bw* of the nozzle 15, the circular projection 24*a* formed in the check valve 24*b* may come into sealing abutment with a circumference of an opening edge of the through-hole 17, whereby the sealing function thereof is reliably exerted.

Furthermore, the side walls of the horizontal portion 15*a* of the nozzle 15 of the base cap 11 are sandwiched between the upper end portions of the pair of side-plate pieces 25*a* extending from both side walls of the base tubular piece 22*b*. Moreover, the foaming member 31 is sandwiched between a lower end of the vertical portion 15*c* of the nozzle 15 and the locking ridge 28 to be firmly fixed.

The junction space R, in which the liquid and air are joined and mixed, is also provided between the lower end of the foaming member 31 and the upper end of the suspended tubular piece 27. The junction space R and the foaming member 31 constitute the foaming mechanism K for turning the liquid L into the foamed liquid FL.

Then, in FIG. 8, upon a squeeze operation by hand applying pressure to the trunk 4 in a direction indicated by arrow outlines with blanks inside, the pressure inside the container is raised, and the liquid L stored in the container body 1 moves upward through the suction tube 32 and flows into the junction space R. At the same time, gas (air) Ar present in an upper portion of the container flows into the junction space R from the peripheral upper end portion of the suspended tubular portion 27 through the inlet hole 26*a*, and the liquid L and air Ar are mixed in the junction space R.

The mixture of the liquid L and gas Ar passes through the foaming member 31, and accordingly, by the effect of the mesh disposed at the upper end of the foaming member 31, fine air bubbles are evenly generated in the liquid L, and the foamed liquid FL is formed. The foamed liquid FL flows along the tubular passage formed by the nozzle 15 as indicated by cross-hatching in the figure and is dispensed from the front end orifice 16.

The dispensing operation may be terminated by releasing the pressure applied by hand. By doing so, the circumferential wall of the trunk 4 is restored to the original shape by elastic restorative force.

FIG. 9 is the longitudinally-sectioned side view illustrating the swing position of the check valve 24*b* when pressure applied to the trunk 4 is released. When the circumferential wall of the trunk 4 is restored to the original shape, the restoration places the inside of the container under reduced pressure, and due to the resulting suction back function, the check valve 24*b* elastically swings obliquely rearward about a base end portion of the swing plate piece 23*a*1 as a pivot, and sealing with respect to the through-hole 17 is released. Then, outer air starts to flow into the inside of the container from the front end orifice 16 through the through-hole 17. At the same time, in accordance with the flow of outer air, the foamed liquid FL remaining in the region extending from the front end orifice 16 to the through-hole 17, i.e., in the horizontal portion 15*a* of the nozzle 15, is returned to the inside of the container through the through-hole 17.

According to the suction back function exerted by the through-hole 17, outer air flows linearly from the front end orifice 16 toward the through-hole 17 and enters the inside of the container through the through-hole 17. Accordingly, in accordance with the flow of outer air, the foamed liquid FL is flowed backward to reach an area indicated by cross-hatching in FIG. 9 at early timing by causing the foamed liquid FL to flow back into the container. Accordingly, subsequent inflow of outer air into the inside of the container through the through-hole 17 is considerably smoothened, and the circumferential wall of the trunk 4 is restored at an early stage. Consequently, the subsequent squeeze operation may be performed immediately, and favorable dispensing operability is achieved.

It is also ensured that the foamed liquid FL remaining in the horizontal portion 15*a*, including at least a portion thereof near the front end orifice 16, is returned to the inside of the container body. As a result, the foamed liquid FL does not remain at least in the horizontal portion 15*a*, and the problem of liquid dripping or the like after use is sufficiently addressed.

Figure 15:
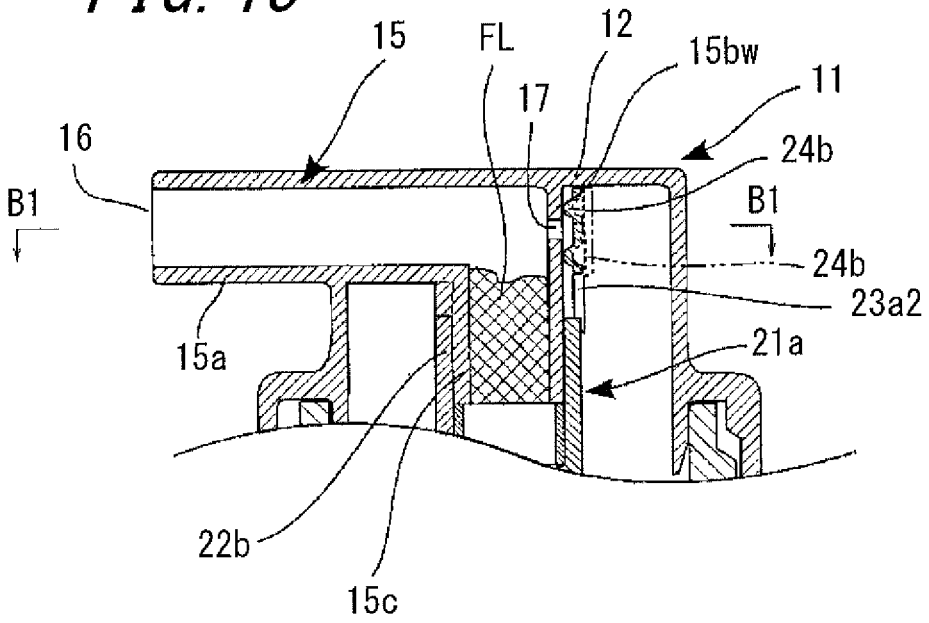
FIG. 15 is a longitudinally-sectioned partial side view of a dispensing container according to Embodiment 5 of the present invention.
Figure 16:
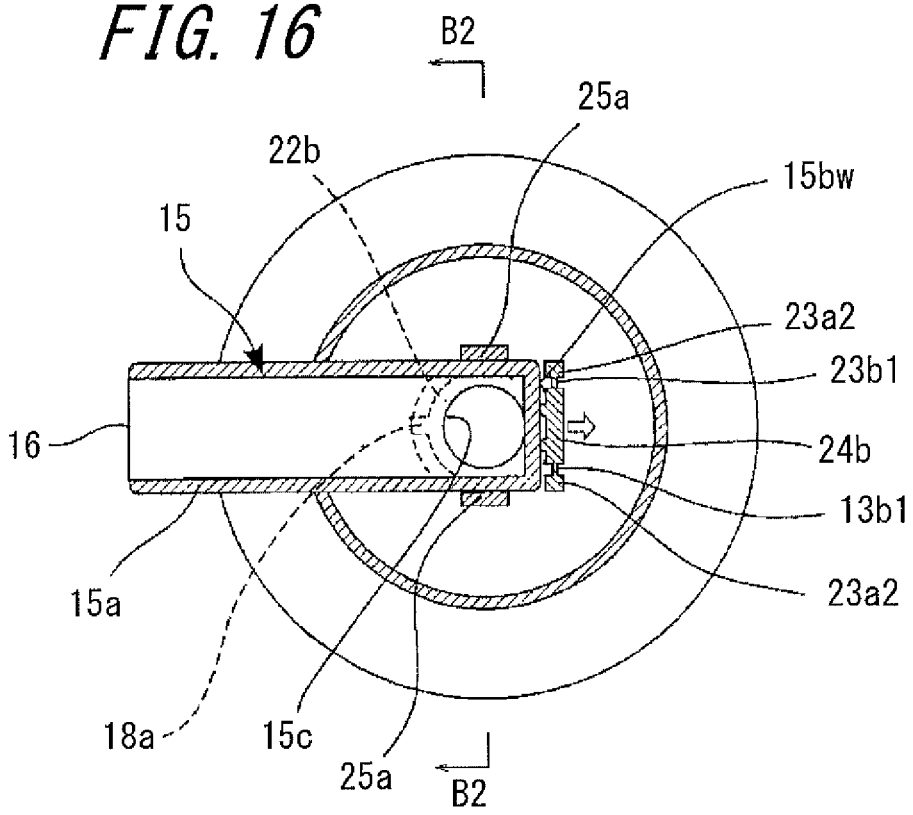
FIG. 16 is a sectional plan view taken along a line B1-B1 of FIG. 15, illustrating a state where a base cap of the container illustrated in FIG. 15 is engaged with a check valve member.
Figure 17:
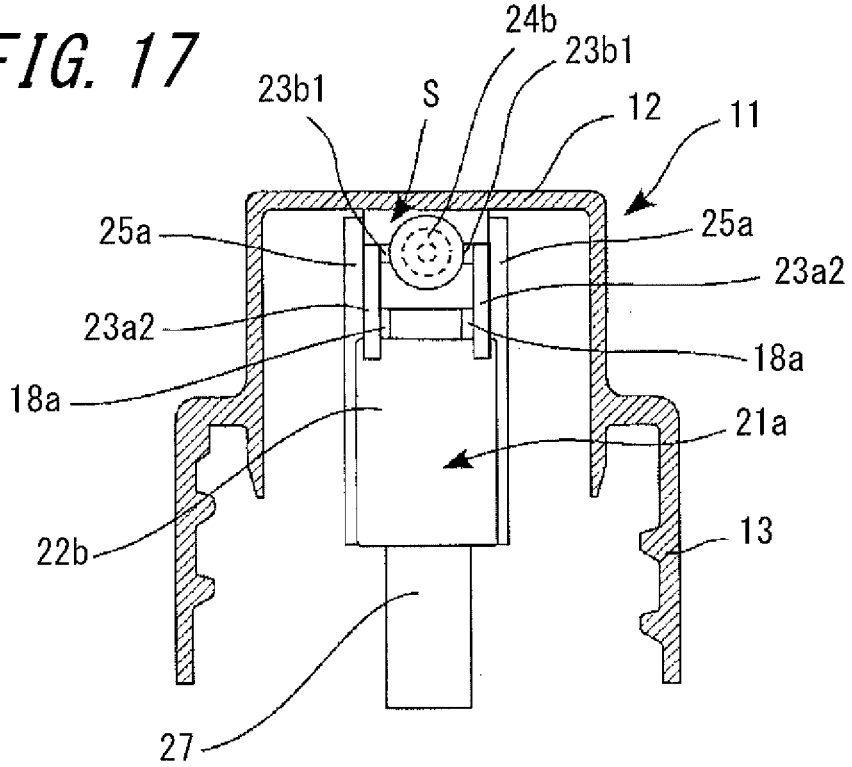
FIG. 17 is a longitudinal-sectioned partial rear view taken along a line B2-B2 of FIG. 16, illustrating a state where the base cap of the container illustrated in FIG. 15 is engaged with the check valve member.

Next, with reference to FIGS. 15-17 illustrating a dispensing container according to Embodiment 5 of the present invention, FIG. 15 is a longitudinally-sectioned side view of a part of the dispensing container, FIG. 16 is a sectional plan view illustrating a state where the base cap 11 and the check valve member 21*a*, which are the members of the container, are assembled together, and FIG. 17 is a longitudinal-sectioned partial rear view illustrating the state where the base cap 11 and the check valve member 21*a*, which are the members of the container, are assembled together.

The container according to the present embodiment has different structures with respect to how the check valve 24*b* is provided. Although similar to the container according to Embodiment 4 illustrated in FIG. 8 in other respects in structure, the container according to the present embodiment is different in terms of the way of providing the check valve 24*b*, i.e., that a pair of left and right support plate pieces 23*a*2 having a slim plate shape is provided to extend from the upper end edge of the rear end wall in the base tubular piece 22*b*, and that the disk-shaped check valve 24*b* is integrally provided between upper end portions of the support plate pieces 23*a*2 via a pair of swing connection pieces 23*b*1 in a bridged manner.

The check valve 24*b* is displaceable rearward by elastic deformation of the pair of swing connection pieces 23*b*1 as indicated by a two-dot chain line of FIG. 15 and also as indicated by an arrow outline with a blank inside of FIG. 16, and then, sealing with respect to the through-hole 17 is released.

Figure 18:
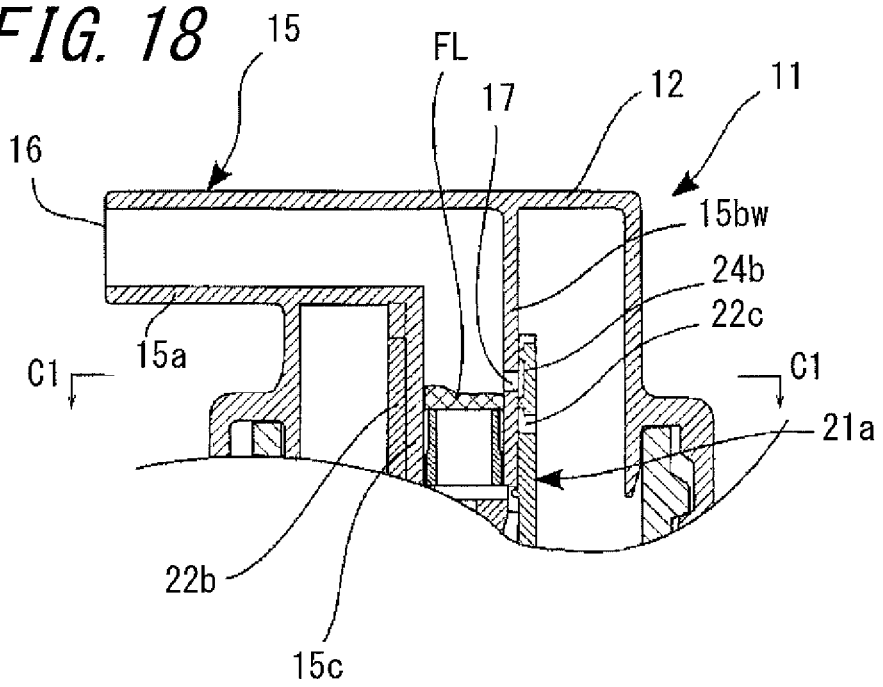
FIG. 18 is a longitudinally-sectioned partial side view of a dispensing container according to Embodiment 6 of the present invention.
Figure 19:
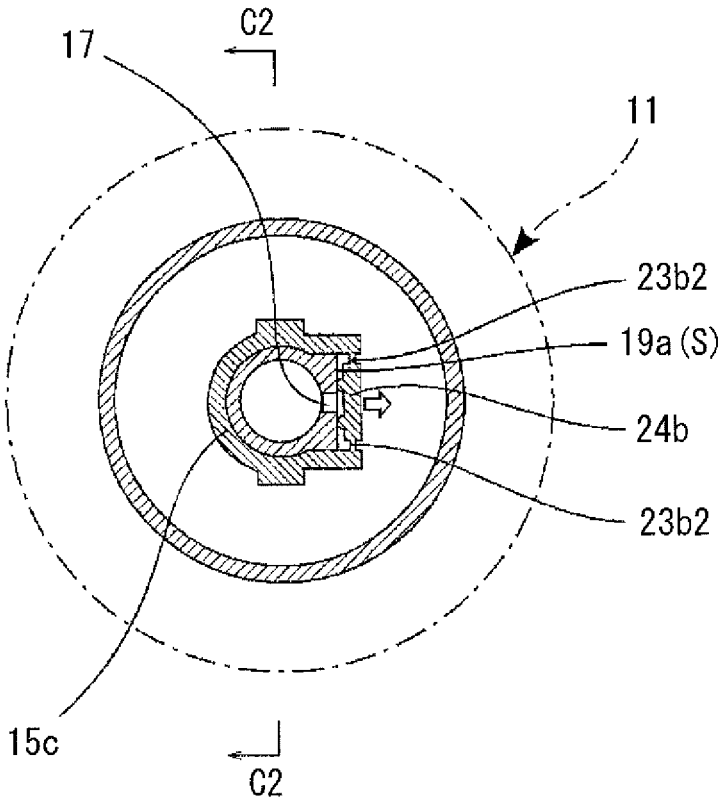
FIG. 19 is a sectional plan view taken along a line C1-C1 of FIG. 18, illustrating a state where a base cap of the container illustrated in FIG. 18 is engaged with a check valve member.
Figure 20:
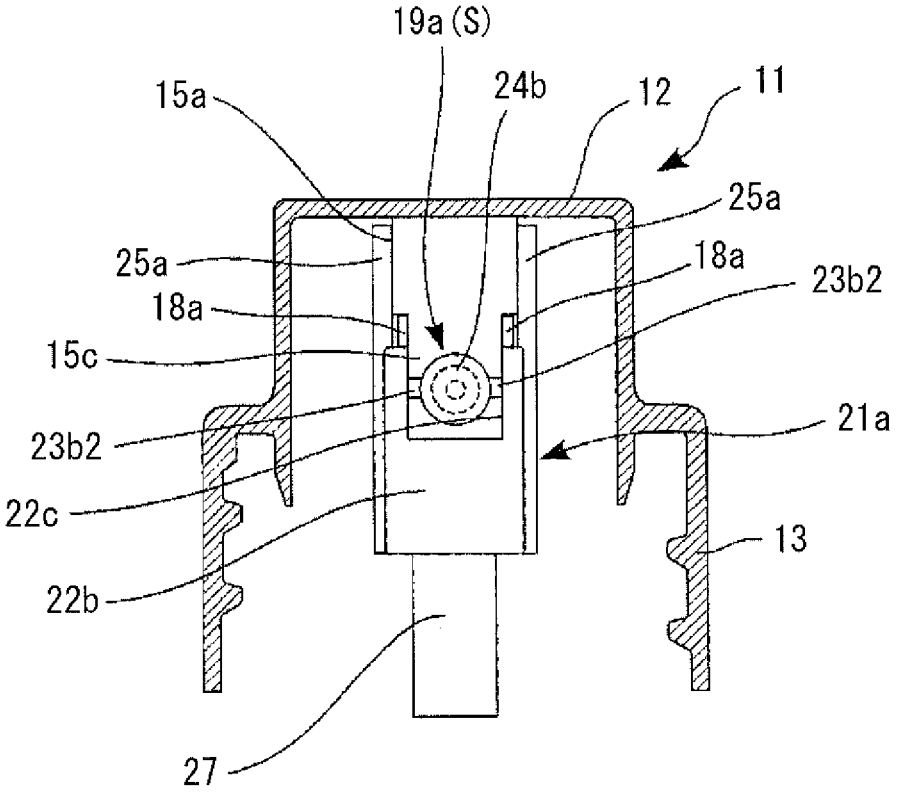
FIG. 20 is a longitudinal-sectioned partial rear view taken along a line C2-C2 of FIG. 19, illustrating a state where the base cap of the container illustrated in FIG. 18 is engaged with the check valve member.
Figure 21:
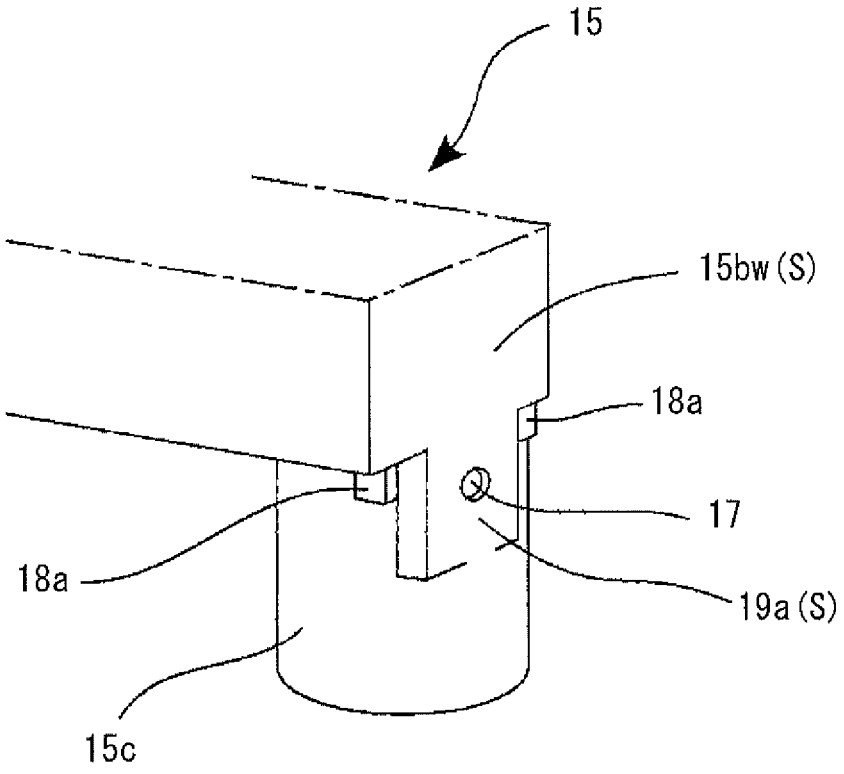
FIG. 21 is a partial perspective view of a nozzle of the base cap of the container illustrated in FIG. 18 as seen from obliquely rearward thereof.

FIGS. 18-21 illustrate a dispensing container according to Embodiment 6 of the present invention, and FIG. 18 is a longitudinally-sectioned side view of a part of the dispensing container, FIG. 19 is a sectional plan view illustrating the state where the base cap 11 and the check valve member 21*a*, which are the members of the container, are assembled together, FIG. 20 is a longitudinal-sectioned partial rear view illustrating the state where the base cap 11 and the check valve member 21*a*, which are the members of the container, are assembled together, and FIG. 21 is a partial perspective view of the nozzle 15 of the base cap 11 as seen from obliquely rearward thereof.

The container according to the present embodiment illustrates a case where the through-hole 17 is provided in a lower position in the rear end wall 15*bw* of the nozzle 15 closer to an upper end of the foaming mechanism K (foaming member 31), compared with the containers according to Embodiments 4 and 5.

In the present embodiment, since the through-hole 17 is provided in the lower position, as illustrated in FIG. 21, the flat surface area S is extended downward by providing an extending surface 19*a* on the rear end wall in the cylindrical vertical portion 15*c*.

On the other hand, in the check valve member 21*a*, as illustrated in FIG. 20, a cutout portion 22*c* is provided by cutting off a rectangular shape from the upper end edge of the rear end portion in the circumferential wall of the base tubular piece 22*b*, and the check valve 24*b* is provided in the cutout portion 22*c* via a pair of left and right swing connection pieces 23*b*2.

In this embodiment, when the suction back function is exerted, the swing connection pieces 23*b*2 are deformed elastically, and the check valve 24*b* is displaced rearward in a direction indicated by an arrow outline with a blank inside in FIG. 19, whereby sealing with respect to the through-hole 17 is released.

By thus providing the through-hole 17 in the upstream position close to the upper end of the foaming member 31, as illustrated by cross-hatching in FIG. 18, the amount of the foamed liquid FL remaining is drastically reduced.

Depending on a type of the liquid L, the air bubbles extinct at an early stage over time, and the foamed liquid FL turns into the original liquid L and flows back into the container body 1 through the foaming mechanism K. As a result, the amount of the foamed liquid FL and the liquid L remaining in the nozzle 15 may be reduced to substantially zero.

Next, Embodiments 7-8 of the present invention will be described in detail with reference to the drawings.

Figure 22A:
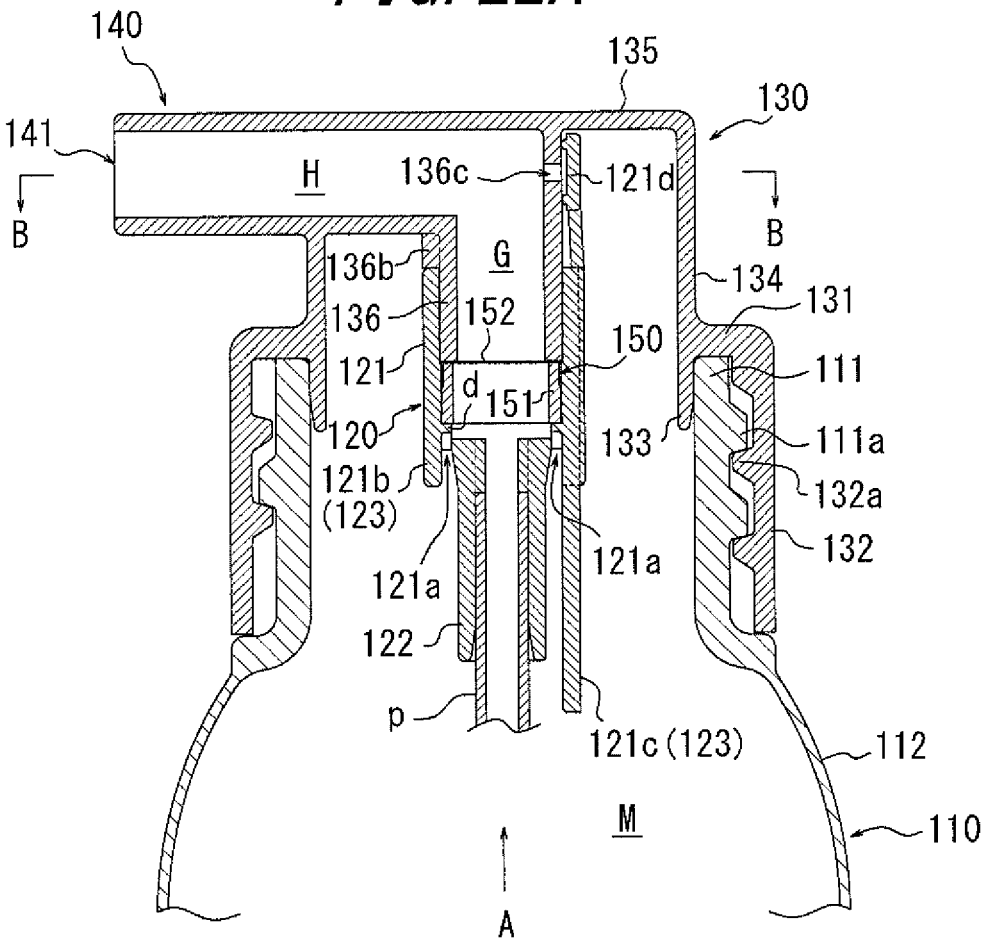
FIG. 22A is a partial sectional view.
Figure 22B:
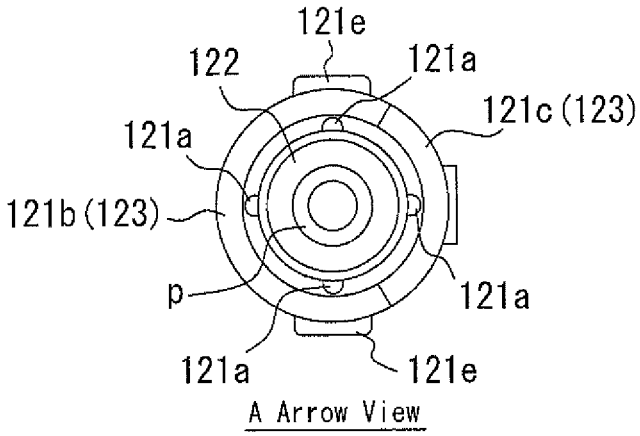
FIG. 22B is an arrow view taken from a direction of an arrow A illustrated in FIG. 22A.
Figure 23:
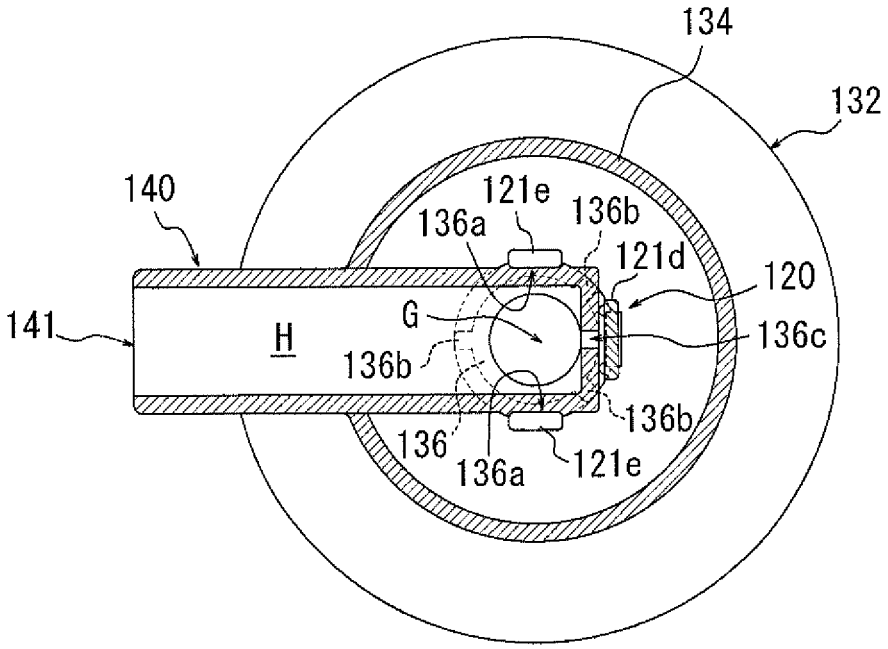
FIG. 23 is a sectional view taken along a line B-B illustrated in FIG. 22A.
Figure 24:
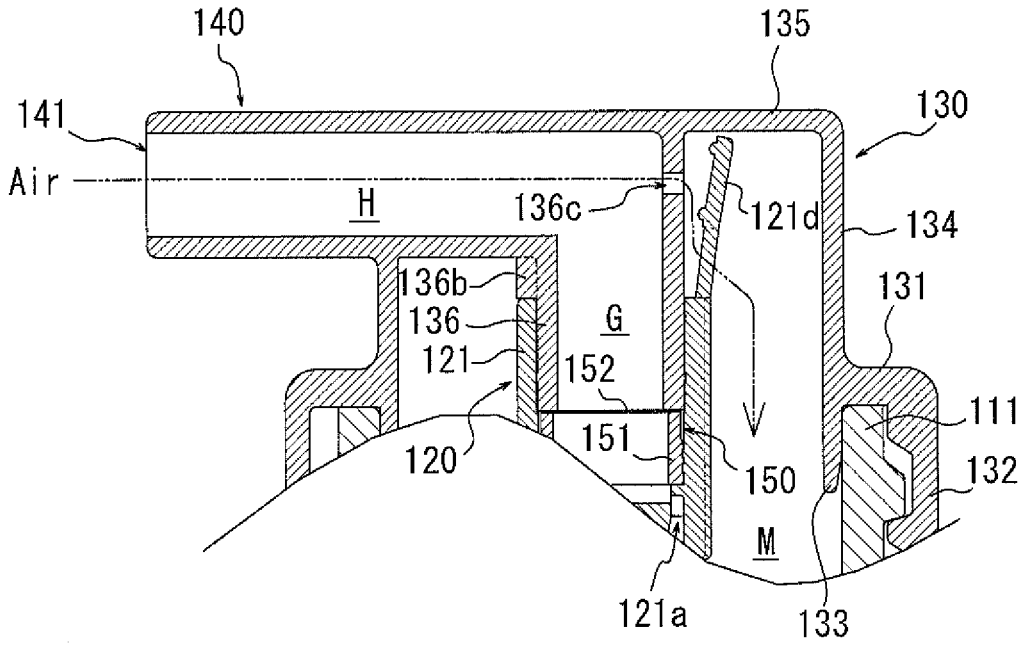
FIG. 24 illustrates a state where a suction back function is exerted in the dispensing container illustrated in FIG. 22.

FIGS. 22A and 22B illustrate a dispensing container according to Embodiment 7 of the present invention, and FIG. 22A is a sectional view of a part of the dispensing container, FIG. 22B is an arrow view taken from a direction of an arrow A illustrated in FIG. 22A, FIG. 23 is a sectional view taken along a line B-B illustrated in FIG. 22A, and FIG. 24 illustrates a state where the suction back function is exerted in the dispensing container illustrated in FIG. 22.

In FIG. 22, reference numeral 110 refers to the container body. The container body 110 includes a cylindrical mouth 111 with an opening in an upper portion thereof, a cylindrical trunk 112 that is connected to the mouth 111 and that extends to a bottom (not illustrated), and a filling space M for the content provided inside thereof. The trunk 112 herein is flexible and made of, for example, a synthetic resin or the like. The mouth 111 has an outer surface wall on which a screw portion 111*a* is formed.

Reference numeral 120 refers to the cylinder that is suspendedly held in the mouth 111 by a base cap that is later described. In the illustrated example, the cylinder 120 includes a cylinder body 121 having a bottomed cylindrical shape, and a cylindrical fitting portion 122 integrally connected to a bottom portion of the cylinder body 121. The fitting portion 122 is fitted with a suction tube p configured to suck the content stored in the filling space M in response to the trunk 112 being squeezed. In the bottom portion of the cylinder body 121, at least one hole (inlet hole 121*a*) passing through back and front of the bottom portion is provided radially outside the fitting portion 122. (In the illustrated example, four inlet holes 121*a* are provided at an equal interval in a circumferential direction.) In the illustrated example, an annular wall 121*b* is provided. The annular wall 121*b* is integrally connected to the cylinder body 121 and surrounds the inlet hole 121*a*. The annular wall 121*b* has a lower end which is partly suspended to form a contiguous tongue piece 121*c* in an integrally connected manner. With the above structure, a shielding wall 123, which is constituted by the annular wall 121*b* and the tongue piece 121*c*, covers the inlet hole 121*a*, with a bottom portion thereof being left open. Furthermore, in the illustrated example, there is provided a check valve 121*d* that is integrally connected to an upper portion of the cylinder body 121 on a side thereof provided with the tongue piece 121*c* for covering a through-hole that is later described. The cylinder 120 protrudes radially outward from the cylinder body 121 and includes a positioning rib 121*e* that has a rectangular shape in the example illustrated in FIG. 23. Although a side view is omitted, the positioning rib 121*e* protrudes upward from an upper end of the cylinder body 121.

In the mouth 111 of the container body 110, the base cap 130 is mounted. The base cap 130 includes a ring-shaped top wall 131 positioned in an upper portion of the mouth 111, and from an outer end edge of the top wall 131, an integrally connected outer wall 132 is suspended to surround an outer side of the mouth 111. The outer wall 132 has an inner surface provided with a screw portion 132*a* configured to engage with the screw portion 111*a* formed in the mouth 111. On the end edge of an inner side of the top wall 131, a sealing wall 133 is also provided to suspend along an inner surface of the mouth 111 and maintain liquid-tight sealing therebetween. Accordingly, the base cap 130 is detachably fixed and held while sealing the mouth 111. Note that, although in the drawing it is illustrated that the base cap 130 is fixed and held by screw, the base cap 130 may be fixed and held by undercut.

The base cap 130 also includes an annular upper portion wall 134 standing from the end edge of the inner side of the top wall 131 and a ceiling wall 135 covering the top portion wall 134. Note that the base cap 130 includes a cylindrical nozzle 140 that is integrally connected to the top portion wall 134 and the ceiling wall 135 to extend laterally and that is provided at a front end thereof with a front end orifice 141 serving as an ejection orifice for the content. The base cap 130 also includes an inner tubular body 136 that is suspended from the ceiling wall 135 and that is integrally connected to a rear end of the nozzle 140. The inner tubular body 136 is inserted and fitted into the cylinder body 121, whereby the cylinder 120 is suspendedly held. Furthermore, as illustrated in FIG. 23, although not illustrated in a side view, in the inner tubular body 136, a recessed portion 136*a* is provided to extend upward from a lower end of the inner tubular body 136. The recessed portion 136*a* is formed by denting an outer surface wall of the inner tubular body 136 inward in correspondence with the positioning rib 121*e* included in the cylinder 120. Moreover, as illustrated in FIG. 22A, a protruding portion 136*b* is provided above the recessed portion 136*a*. With the above structure, when inserted to the inner tubular body 136, the cylinder 120 is held unrotationally by the positioning rib 121*e* coming into engagement with the recessed portion 136*a* and is positioned to be held at a predetermined height by the upper end of the cylinder 120 coming into abutment against the protruding portion 136*b*.

By mounting the cylinder 120 to the base cap 130, a longitudinal junction space G and a lateral expulsion passage H communicating with the junction space G are formed thereinside. In this regard, the inner tubular body 136 connected to the rear end of the nozzle 140 is also provided with a through-hole 136*c* that lets the expulsion passage H communicate with the filling space M provided in the container body 110. The through-hole 136*c* is closed from outside of the inner tubular body 136 by the aforementioned check valve 121*d*.

Inside the junction space G, a foaming member 150 is provided. In the illustrated example, the foaming member 150 is sandwiched between a ring-shaped stepped portion d provided inside the cylinder body 121 and the lower end of the inner tubular body 136. The foaming member 150 includes a ring 151 and a mesh 152 adhered to an end surface of the ring 151. The foaming member 150 is capable of foaming an air-containing content by passing the content through the foaming member 150. The number of the foaming members 150 to be provided and coarseness of the mesh 152 are appropriately changed in accordance with the type of the content.

In the dispensing container configured as above, when the trunk 112 is squeezed, pressure is applied to the filling space M under the effect of the check valve 121*d*, and the content passes through the suction tube p and reaches the junction space G. Similarly, air under pressure also passes though the inlet hole 121*a* and reaches the junction space G. The content, which is turned into a desired foam by passing through the foaming member 150 together with air, is dispensed from the front end orifice 141 of the nozzle 140 through the expulsion passage H. Subsequently, when squeezing of the trunk 112 is released, the flexible trunk 112 is restored to the original shape. Consequently, the filling space M assumes the negative pressure, and as illustrated in FIG. 24, the foamed content remaining in the expulsion passage H causes the check valve 121*d* to open, passes through the through-hole 136*c* together with outer air, and is introduced to the filling space M. Here, the inlet hole 121*a*, except for the bottom portion thereof, is covered by the shielding wall 123 constituted by the annular wall 121*b* and the tongue piece 121*c*. Accordingly, the remaining content is prevented from flowing directly into the inlet hole 121*a*, and probability that the bubbles of the content clog up the inlet hole 121*a* is sufficiently reduced. As a result, a mixture ratio of the content and air is maintained to be a desired ratio, and the fine-textured foam is stably expelled.

Additionally, although the shielding wall 123 may be constituted by the annular wall 121*b* alone, it is preferable that the tongue piece 121*c* is provided at least on the side of the through-hole 136*c* as illustrated in the figures. In this case, the annular wall 121*b* may be omitted, and the tongue piece 121*c* may be directly connected to the cylinder body 121. With the above structure, the inlet hole 121*a* positioned on the side provided with the through-hole 136*c*, into which the remaining content might directly flow, is effectively covered by the shielding wall 123 having a smallest possible size. Furthermore, the shielding wall 123 and the check valve 121*d* may be provided as independent members separately from the cylinder 120.

Figure 25A:
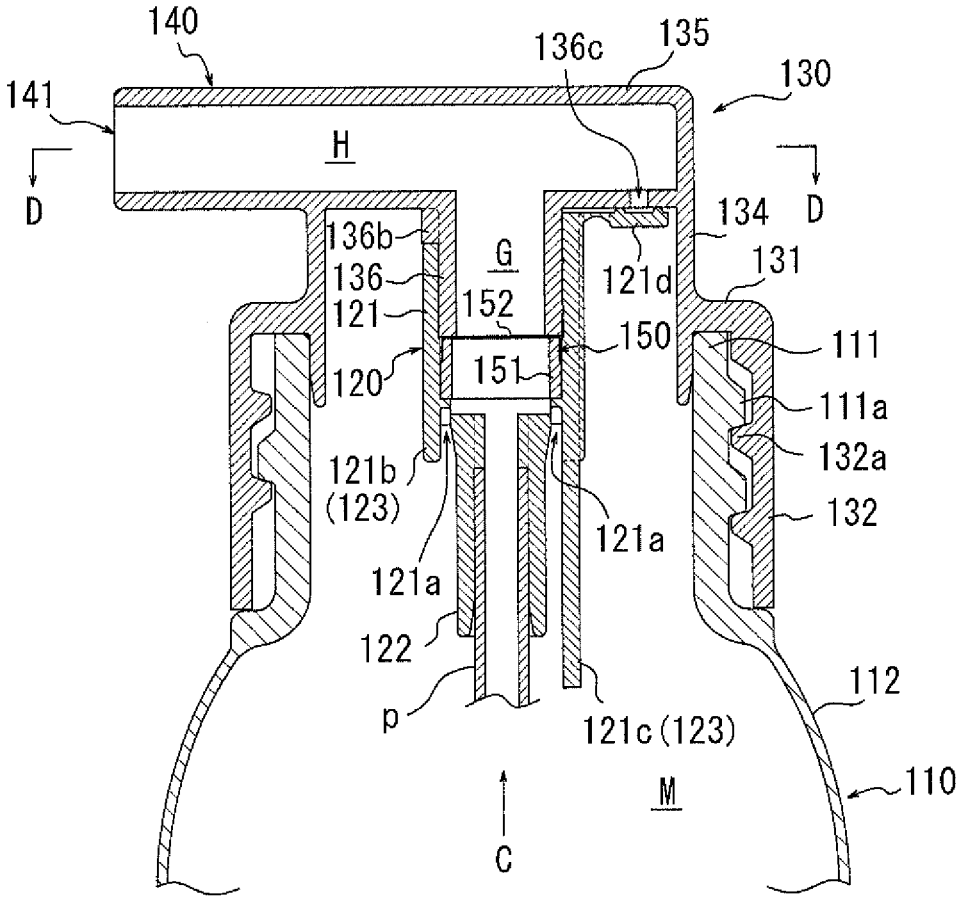
FIG. 25A is a partial sectional view.
Figure 25B:
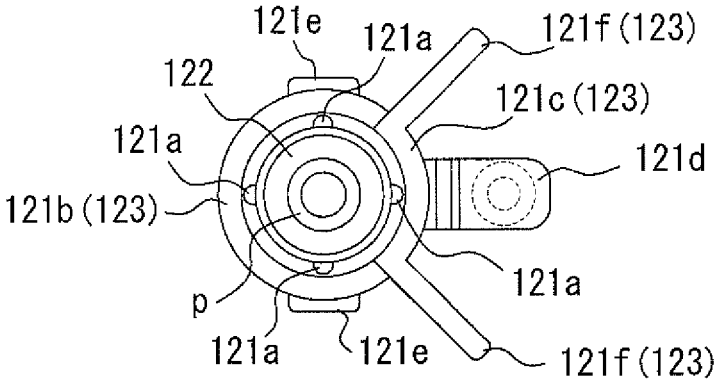
FIG. 25B is an arrow view taken from a direction of an arrow C illustrated in FIG. 25A.
Figure 26:
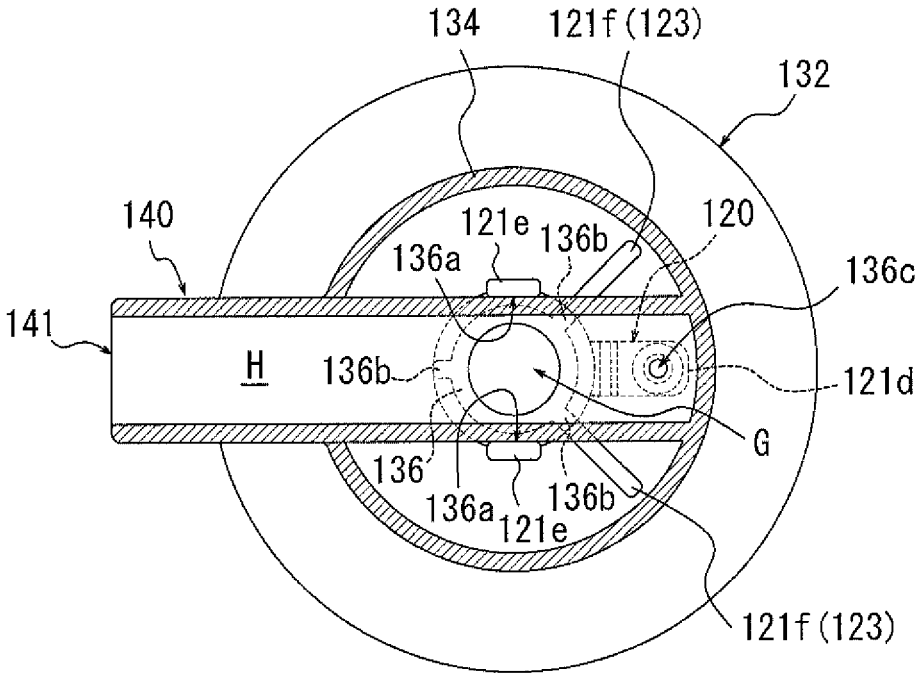
FIG. 26 is a sectional view taken along a line D-D illustrated in FIG. 25A.
Figure 27:
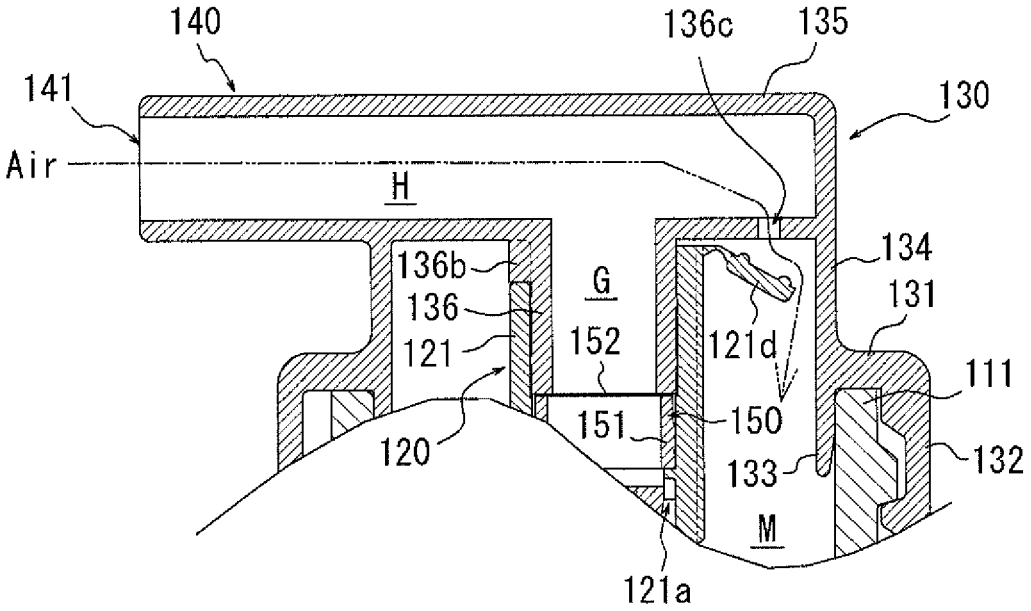
FIG. 27 illustrates a state where a suction back function is exerted in the dispensing container illustrated in FIG. 25.

FIGS. 25-27 illustrate a dispensing container according to Embodiment 8 of the present invention. In contrast to the dispensing container illustrated in FIGS. 22-24, the present embodiment provides a pair of barrier walls 121*f* on side edges on both sides of the tongue piece 121*c* and configures the shielding wall 123 by the annular wall 121*b*, the tongue piece 121*c*, and the barrier walls 121*f*. The present embodiment also provides the vertical through-hole 136*c* by coupling the inner tubular body 136 to the upper portion wall 134 (although the inner tubular body 136 is coupled to the upper portion wall 134 on an opposite side to the front end orifice, the present embodiment is not limited to the example), and also arranges the check valve 121*d* in a folded manner. Although there is a problem that the remaining content introduced from the through-hole 136*c* might flow around to the back of the side edge of the tongue piece 121*c* that is relatively close to the through-hole 136*c* and flow into the inlet hole 121*a*, by providing the barrier walls 121*f*, the flow-around of the content is prevented. As a result, clog up of the inlet hole 121*a* is less likely to occur, and the desired foamed content is stably and continuously expelled. Furthermore, the shielding wall 123 and the check valve 121*d* may be provided as independent members separately from the cylinder 120.

Meanwhile, the check valve 121*d* may have any shape as long as the check valve 121*d* is capable of closing through-hole 136*c*, and the shape of the check valve 121*d* is not limited to those illustrated in FIGS. 22-27.

Next, Embodiment 9 of the present invention will be described in detail with reference to the drawings.

Figure 28:
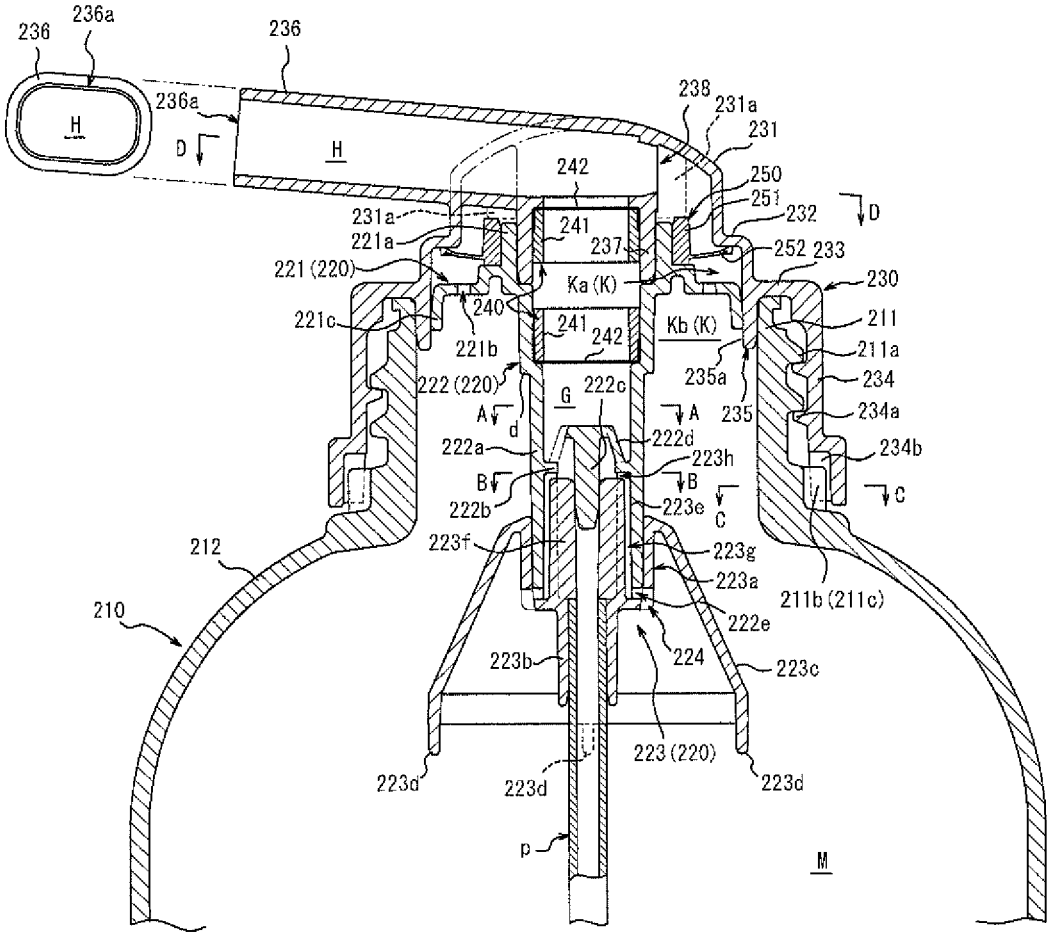
FIG. 28 is a partial sectional side view of a dispensing container according to Embodiment 9 of the present invention.
Figure 29:
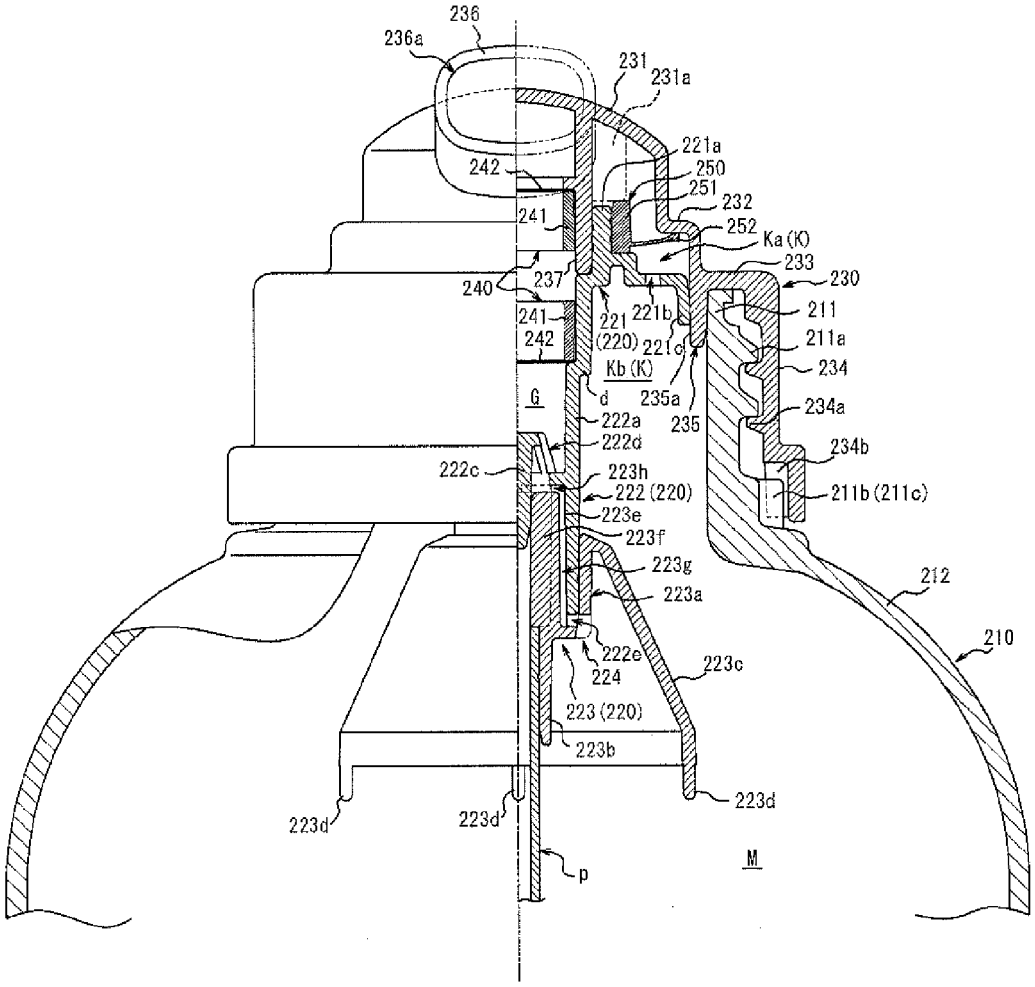
FIG. 29 is a sectional front view of the dispensing container illustrated in FIG. 28.
Figure 30:
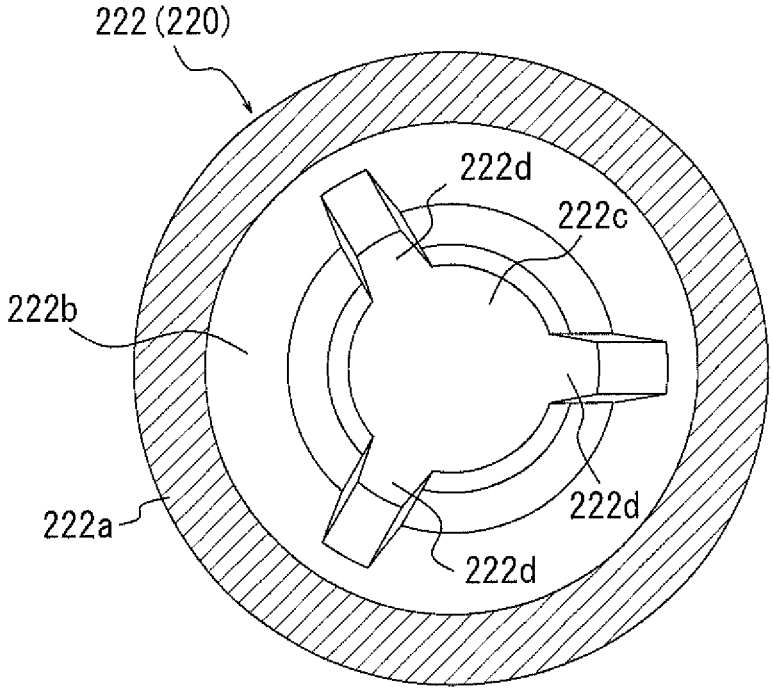
FIG. 30 is a sectional view taken along a line A-A illustrated in FIG. 28.
Figure 31A:
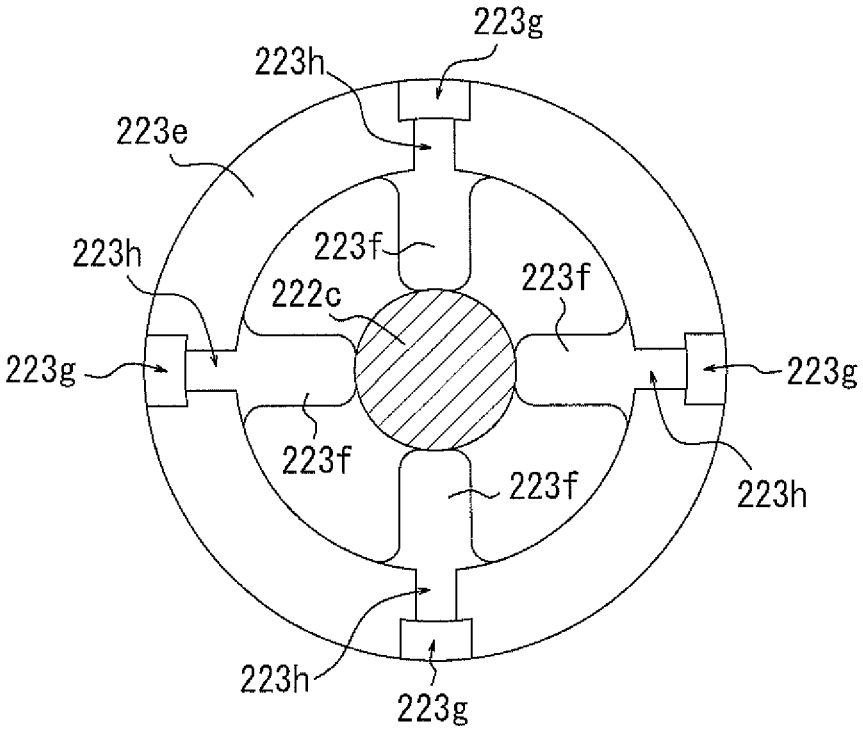
FIG. 31A is a sectional view taken along a line B-B illustrated in FIG. 28.
Figure 31B:
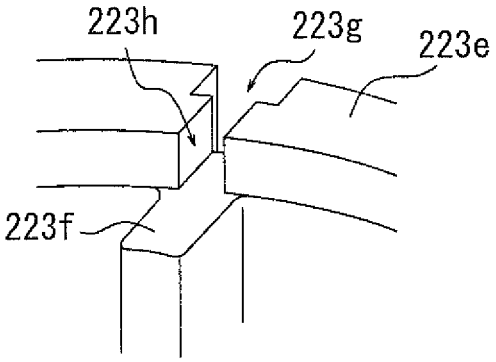
FIG. 31B is a partial perspective view of FIG. 31A.
Figure 32:
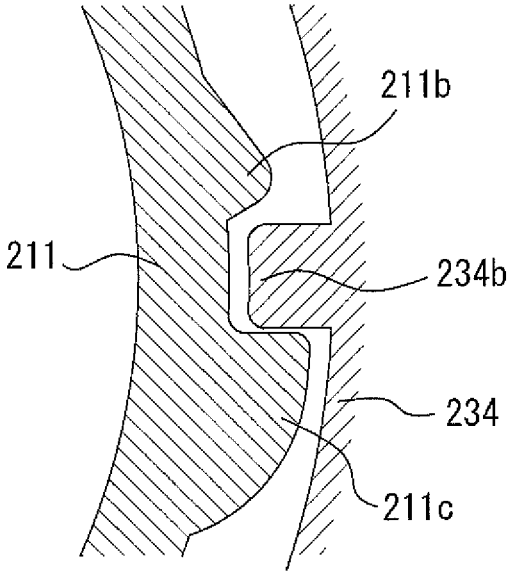
FIG. 32 is a sectional view taken along a line C-C illustrated in FIG. 28.
Figure 33:
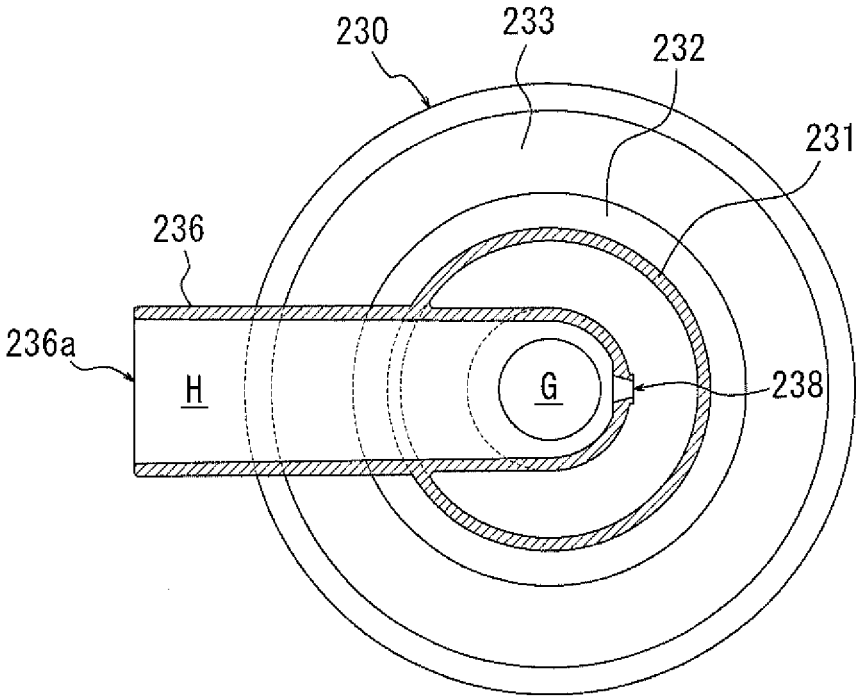
FIG. 33 is a sectional view taken along a line D-D illustrated in FIG. 28.

FIG. 28 is a partial sectional side view of a dispensing container according to Embodiment 9 of the present invention, FIG. 29 is a sectional front view of the dispensing container illustrated in FIG. 28, FIG. 30 is a sectional view taken along a line A-A illustrated in FIG. 28, FIG. 31A is a sectional view taken along a line B-B illustrated in FIG. 28, FIG. 31B is a perspective view of FIG. 31A, FIG. 32 is a sectional view taken along a line C-C illustrated in FIG. 28, and FIG. 33 is a sectional view taken along a line D-D illustrated in FIG. 28.

In FIG. 28, reference numeral 210 refers to the container body. The container body 210 includes a cylindrical mouth 211 with an opening in an upper portion thereof, a cylindrical trunk 212 that is connected to the mouth 211 and that extends to a bottom (not illustrated), and the filling space M for the content provided inside thereof. The trunk 212 herein is flexible and made of, for example, a synthetic resin or the like. The mouth 212 has an outer surface wall on which a screw portion 211*a* is formed. Furthermore, as illustrated in FIG. 32, in a base portion of the mouth 211, a small protuberance 211*b* and a large protuberance 211*c* are provided at an interval in the circumferential direction.

Reference numeral 220 refers to the cylinder that is suspendedly held in the mouth 211 by a base cap that is later described. In the illustrated example, the cylinder 220 includes a cylinder body 222 and a cylinder bottom body 223. The cylinder body 222 includes a flange 221 in an upper portion thereof. A lower end portion of the cylinder body 222 is inserted and fitted into the cylinder bottom body 223, and thus, the cylinder bottom body 223 serves as a bottom of the cylinder 220.

The cylinder body 222 includes a tubular body 222*a* that includes a small-diameter lower portion, a large-diameter upper portion, and a stepped portion d connecting the lower portion and the upper portion. Inside of the tubular body 222*a*, a ring plate 222*b* extending radially inward is provided. Further inward of the ring plate 222*b*, a bar body 222*c* extending in an axis direction of the cylinder body 222 is also provided. The bar body 222*c* is held such that an upper portion of the bar body 222*c* is integrally connected to a connection piece 222*d* extending obliquely upward from the ring plate 222*b*. As illustrated in FIG. 30, a plurality of the connection pieces 222*d* is provided at an interval (in the illustrated example, a total of three connection pieces 222*d* are provided at an equal interval) in the circumferential direction. Furthermore, as illustrated in FIG. 28, the tubular body 222*a* has a lower end portion that is provided with at least one cutout portion 222*e* that is opened downward and that is provided at an interval in the circumferential direction.

The flange 221, which is integrally connected to an upper portion of the tubular body 222*a*, includes an annular fitting wall 221*a* that stands upward and that is fitted and held to the base cap that is later described, at least one hole (outlet hole 221*b*) that passes through back and front of the flange 221, and an annular wall 221*c* that is provided around an end edge of the flange 221 and that extends downward in the example illustrated in FIG. 28.

The cylinder bottom body 223 includes a bottom portion 223*a* having a bottomed cylindrical shape that is inserted to a lower portion of the tubular body 222*a* to be fitted and held and that has an orifice in a middle portion thereof, a cylindrical fitting portion 223*b* that is suspended to surround the orifice of the bottom portion 223*a*, an inclined wall 223*c* that is integrally connected to an upper portion of the bottom portion 223*a* and that has a conical shape with a diameter increasing toward bottom, and a protrusion 223*d* that is integrally connected to a lower end of the inclined wall 223*c* and that is provided at an interval in the circumferential direction (in the illustrated example, four protrusions 223*d* are provided at an equal interval.) Moreover, the suction tube p, which is configured to suck the content stored in the filling space M in response to the trunk 212 being squeezed, is fitted and held to the fitting portion 223*b*.

As illustrated in FIGS. 31A and 31B, inside the cylinder bottom body 223, an annular inner wall 223*e* stands, and the inner wall 223*e* is fitted and held to an inner circumferential surface of the tubular body 222*a* as illustrated in FIG. 28. An inner circumferential wall of the inner wall 223*e* is provided with a plurality of ribs 223*f* configured to support the bar body 222*c* at an interval in the circumferential direction (in the illustrated example, four ribs 223*f* are provided at an equal interval). An outer circumferential surface of the inner wall 223*e* is also provided with a plurality of outer groove portions 223*g* at an interval in the circumferential direction (in the illustrated example, four outer groove portions 223*g* are provided at an equal interval). An upper surface of the inner wall 223*e* is provided with an upper groove portion 223*h* communicating with the outer groove portions 223*g*. Note that, as illustrated in FIG. 28, the cylinder bottom body 223 also includes, in a connection portion between a bottom wall and a circumferential wall of the bottom portion 223*a*, an inlet hole 224 for taking air into an inside of the cylinder bottom body 223.

The cylinder 220 configured as above is capable of introducing the content stored in the filling space M to an inside thereof, based on a flow path of the content extending from the suction tube p through space between the ribs 223*f* to space between the connection pieces 222*d* in the stated order. On the other hand, air contained in the filling space M is introduced to the inside, based on a flow path of air extending from the inlet hole 224, through the cutout portion 222*e*, the outer groove portion 223*g*, and the upper groove portion 223*h*, to the space between the connection pieces 222*d* in the stated order.

In the mouth 211 of the container body 210, a base cap 230 is mounted. The base cap 230 includes a dome-shaped top wall 231 covering the mouth 211, and the top wall 231 includes a ring wall 233 integrally connected to the top wall 231 via a stepped portion 232. The top wall 231 has an inner surface provided with a positioning rib 231*a* for positioning of a check valve to be assembled. The check valve is later described. An annular outer wall 234 is also provided radially outward of the ring wall 233. The outer wall 234 extends from an edge portion of the ring wall 233 and has an inner surface provided with a screw portion 234*a* configured to engage with the screw portion 211*a* formed in the mouth 211. As illustrated in FIG. 32, a detent rib 234*b* is also provided in a lower end portion of the outer wall 234. With the above structure, when the base cap 230 is screwed, right before the base cap 230 is completely screwed in, the detent rib 234*b* crosses the small protuberance 211*b* and is locked against rotation and held between the small protuberance 211*b* and the large protuberance 211*c*. Furthermore, as illustrated in FIG. 28, a sealing wall 235 is provided radially inward of the ring wall 233 for sealing the filling space M. In this regard, an radially inner surface of the sealing wall 235 constitutes an inner surface wall 235*a* of the base cap 230 with which the annular wall 221*c* provided around the end edge of the flange 221 is in elastic contact without space therebetween. Note that, although in the drawing it is illustrated that the base cap 230 is fixed and held by screw, the base cap 230 may be fixed and held by undercut.

The base cap 230 also includes a nozzle 236 that is integrally connected with the top wall 231 and that is slightly tilted upward toward a front end thereof, and an inner tubular portion 237 that is integrally connected with the top wall 231 and the nozzle 236 on a rear end side of the nozzle 236. By inserting and fitting the inner tubular portion 237 in the fitting wall 221*a* of the cylinder 220, the cylinder 220 is suspendedly held in the mouth 211. As a result, an annular passage K is defined between an outer surface wall of the cylinder 220 and the base cap 230 and between the outer surface wall of the cylinder 220 and the mouth 211. The annular passage K is covered by the top wall 231 on top thereof and communicates with the filling space M provided in the container body 210. The annular passage K is divided into an upper and a lower portion, and accordingly, the annular passage K is defined to have an upper annular passage Ka in the upper portion and a lower annular passage Kb in the lower portion. On the other hand, inner space defined by the cylinder body 222 and the cylinder bottom body 223 serves as the junction space G in which, in response to squeezing of the trunk 212, the content introduced through the aforementioned flow path of the content is mixed with air introduced through the aforementioned flow path of air to be foamed.

In the junction space G, a foaming member 240 is disposed. In the illustrated example, one foaming member 240 is disposed both on the stepped portion d of the tubular body 222*a* and in the inner tubular portion 237 of the base cap 230. The foaming member 240 has substantially the same structure as that of the aforementioned foaming member 150.

After passing through the foaming member 240 and being foamed, the content is delivered toward the nozzle 236. At this time, since the expulsion passage H communicating with the junction space G is formed inside the nozzle 236, the content is dispensed to the outside from an outlet of the expulsion passage H, that is, a front end orifice 236*a* of the nozzle 236. Furthermore, the inner tubular portion 237 of the base cap 230 is provided with a through-hole 238 that lets the expulsion passage H communicate with the annular passage K. In the annular passage K, a check valve 250 is positioned by a positioning rib 231*a* to be fitted to the fitting wall 221*a* and is held without compromising sealing performance. The check valve 250 includes a ring 251, and an elastically displaceable annular valve body 252 that is arranged outside the ring 251. The valve body 252 is in sealing contact with a lower surface of the stepped portion 232 of the base cap 230. With the above structure, air and the content introduced from the filling space M are not expelled from the through-hole 238, while outer air or the like is introduced into the filling space M through the through-hole 238.

In the dispensing container configured as above, when the trunk 212 is squeezed, pressure is applied to the filling space M under the effect of the check valve 250, and the content follows the aforementioned flow path of the content and reaches the junction space G. Similarly, air under pressure also follows the aforementioned flow path of air and reaches the junction space G. The content, which is turned into a desired foam by passing through the foaming member 240 together with air, is dispensed from the front end orifice 236*a* of the nozzle 236 through the expulsion passage H. Subsequently, when squeezing of the trunk 212 is released, the flexible trunk 212 is restored to the original shape. Consequently, the filling space M assumes the negative pressure, and the foamed content remaining in the expulsion passage H passes through the through-hole 238 together with outer air, displaces the valve body 252 of the check valve 250 downward, and is introduced to the upper annular passage Ka. Here, the upper annular passage Ka serves as a storage space that is defined by the flange 221 and that temporality stores the remaining content introduced, and therefore, the remaining content being foamed is temporality retained in the storage space. Consequently, when passing through the outlet hole 221*b*, the remaining content is returned to the filling space M with reduced bubbles. As a result, the filling space M is prevented from being immediately filled with the bubbles of the remaining content, and the inlet hole 224 for air is less likely to be clogged up by the bubbles of the remaining content. Accordingly, the mixture ratio of the content and air is maintained to be the desired ratio, and the fine-textured foam is stably and continuously expelled.

Moreover, as illustrated in FIGS. 28 and 33, the outlet hole 221*b* has an opening area smaller than that of the through-hole 238, and therefore, it is ensured that size of the bubbles of the remaining content when returning to the filling space M is reduced. As a result, the problem of the bubbles of the remaining content filling the filling space M is further prevented.

Figure 34:
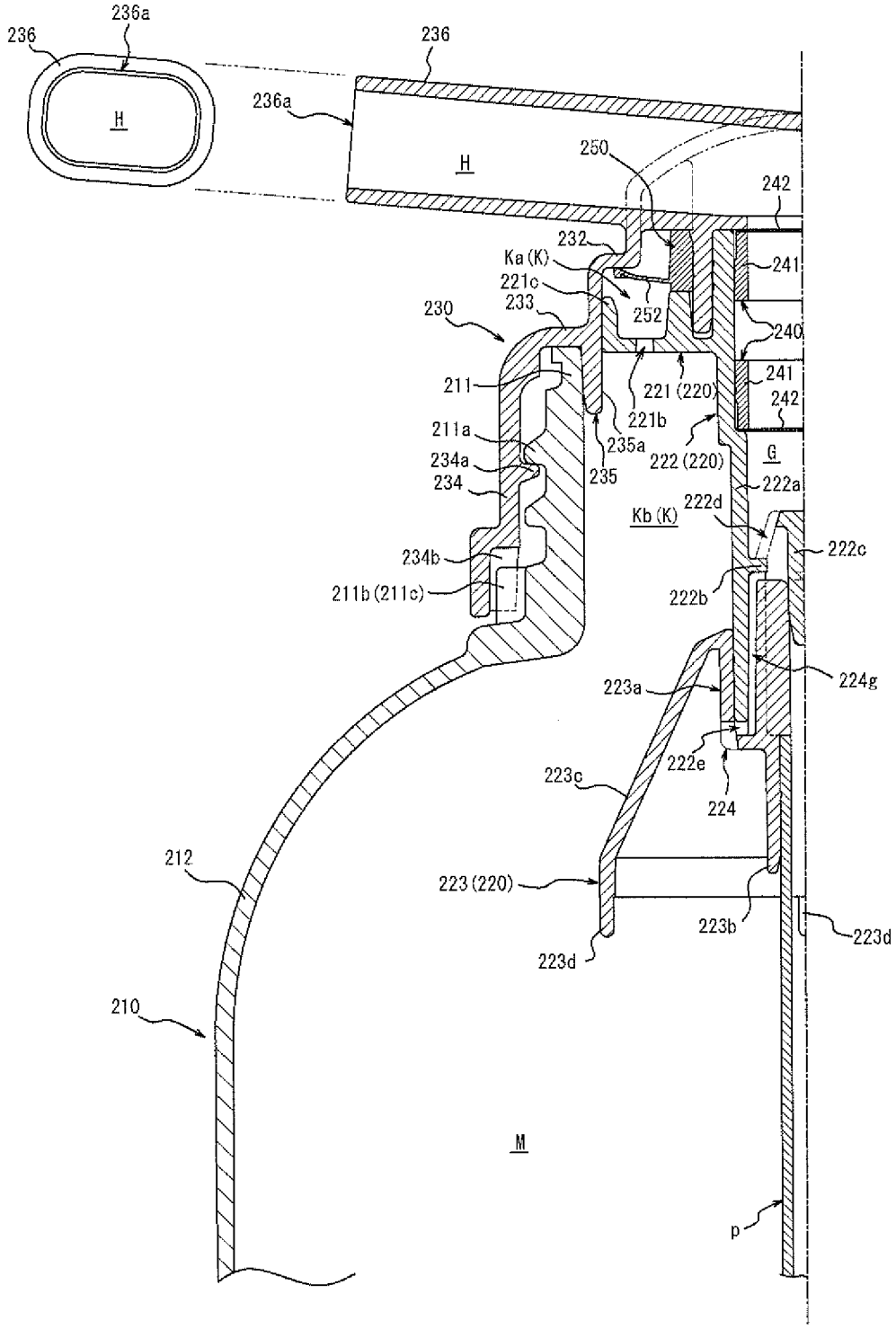
FIG. 34 is a partial sectional side view of a dispensing container according to Embodiment 10 of the present invention.

Moreover, as illustrated in the figures, when the annular wall 221*c* is provided around the end edge of the flange 221 to be in elastic contact with the inner surface wall 235*a* of the base cap 230, it is ensured that the remaining content is prevented from leaking out from space between the flange 221 and the inner surface wall 235*a*. As a result, the remaining content is reliably introduced to the filling space M through the outlet hole 221*b* alone, and therefore, even when the content is dispensed successively, the desired foam is stably expelled. Additionally, the annular wall 221*c* may be configured to stand upward from the end edge of the flange 221 as illustrated in FIG. 34. In this case, although not illustrated, by providing the standing annular wall 221*c* such that an upper end of the annular wall 221*c* abuts against a lower surface of the stepped portion 232, the cylinder 220 may be suspendedly held in a reliable manner without tottering.

Moreover, the inclined wall 223*c* of the cylinder 220 is provided such that an outer surface of the inclined wall 223*c* is further away from the inlet hole 224 in a portion of the inclined wall 223*c* that is located further downward. As a result, it is ensured that the problem of the remaining content flowing directly into the inlet hole 224 after passing through the outlet hole 221*b* is prevented. Moreover, when the protrusion 223*d* is provided, the remaining content flowing down the outer surface of the inclined wall 223*c* is likely to drop from the protrusion 223*d* down to the filling space all together similarly to dew falling from an umbrella. As a result, clog up of the inlet hole 224 is further prevented.

Next, Embodiment 11 of the present invention will be described in detail with reference to the drawings.

Figure 35:
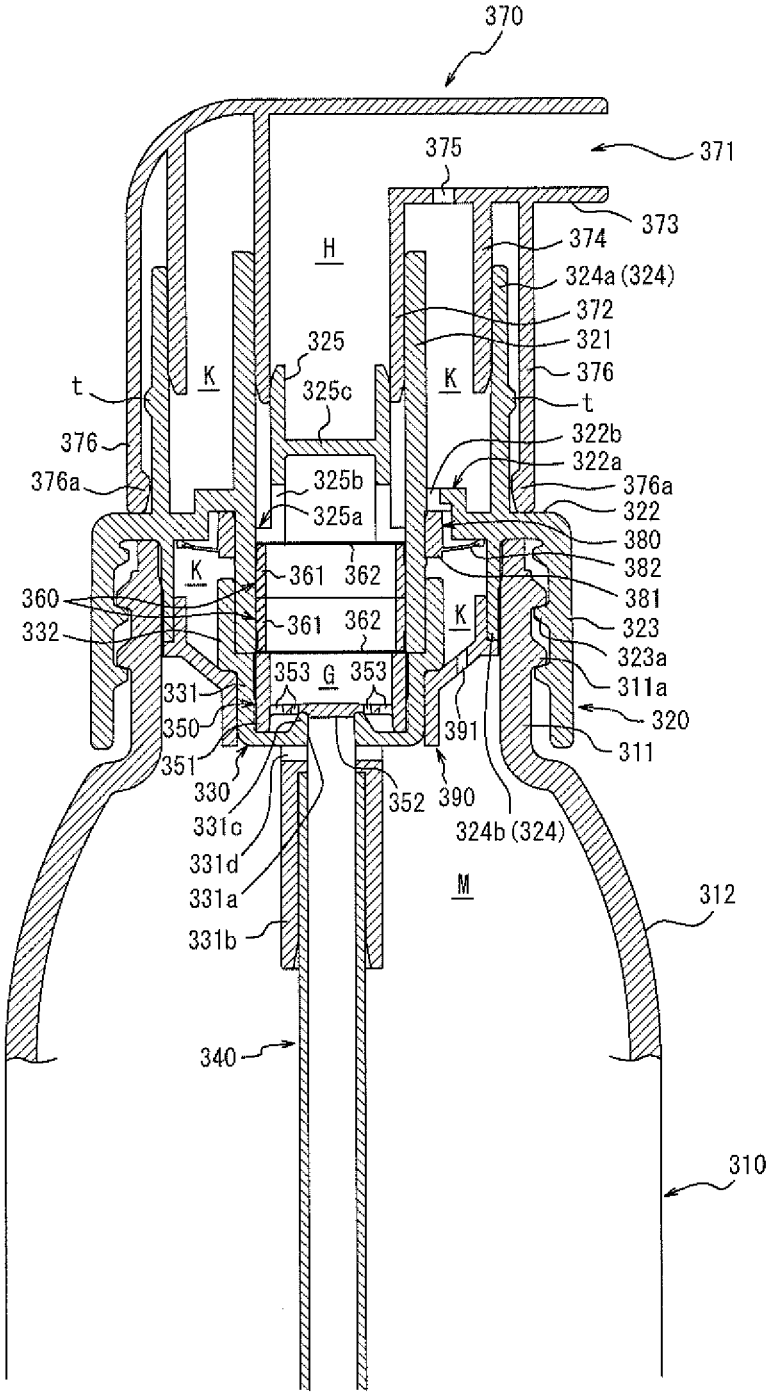
FIG. 35 is a partial sectional view of a dispensing container according to Embodiment 11 of the present invention, illustrating a configuration during distribution.
Figure 36:
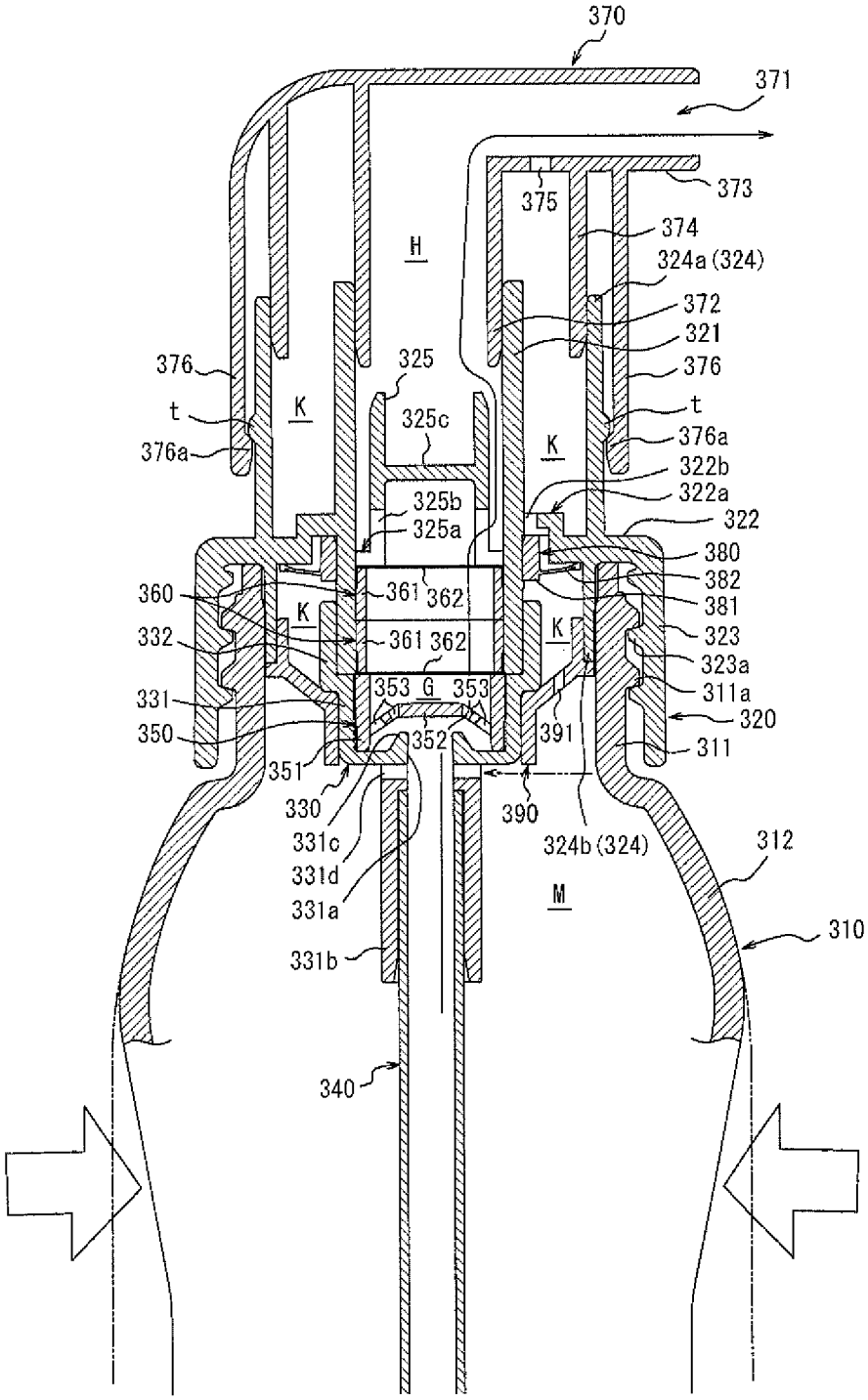
FIG. 36 is a partial sectional view illustrating a position where a trunk of the dispensing container illustrated in FIG. 35 is squeezed.
Figure 37:
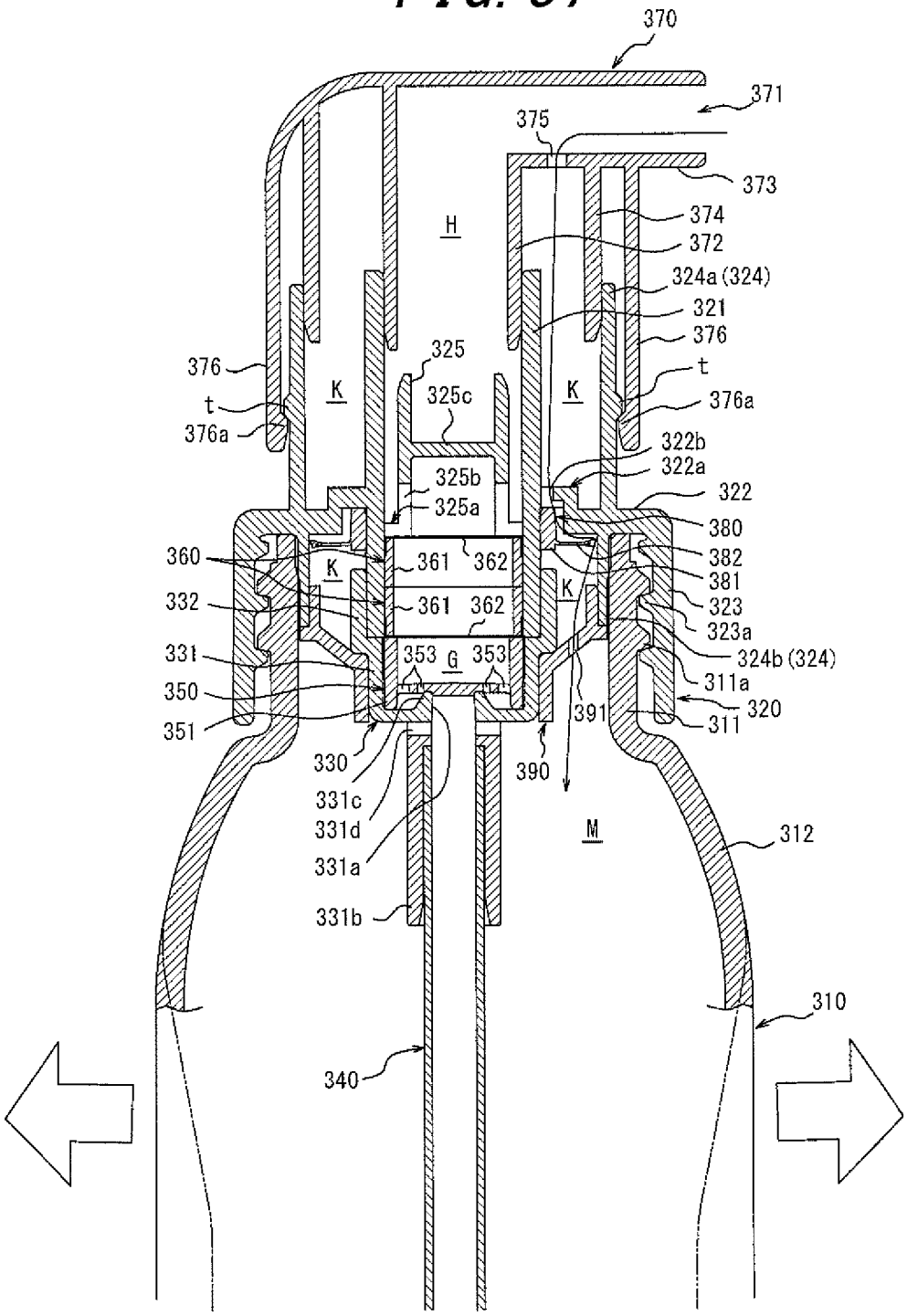
FIG. 37 is a partial sectional view illustrating a position in which the trunk of the dispensing container illustrated in FIG. 36 is restored.
Figure 38:
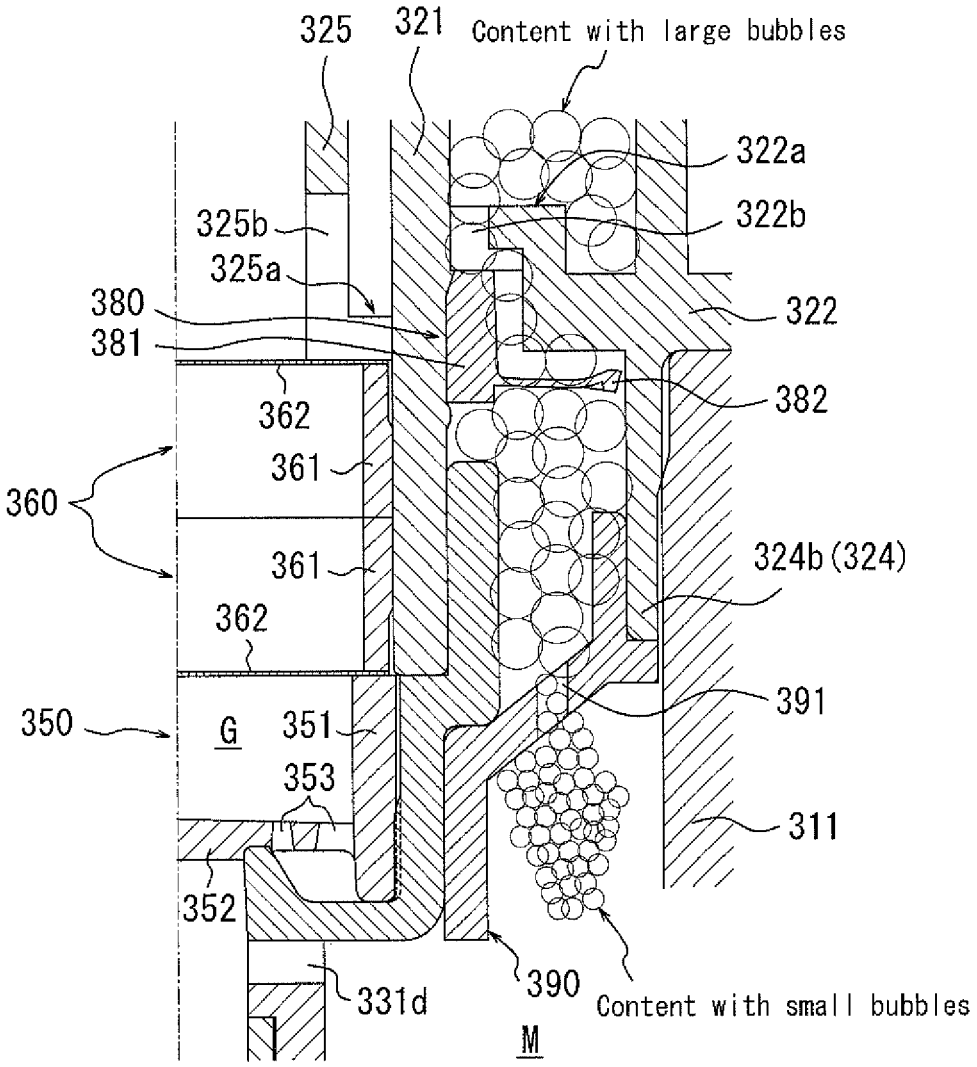
FIG. 38 is an enlarged sectional view of a vicinity of a through-hole and an orifice of the dispensing container illustrated in FIG. 37.

FIG. 35 is a partial sectional view of a dispensing container according to Embodiment 11 of the present invention, illustrating a configuration during distribution, FIG. 36 is a partial sectional view illustrating a position where a trunk of the dispensing container illustrated in FIG. 35 is squeezed, FIG. 37 is a partial sectional view illustrating a position in which the trunk of the dispensing container illustrated in FIG. 36 is restored, and FIG. 38 is an enlarged sectional view of a vicinity of a through-hole and an orifice of the dispensing container illustrated in FIG. 37.

In FIG. 35, reference numeral 310 refers to the container body. The container body 310 has substantially the same structure as that of the aforementioned container body 110.

Reference numeral 320 refers to the base cap configured to close the filling space M provided in the container body 310. The base cap 320 includes a tubular body 321 that stands along an axis line of the container body 310 in the mouth 311, a ceiling wall 322 that extends radially outward from an axially middle portion of the tubular body 321 and that is integrally connected to the tubular body 321 via a stepped portion 322*a*, and a circumferential wall 323 suspended from an edge portion of the ceiling wall 322. The circumferential wall 323 includes an inner surface wall provided with a screw portion 323*a* in correspondence with a screw portion 311*a*, and the base cap 320 is detachably fixed and held to the mouth 311. Note that, although in the drawing it is illustrated that the base cap 320 is fixed and held by screw, the base cap 320 may be fixed and held by undercut.

On an upper surface of the ceiling wall 322, an upper outer tube 324*a* is provided to surround the tubular body 321 with space therebetween, and on a lower surface of the ceiling wall 322, a lower outer tube 324*b* is also provided to surround the tubular body 321 with space therebetween. The upper outer tube 324*a* has an outer surface wall provided in an axially middle portion thereof with a protrusion t that protrudes radially outward. Moreover, the stepped portion 322*a*, where the tubular body 321 is connected to the ceiling wall 322, is provided with a plurality of opening holes 322*b* that are arranged at an interval in the circumferential direction. Thus, the annular passage K, connected through the opening hole 322*b*, is formed between the tubular body 321 and the upper outer tube 324*a* and between the tubular body 321 and the lower outer tube 324*b*. Note that the upper outer tube 324*a* and the lower outer tube 324*b* are collectively referred to as an outer tube 324.

Moreover, inside the tubular body 321, there is provided an inner tube 325 that is away from an inner surface wall of the tubular body 321. The inner tube 325 is integrally connected to the tubular body 321 via a flange 325*a* that extends radially outward from a lower end of the inner tube 325. In a connecting portion between the tubular body 321 and the inner tube 325, a plurality of drain holes 325*b* is provided at an interval in the circumferential direction. In an axially middle portion of the inner tube 325, a top wall 325*c* is also provided.

Reference numeral 330 refers to the cylinder connected to a lower end portion of the tubular body 321. The cylinder 330 includes a bottomed tubular portion 331 and an annular portion 332 that is integrally connected to an edge portion of the bottomed tubular portion 331 via a stepped portion. The annular portion 332 is fitted with the lower end portion of the tubular body 321, and the junction space G is defined inside thereof. The bottomed tubular portion 331 has a bottom surface provided with a bottom hole 331*a* that passes through back and front of the bottom surface. Below an edge portion of the bottom hole 331*a*, there is provided a cylindrical fitting portion 331*b* that is integrally connected to the bottomed tubular portion 331. Above the edge portion of the bottom hole 331*a*, a protrusion 331*c* is provided to protrude. Moreover, the suction tube 340, which is configured to suck the content stored in the filling space M in response to the trunk 312 being squeezed and to feed the sucked content to the junction space G, is fitted to the fitting portion 331*b*. Above the fitting portion 331*b*, a plurality of inlet holes 331*d* extending radially is provided at an interval in the circumferential direction. When the trunk 312 is squeezed, air contained in the filling space M is introduced to the junction space G.

Note that a check valve 350 is provided inside the bottomed tubular portion 331. The check valve 350 includes a ring 351 and a valve portion 352 that is elastically supported in the ring 351. Around the valve portion 352, valve holes 353 passing through back and front are provided at an interval in the circumferential direction. Portions located between the valve holes 353 elastically connect the ring 351 with the valve portion 352, and accordingly, the valve portion 353 may be seated and detached. As illustrated in FIG. 35, in the check valve 350, the protrusion 331*c* is normally in sealing contact with the valve portion 352 so as to shut off air flow from the inlet hole 331*d*. However, in the present invention, the check valve 350 is not indispensable and may be omitted.

Above the check valve 350, a foaming member 360 is also provided. In the illustrated example, a total of two foaming members 360 are arranged in a vertically symmetrical manner. The foaming member 360 has substantially the same structure as that of the aforementioned foaming member 150.

In an upper end portion of the tubular body 321, there is also provided a lateral-type nozzle including an ejection orifice 371 on a side portion thereof. The nozzle 370 includes an annular wall 372 that slidably abuts against the inner surface wall of the tubular body 321, and a partition wall 373 that extends radially outward from the annular wall 372 and that defines the expulsion passage H together with the annular wall 372. Radially outward of the annular wall 372, an annular circumferential wall 374 is also provided to surround the annular wall 372. The annular circumferential wall 374 slidably abuts against an inner surface wall of the upper outer tube 324*a*. The partition wall 373 is also provided with a through-hole 375 that lets the expulsion passage H communicate with the annular passage K. The nozzle 370 also includes a side wall 376 that is provided with a claw portion 376*a* at a lower end of an inner surface wall thereof. Note that liquid-tight abutment contact is established between the annular wall 372 and the tubular body 321 and between the annular circumferential wall 374 and the upper outer tube 324*a*, and accordingly, leakage of the content is prevented.

In the lower portion of the annular passage K divided by the ceiling wall 322 of the base cap 320, a check valve 380 is provided. The check valve 380 includes a ring 381, and an elastically displaceable valve body 382 that is arranged outside the ring 381. In the illustrated example, the check valve 380 is arranged in the stepped portion 322*a* of the ceiling wall 322 and is held by an undercut portion provided in an outer surface wall of the tubular body 321 such that the check valve 380 is prevented from slipping off. As illustrated in FIG. 35, in the check valve 380, the valve body 382 is normally in sealing contact with the lower surface of the ceiling wall 322 so as to shut off air flow from the opening hole 322*b*.

In a lower end portion of the outer tube 324 (i.e. a lower end portion of the lower outer tube 324*b*), a partition wall 390 is provided. The partition wall 390 extends from the lower end portion to the cylinder 330, thereby defining the annular passage K. In the illustrated example, the partition wall 390 is secured between the inner surface wall of the outer tube 324 and an outer surface wall of the bottomed tubular portion 331 and is held and prevented from slipping off. The partition wall 390 is provided with an opening 391 passing through back and front of the partition wall 390, and the annular passage K communicates with the filling space M through the opening 391. Additionally, the partition wall 390 may be, for example, integrally connected to the cylinder 330, and thus formed cylinder 330 may be fitted in the outer tubular 324.

The dispensing container configured as above maintains the nozzle 370 in a descending position illustrated in FIG. 35 during distribution, and therefore effectively prevents unrequired leakage of the content. For expulsion of the content, the nozzle 370 is displaced from the descending position illustrated in FIG. 35 to an ascending position illustrated in FIG. 36. Since the nozzle 370 is provided with the claw portion 376*a* that engages with the protrusion t provided in the base cap 320, it is possible to stop ascending of the nozzle 370 in a desired position.

Subsequently, as illustrated in FIG. 36, the trunk 312 is squeezed. The content under the resulting pressure flows toward the bottom hole 331*a* through the suction tube 340 as indicated by an arrow in solid line in FIG. 36. Similarly, air under pressure flows toward the bottom hole 331*a* through the inlet hole 331*d* and lifts up the valve portion 352 as indicated by an arrow in a two-dot chain line in FIG. 36. After passing the valve portion 352, the content and air reaches the junction space G through the valve hole 353 and mixed, and then passes through the foaming members 360 in the form of the mixture. The content, which is turned into a desired foam by passing through the foaming members 360, is expelled from the ejection orifice 371 through the expulsion passage H. Meanwhile, even when pressure is applied to the filling space M, since the opening hole 322*b* is closed by the valve body 382, air contained in the filling space M does not escape to the outside through the opening hole 322*b*.

After the expulsion of the content, when squeezing of the trunk 312 is released, the flexible trunk 312 is restored to the original shape as illustrated in FIG. 37. Consequently, the filling space M assumes the negative pressure, and as indicated by an arrow in solid line in FIG. 37, outer air passes through the through-hole 375 from the ejection orifice 371, displaces the valve body 382 of the check valve 380 downward, and is introduced to the filling space M. At the same time, the foamed content remaining in the expulsion passage H is also drawn back to the annular passage K, and accordingly, it is ensured that liquid dripping from the ejection orifice 371 due to the remaining content is prevented. Here, the annular passage K serves as a storage space that is defined by the partition wall 390 and that temporality stores the remaining content introduced into the annular passage K, and therefore, the remaining content being foamed is temporality retained in the storage space. Consequently, the remaining content is returned to the filling space M with reduced bubbles. Furthermore, as illustrated in FIG. 38, after passing through the opening 391, the content remaining in the annular passage K in the form of relatively large bubbles is returned to the filling space M in the form of bubbles smaller than an opening area of the opening 391. As a result, the filling space M is prevented from being immediately filled with the bubbles of the remaining content, and the inlet hole 331*d* is less likely to be clogged up by the bubbles of the remaining content. Accordingly, the mixture ratio of the content and air is maintained to be the desired ratio, and the fine-textured foam is stably and continuously expelled.

After the restoration of the trunk 312, the nozzle 370 is displaced to the descending position illustrated in FIG. 35. By doing so, the annular wall 372 comes into sealing contact with the inner tube 325, and communication between the junction space G and the expulsion passage H is closed. As a result, it is further ensured that the filling space M is sealed.

When the opening 391 provided in the partition wall 390 is smaller in opening area than a the through-hole 375 having a smallest possible opening area, the size of the bubbles of the remaining content to be stored is reliably reduced. As a result, the fine-textured foam is even more stably expelled. Additionally, the through-hole 375 should not necessarily be provided in the partition wall 373 and may be provided in the annular wall 372. Furthermore, the opening area of the opening hole 322*b* may be reduced, and the size of the bubbles of the remaining content may be reduced by the opening hole 322*b* as well.

When the annular passage K is provided around the expulsion passage H as illustrated in the figures, inner space is effectively used, and the aforementioned desired foam is stably expelled without enlarging a size of the container.

Next, Embodiment 12 of the present invention will be described in detail with reference to the drawings.

Figure 39:
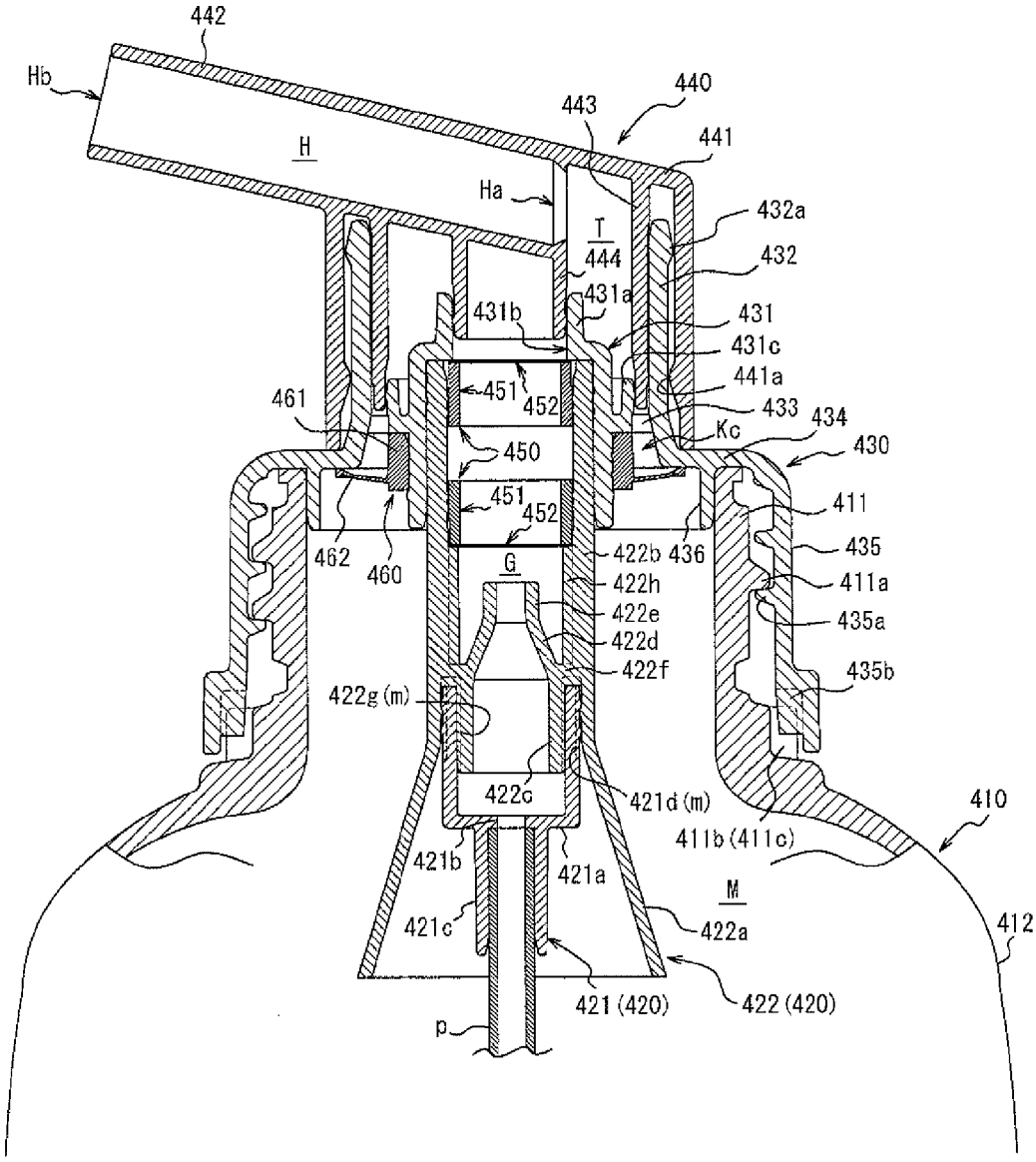
FIG. 39 is a partial sectional view of a dispensing container according to Embodiment 12 of the present invention in which a head is displaced to a descending position.
Figure 40:
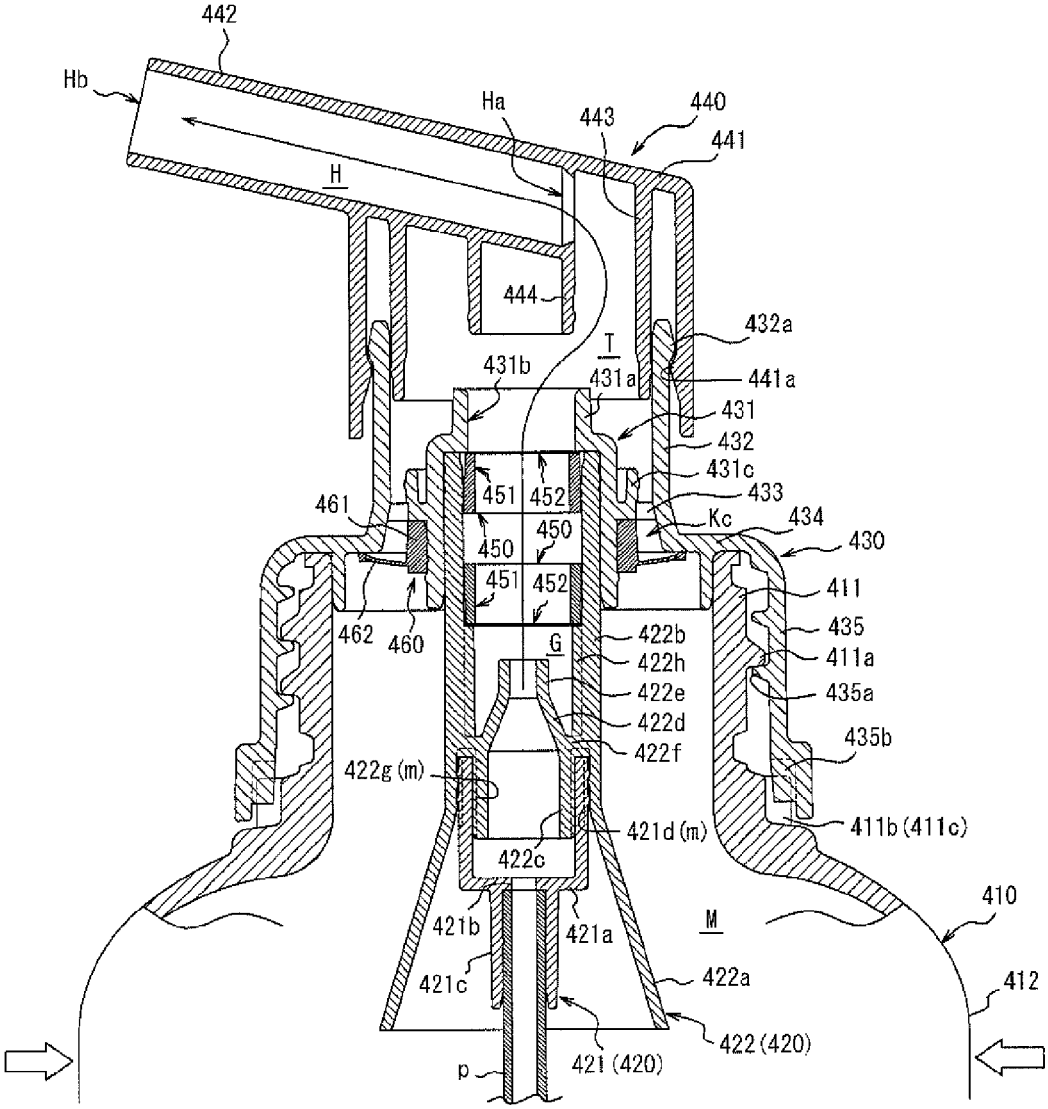
FIG. 40 is a partial sectional view illustrating a position in which the head of the dispensing container illustrated in FIG. 39 is displaced to an ascending position and a trunk is squeezed.
Figure 41:
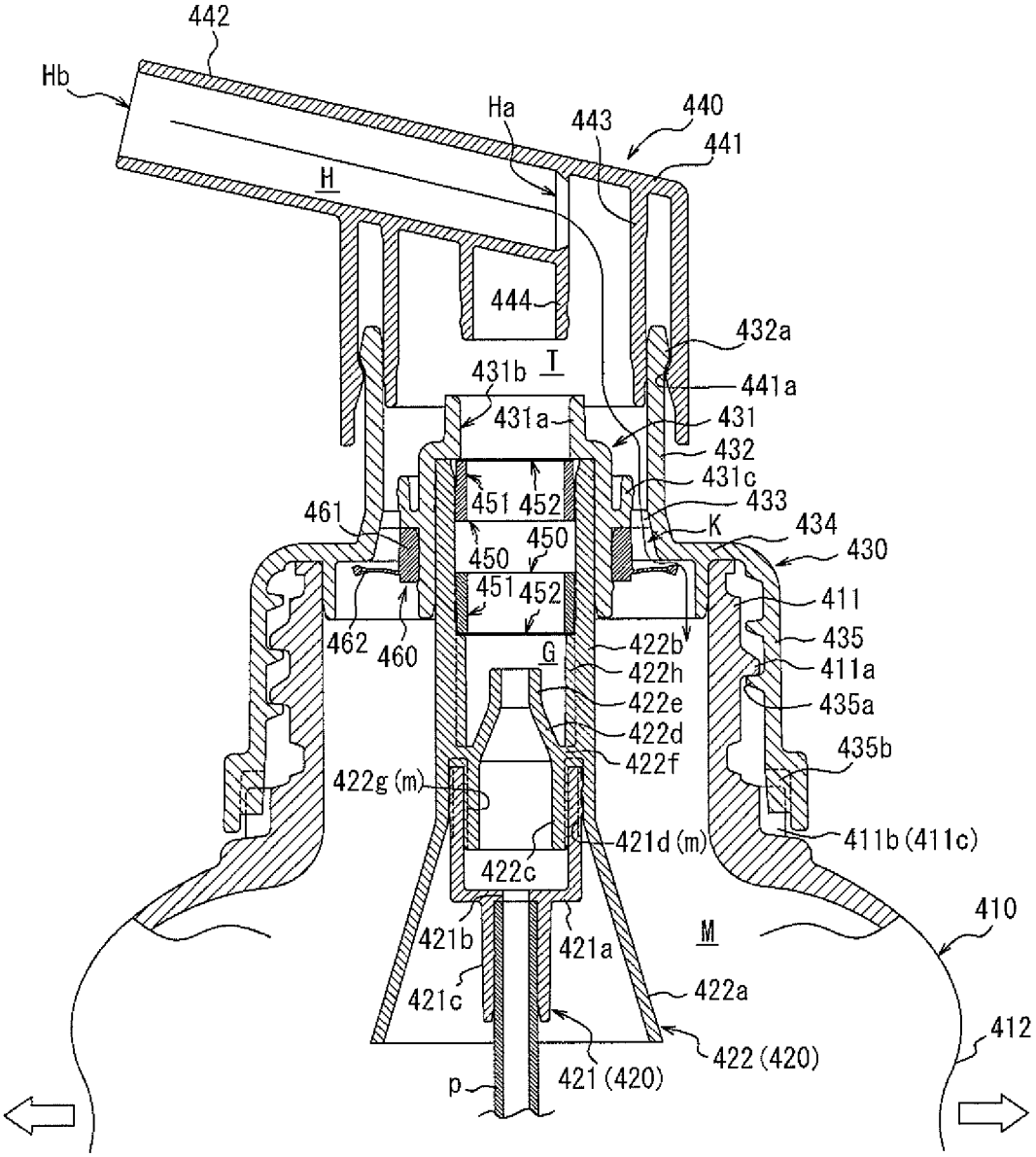
FIG. 41 is a partial sectional view illustrating a position in which the trunk of the dispensing container illustrated in FIG. 40 is restored.

FIG. 39 is a partial sectional view of a dispensing container according to Embodiment 12 of the present invention in which a head is displaced to a descending position, FIG. 40 is a partial sectional view illustrating a position in which the head of the dispensing container illustrated in FIG. 39 is displaced to an ascending position and a trunk is squeezed, and FIG. 41 is a partial sectional view illustrating a position in which the trunk of the dispensing container illustrated in FIG. 40 is restored.

In FIG. 39, reference numeral 410 refers to the container body. The container body 410 has substantially the same structure as that of the aforementioned container body 210.

Reference 420 refers to the cylinder that introduces the content and air to an inside thereof to be foamed. In the illustrated example, the cylinder 420 includes a lower cylinder portion 421 forming a bottom portion of the cylinder 420 and an upper cylinder portion 422 forming the trunk of the cylinder 420.

The lower cylinder portion 421 includes a lower cylinder body 421*a* having a bottomed cylindrical shape, a hole 421*b* that is provided through a bottom portion of the lower cylinder body 421*a*, a fitting portion 421*c* that is provided in correspondence with the hole 421*b* and that is fitted with and holds the suction tube p configured to suck the content stored in the filling space M. An outer circumferential surface of an upper portion of the lower cylinder body 421*a* is provided with a groove 421*d*.

The upper cylinder portion 422 includes a conical wall 422*a* that is tapered such that a diameter increases from top to bottom and that surrounds the lower cylinder portion 421, and a cylindrical upper cylinder body 422*b* that is integrally connected to an upper portion of the conical wall 422*a*. On an inner circumferential side of the upper cylinder body 422*b*, a cylindrical large-diameter portion 422*c*, an inclined portion 422*d*, and a cylindrical small-diameter portion 422*e* are also provided in an integrally connected manner and are connected to an inner surface of the upper cylinder body 422*b* via a connecting portion 422*f*. The cylindrical large-diameter portion 422*c* holds the lower cylinder portion 421 such that the lower cylinder portion 421 is fitted between the conical wall 422*a* and the large-diameter portion 422*c*. The inclined portion 422*d* has a diameter decreasing from the large-diameter portion 422*c* toward top. The small-diameter portion 422*e* stands above the inclined portion 422*d*. The large-diameter portion 422*c* and the connecting portion 422*f* are provided with a groove 422*g* in correspondence with the groove 421*d* provided in the lower cylinder portion 421. The groove 421*d* and the groove 422*g* together form an inlet passage in for introducing air contained in the filling space M into the cylinder 420. The connecting portion 422*f* is also provided, at an upper portion thereof, with a plurality of support ribs 422*h* at an interval in the circumferential direction. The support ribs 422*h* support, from below, a foaming member that is later described.

In the lower cylinder portion 421 and the upper cylinder portion 422 that are configured as above, a recessed space is defined inside thereof, and the recessed space serves as the junction space G in which the content and air are introduced and mixed to be foamed.

Reference numeral 430 refers to the base cap configured to be mounted to a mouth 411 of the container body 410. The base cap 430 includes an inner tube 431 having a bottomed cylindrical shape that is fitted with and holds the upper cylinder body 422*b*, and an outer tube 432 that surrounds the inner tube 431 with space therebetween. The inner tube 431 is linked to the outer tube 432 via a plurality of connecting portions 433 provided at an interval in the circumferential direction. Between the inner tube 431 and the outer tube 432, there is provided an annular space Kc that communicates with the filling space M through space between adjacent two connecting portions 433. The outer tube 432 is also provided at an upper portion thereof with an outwardly protruding portion 432*a* that bulges out toward an outer circumference thereof.

The outer tube 432 is arranged on a ring-shaped ceiling wall 434 that is provided on the mouth 411. On an outer edge portion of the ceiling wall 434, an outer wall 435 is provided to surround the mouth 411. The outer wall 435 has an inner surface provided with a screw portion 435*a* that engages with a screw portion 411*a* of the mouth 411. The outer wall 435 also has a lower end portion provided with a detent rib 435*b* that has substantially the same structure as that of the detent rib 234*b* illustrated in FIG. 32. With the above structure, when the base cap 430 is screwed, right before the base cap 430 is completely screwed in, the detent rib 435*b* crosses the small protuberance 411*b* and is locked against rotation and held between the small protuberance 411*b* and the large protrusion 411*c*. Furthermore, as illustrated in FIG. 39, a sealing wall 436 is provided on a rear surface of the ceiling wall 434. The sealing wall 436 is in sealing contact with an inner circumferential surface of the mouth 411 and maintains air-tight sealing between the container body 410 and the base cap 430. Note that, although in the drawing it is illustrated that the base cap 430 is fixed and held by screw, the base cap 430 may be fixed and held by undercut.

The inner tube 431 also includes a tubular body 431*a* standing from a top portion thereof, and an inner circumferential side of the tubular body 431*a* forms an upper opening 431*b* that extends through the top portion of the inner tube 431 and that communicates with an inside of the cylinder 420. On an outer circumferential side of the inner tube 431, an elastic wall 431*c* is also provided. A lower portion of the elastic wall 431*c* is coupled to an outer circumferential surface of the inner tube 43, and an upper portion of the elastic wall 431*c* forms a free end.

Reference numeral 440 refers to the head provided above the base cap 430. The head 440 includes a head body 441 having a bottomed cylindrical shape, and a nozzle 442 that is tilted upward toward a front end thereof and that is integrally connected to the head body 441. Inside the nozzle 442, the expulsion passage H for the content is formed, and the content is introduced from a rear end orifice Ha provided at a rear end of the nozzle 442 and is dispensed to the outside from a front end orifice Hb. The head body 441 is also provided, in an opening portion in a lower portion thereof, with an inwardly protruding portion 441*a* that bulges out toward an inner circumference of the head body 441.

Inside the head body 441, an annular wall 443 is provided. The annular wall 443 extends along an inner circumferential surface of the outer tube 432 and that is slidable relative to the outer tube 432. With the above structure, the head body 441 is capable of being displaced to the ascending and the descending position along an axis line of the outer tube 432. In the descending position of the head body 441 as illustrated in FIG. 39, a lower end portion of the annular wall 443 is in sealing contact with the elastic wall 431*c*. On an inner circumferential side of the annular wall 443, a plug body 444 is also provided. The plug body 444 is in sealing contact with an inner circumferential surface of the tubular body 431*a* in the descending position of the head body 441.

Reference numeral 450 refers to the foaming member disposed in the junction space G. In the illustrated example, one forming member 450 is disposed both on the support ribs 422*h* and at an opening end of the upper cylinder body 422*b*, and these foaming members 450 are fitted and held in an inner circumferential surface of the upper cylinder body 422*b*. The foaming member 450 has substantially the same structure as that of the aforementioned foaming member 150.

Reference numeral 460 refers to the check valve disposed between the annular space Kc and the filling space M. In the illustrated example, the check valve 460 is fitted and held to an outer circumferential wall of the inner tube 431. The check valve 460 also includes a ring 461, and an elastically displaceable annular valve body 462 that is arranged outside the ring 461. The valve body 462 is in sealing contact with the rear surface of the ceiling wall 434 of the base cap 430. With the above structure, air and the content introduced from the filling space M are not expelled to the annular space Kc, while outer air or the like is introduced into the filling space M through the annular space Kc.

As illustrated in FIG. 39, in the dispensing container configured as above, by displacing the head body 441 downward and maintaining the head body 441 in the descending position, the plug body 444 is in sealing contact with the inner circumferential surface of the tubular body 431*a*, thereby preventing the content from being dispensed. As a result, unrequired leakage of the content during distribution is prevented. Particularly when the elastic wall 431*c* is provided to be in sealing contact with the annular wall 443 as illustrated in the figures, the filling space M is sealed, and deformation of the trunk 412 is further prevented. As a result, it is further ensured that unrequired dispensing of the content is prevented.

Furthermore, as illustrated in FIG. 40, in the dispensing container according to the present invention the upper opening 431*b* and the annular space Kc are released simply by pulling the head body 441 upward. Accordingly, the dispensing container may be placed into a condition ready for dispensing by a simple operation. Besides, when the outwardly protruding portion 432*a* and the inwardly protruding portion 441*a* are provided as illustrated in the figures, the protruding portions 432*a* and 441*a* may serve to prevent the head body 441 from slipping off.

Upon squeezing of the trunk 412, pressure is applied to the filling space M under the effect of the check valve 460, and the content passes through the suction tube p and is introduced to the junction space G. Similarly, under pressure, air contained in the filling space M also passes though the inlet passage m and reaches the junction space G. By causing the content to pass through the foaming members 450 after being mixed with air, the content is turned into a desired foam.

In the present embodiment, as illustrated in FIG. 40, in the position in which the head 440 is displaced upward, space (relay space T) is formed inside the outer tube 432 and the annular wall 443. The relay space T serves as a feeding passage for feeding the foamed content from the upper opening 431*b* toward the expulsion passage H. Accordingly, as indicated by arrows in FIG. 40, the foamed content is introduced to the expulsion passage H from the rear end orifice Ha and dispensed from the front end orifice Hb.

Subsequently, as illustrated in FIG. 41, when squeezing of the trunk 412 is released, the flexible trunk 412 is restored to the original shape. Consequently, the filling space M assumes the negative pressure, and the foamed content remaining in the expulsion passage H is drawn back to the relay space T together with outer air as indicated by an arrow in FIG. 41. Meanwhile, although it is hard for air or the like to flow in the inside of the cylinder 420 because of the foaming members 450 and the small-diameter portion 422*e*, the check valve 460 is easily opened with respect to flow from the annular space Kc toward the filing space M, the content remaining in the relay space T is returned to the filling space M through the annular space Kc.

In this regard, it is assumed, when the returned content flows into the inlet passage m that introduces air into the cylinder 420, that the mixture ratio of the content and air within the cylinder 420 might be changed from the desired ratio and that texture of the foam might be deteriorated (i.e. texture of the foam becomes coarse). However, since in the illustrated example the conical wall 422*a* is provided to cover the inlet passage m, even when the remaining content to be returned is increased as a result of repeated dispensing operations, the desired foam is maintained.

INDUSTRIAL APPLICABILITY

As has been described, the squeeze-type dispensing container according to the present invention has a relatively simple structure, has smooth dispensing operability and excellent hygiene free from the problem of liquid dripping or the like, and is capable of reducing costs of components.

The dispensing container according to the present invention is expected to be widely used as a dispensing container for a foamed liquid.

REFERENCE SIGNS

1 container body
2 mouth
4 trunk
11 base cap
12 top wall
13 outer wall
14 sealing wall
15 nozzle
15*a* horizontal portion
15*b* vertical portion
16 front end orifice
17 through-hole
18 stepped portion
19 extended portion
21 cylinder
22 fitting tubular piece
22*a* bottom wall
23 outer tubular piece
24 valve body
26 inlet hole
27 suspended tubular piece
28 locking ridge
31 foaming member
32 suction tube
Ar gas (air)
FL foamed liquid
K foaming mechanism
L liquid
P tubular passage
R junction space
110 container body
111 mouth
112 trunk
120 cylinder
121 cylinder body
121*a* inlet hole
121*b* annular wall (123 shielding wall)
121*c* tongue piece (123 shielding wall)
121*f* barrier wall (123 shielding wall)
130 base cap
136*c* through-hole
140 nozzle
M filling space
G junction space
H expulsion passage
p suction tube
210 container body
211 mouth
212 trunk
220 cylinder
221 flange
221*b* outlet hole
221*c* annular wall
224 inlet hole
230 base cap
236 nozzle
238 through-hole
310 container body
311 mouth
312 trunk
320 base cap
321 tubular body
322 ceiling wall
323 circumferential wall
324 outer tube
325 inner tube
330 cylinder
331 bottomed tubular portion
331*d* inlet hole
332 annular portion
340 suction tube
350 check valve
360 foaming member
370 nozzle
371 ejection orifice
375 through-hole
376 side wall
380 check valve
390 partition wall
391 opening
410 container body
411 mouth
412 trunk
420 cylinder
430 base cap
431 inner tube
431*b* upper opening
431*c* elastic wall
432 outer tube
440 head
441 head body
442 nozzle
443 annular wall
444 plug body

The invention claimed is:

1. A dispensing container that dispenses as foam a liquid containable therein, comprising:

a container body including a flexible trunk configured to store therein the containable liquid; and a base cap mounted to a mouth of the container body, wherein:

at a top wall of the base cap is provided a nozzle that forms a tubular passage communicating with a front end orifice, the nozzle (i) having a vertical portion that extends in an axis direction of the container body, (ii) having a horizontal portion that extends in a lateral direction of the container body, and (iii) being bent from the axis direction to the lateral direction and toward the front end orifice, an upstream end portion of the nozzle is provided with a foaming mechanism for the liquid, a through-hole is provided at a rearmost end wall of the vertical portion of the nozzle that is downstream of the foaming mechanism, the through-hole is provided with a check valve, and the front end orifice communicates with an inside of the container body through the through-hole.

2. The dispensing container of claim 1, wherein:

the foaming mechanism is constituted by a junction space and a foaming member that are provided in the upstream end portion of the nozzle, and the foaming member is disposed downstream of the junction space.

3. The dispensing container of claim 2, wherein:

a tubular cylinder is engagedly assembled and fixed to the upstream end portion of the nozzle, and the foaming member is assembled and fixed in the tubular cylinder.

4. The dispensing container of claim 3, wherein, at a lower end portion of the tubular cylinder, (i) a suction tube for supplying the liquid to the junction space is suspendedly provided, and (ii) an inlet hole for supplying air to the junction space is provided.

5. The dispensing container of claim 3, wherein a ring-shaped valve body is contiguously provided around a circumferential wall of the tubular cylinder as an outer flange, the valve body serving as the check valve for the through-hole.

6. A dispensing container that dispenses as foam a liquid containable therein, comprising:

a container body including a flexible trunk configured to store therein the containable liquid; and a base cap mounted to a mouth of the container body, wherein:

at a top wall of the base cap is provided a nozzle that forms a tubular passage communicating with a front end orifice, the nozzle (i) having a vertical portion that extends in an axis direction of the container body, (ii) having a horizontal portion that extends in a lateral direction of the container body, and (iii) being bent from the axis direction to the lateral direction and toward the front end orifice, an upstream end portion of the nozzle is provided with a junction space and a foaming member that constitute a foaming mechanism for the liquid, the foaming member being disposed downstream of the junction space, a through-hole is provided at a lower end portion of a circumferential wall of an extended portion of the horizontal portion of the nozzle, the extended portion being downstream of the foaming mechanism and projecting from the vertical portion toward a direction opposite the front end orifice, the through-hole being provided with a check valve, and the front end orifice communicating with an inside of the container body through the through-hole, a tubular cylinder is engagedly assembled and fixed to the upstream end portion of the nozzle, the foaming member being assembled and fixed in the tubular cylinder, and a ring-shaped valve body is contiguously provided around a circumferential wall of the tubular cylinder as an outer flange, the valve body serving as the check valve for the through-hole.

7. The dispensing container of claim 1, wherein the rearmost end wall of the nozzle faces the front end orifice.

8. The dispensing container of claim 1, wherein the rearmost end wall and the front end orifice are on opposite sides of the foaming mechanism.

9. The dispensing container of claim 6, wherein the through-hole and the flout end orifice are on opposite sides of the foaming mechanism.

* * * * *